US009074352B2

(12) United States Patent
Ramun

(10) Patent No.: US 9,074,352 B2
(45) Date of Patent: Jul. 7, 2015

(54) UNIVERSAL CONTROL SCHEME FOR MOBILE HYDRAULIC EQUIPMENT AND METHOD FOR ACHIEVING THE SAME

(76) Inventor: John R. Ramun, Poland, OH (US)

( * ) Notice: Subject to any disclaimer, the term of this patent is extended or adjusted under 35 U.S.C. 154(b) by 951 days.

(21) Appl. No.: 13/181,179

(22) Filed: Jul. 12, 2011

(65) Prior Publication Data

US 2012/0000192 A1 Jan. 5, 2012

Related U.S. Application Data

(63) Continuation-in-part of application No. 11/728,969, filed on Mar. 27, 2007, now Pat. No. 7,975,475.

(60) Provisional application No. 61/448,448, filed on Mar. 2, 2011, provisional application No. 60/786,173, filed on Mar. 27, 2006.

(51) Int. Cl.

| | |
|---|---|
| ***E02F 3/30*** | (2006.01) |
| ***E02F 3/96*** | (2006.01) |
| ***E02F 9/20*** | (2006.01) |
| ***E02F 9/22*** | (2006.01) |
| ***F15B 11/16*** | (2006.01) |

(52) U.S. Cl.

CPC ..... *E02F 3/301* (2013.01); *E02F 3/965* (2013.01); *E02F 3/966* (2013.01); *E02F 9/2004* (2013.01); *E02F 9/2012* (2013.01); *E02F 9/2221* (2013.01); *F15B 11/16* (2013.01); *F15B 2211/30525* (2013.01); *F15B 2211/327* (2013.01); *F15B 2211/40523* (2013.01); *F15B 2211/40584* (2013.01); *F15B 2211/5059* (2013.01); *F15B 2211/7135* (2013.01)

(58) Field of Classification Search

CPC ..... F15B 11/16; F15B 2211/30525; F15B 2211/327; F15B 2211/40523; F15B 2211/40584; F15B 2211/5059; F15B 2211/7135; E02F 3/301; E02F 3/965; E02F 3/966; E02F 9/2004; E02F 9/2012; E02F 9/2221

USPC ..... 91/525, 526, 527, 529, 530, 531

See application file for complete search history.

(56) References Cited

U.S. PATENT DOCUMENTS

| | | | | |
|---|---|---|---|---|
| 4,561,341 | A * | 12/1985 | Aikawa | 91/531 |
| 5,940,997 | A | 8/1999 | Toyooka et al. | |
| 6,619,037 | B1 | 9/2003 | Toyooka et al. | |
| 6,854,554 | B2 | 2/2005 | Brandt et al. | |
| 6,994,284 | B1 | 2/2006 | Ramun | |

(Continued)

FOREIGN PATENT DOCUMENTS

| | | |
|---|---|---|
| DE | 3518892 | 2/1987 |
| DE | 4433633 | 12/1995 |

(Continued)

*Primary Examiner* — Michael Leslie
(74) *Attorney, Agent, or Firm* — The Webb Law Firm

(57) ABSTRACT

A universal control scheme for mobile hydraulic equipment has switches to activate and/or control any number of different tools or accessories that may be used to configure the equipment. Additionally, a single controller command may be reassigned from one set to another set of hydraulic line pairs. Furthermore, at different times, two separate controller commands may be used to control the same hydraulic line pair. The control scheme also provides for consolidating hydraulic line pair functions to separate for dedicated use those line pairs associated with operating hydraulic cylinders to extend or retract a member and those line pairs used to provide hydraulic fluid for operating tools.

18 Claims, 44 Drawing Sheets

(56) References Cited

U.S. PATENT DOCUMENTS

| | | | | |
|---|---|---|---|---|
| 7,975,475 | B2 * | 7/2011 | Ramun | 60/427 |
| 2003/0019681 | A1 | 1/2003 | Nakamura | |
| 2006/0157605 | A1 | 7/2006 | Ramun et al. | |

FOREIGN PATENT DOCUMENTS

| | | | |
|---|---|---|---|
| EP | 0900889 | A | 3/1999 |
| EP | 1178157 | A | 2/2002 |
| EP | 1260716 | A1 | 11/2002 |
| EP | 1561865 | | 8/2005 |
| JP | 04312679 | A | 11/1992 |
| JP | 540346 | U | 6/1993 |
| JP | 2000008400 | | 1/2000 |
| JP | 2000199244 | A | 7/2000 |
| JP | 2000273916 | A | 10/2000 |
| JP | 2002188177 | A | 7/2002 |

* cited by examiner

800

900

| | M3 | M4 | M5 |
|---|---|---|---|
| AUX BOOM EXT/RET | A | – | – |
| SHEAR OPEN/CLOSE | A | B | – |
| SHEAR CURL/EXT | A | B | C |
| BUCKET CURL/DUMP | D | D | D |
| SHEAR ROTATE L/R | E | E | E |
| HAMMER | F | F | F |
| | | | |
| MAGNET | G | G | G |
| M3 QD | H | – | – |
| M4 QD | H | I | – |
| M5 QD | H | I | J |

UNIVERSAL CONTROL SCHEME FOR MOBILE HYDRAULIC EQUIPMENT AND METHOD FOR ACHIEVING THE SAME

CROSS REFERENCE TO RELATED APPLICATIONS

This application claims the benefit of U.S. Provisional Application No. 61/448,448 filed Mar. 2, 2011 and is a continuation-in-part of U.S. patent application Ser. No. 11/728,969 filed Mar. 27, 2007, which claims the benefit of U.S. Provisional Application No. 60/786,173 filed Mar. 27, 2006. The contents of U.S. Provisional Application No. 61/448,448 filed Mar. 2, 2011 are hereby incorporated by reference.

BACKGROUND OF THE INVENTION

1. Field of the Invention

The present invention relates to a universal control scheme associated primarily with the hydraulic system for construction or demolition equipment, wherein the equipment is intended for use with hydraulic attachments such as a bucket, a cutting shear, a grapple, a hammer, a magnet or the like.

2. Description of Related Art

Throughout the application, reference will be made to construction equipment. However, the equipment is also referred to as demolition equipment, scrap handling equipment and the like. The description of construction equipment is not intended to be restrictive of the equipment being referenced. Construction equipment such as heavy-duty metal cutting shears, grapples, and concrete crushers, have been mounted on backhoes powered by hydraulic cylinders for a variety of jobs in the demolition field. This equipment provides for the efficient cutting and handling of scrap. For example, in the dismantling of an industrial building, metal scrap in the form of various diameter pipes, structural I-beams, channels, angles, sheet metal plates and the like must be efficiently severed and handled by heavy-duty metal shears.

However, typically such shears are detachably connected to the hydraulic cylinder such that, if the hydraulic cylinder is intended to be used for a different application, such as digging with a bucket, then the shears may be removed and the bucket may be attached to the hydraulic cylinder for the desired application.

FIG. 1 illustrates the hydraulics associated with a construction machine 10, such as a backhoe. In particular, the many functions of the backhoe are powered by hydraulic fluid, whereby an engine 12 operates hydraulic pumps 14 which take hydraulic fluid from a hydraulic tank 16 and provide it to a plurality of control valves 18. A plurality of hydraulic lines extend from the control valves 18 to different accessories and tools on the backhoe 10. In particular, a boom 20 pivotally attached to the base platform is operated by a boom hydraulic cylinder 24 powered by fluid from the control valves 18. In a similar fashion, a stick 26 and a bucket 28 are pivotally manipulated by associated hydraulic cylinders powered with fluid provided from one of the control valves 18. The platform 22 may be pivoted about the base 30 utilizing a hydraulic swing motor 32, again powered by hydraulic fluid supplied through one of the control valves 18. In general, the control valves 18 are operated within the backhoe cabin (not shown) by the use of two separate joysticks that may be pivoted in different directions and with buttons that may be associated with each of these joysticks.

Oftentimes, hydraulic equipment such as the backhoe illustrated in FIG. 1, may be reconfigured to perform different functions by substituting different parts of the backhoe.

In particular, FIG. 2 illustrates a construction machine 10 which has attached to the stick 26, a shear 35 for which the jaws 36, 38 open and close but, for which also the body 40 rotates about the shear axis 41. It should be appreciated that there is at least one additional function for the construction machine 10 illustrated in FIG. 2 beyond that shown for the construction machine illustrated in FIG. 1. In particular, the shear jaws 36, 38 are capable of opening and closing. Additionally, the body 40 is capable of rotating about its axis 41. Therefore, in order to configure the construction machine 10 illustrated in FIG. 1, it would be necessary to add an entire hydraulic circuit to control the hydraulic motor which would rotate the shear about its axis 41 or, which would open and close the jaws 36, 38, or both.

FIG. 3 illustrates a construction machine 10 which utilizes a grapple 44 attached to the stick 26 whereby, once again, the grapple 44 is capable of rotating about an axis 45 extending therethrough and, once again, a new hydraulic circuit would be required to power the hydraulic motor to rotate the grapple 44 about its axis 45 and/or to open and close the jaws of the grapple 44. The construction machine 10, as illustrated in FIGS. 1-3, utilizes a hydraulic motor to rotate the attachments about their axes. It should be appreciated that the control valve associated with this function is capable of reversing flow through the hydraulic motor so that the rotation of the tool may occur in either direction. Under these circumstances, the circuit that provides this function must include a control valve capable of reversing flow.

FIG. 4 illustrates a construction machine 10 having a hammer 47 attached to the stick 26. Once again, a separate hydraulic function is required to operate the hammer 47. However, unlike the previous configurations, the hammer 47 does not utilize a hydraulic motor capable of reversing, but only utilizes hydraulic fluid under pressure in a single direction to reciprocate the tip of the hammer. This requires the addition of yet another hydraulic line pair having associated therewith a hydraulic valve which does not reverse the flow because, under such circumstances, reversal is not needed.

FIG. 5 illustrates a construction machine 10 having an electric magnet 50 attached to the stick 26.

As can be appreciated, the reconfiguration of a single construction machine may be very involved and hydraulic line pairs used to operate accessories and equipment must be found at different locations on the construction machine 10.

FIG. 6 illustrates a schematic of a simple hydraulic system similar to that which may be associated with the construction machine 10 shown in FIG. 1.

To the extent that the construction machine 10 illustrated in FIG. 1 is designed for the sole purpose of manipulating a bucket 28, then the control valves 18 may be dedicated to particular hydraulic fluid lines, which themselves are dedicated to a particular function on the construction machine 10. In FIG. 6, the hydraulic tank 16 provides fluid to the pump 14 which supplies hydraulic lines 52, 54, 56 connected to associated control valves 58, 60, 62 to control the flow of hydraulic fluid to achieve different functions, for example, functions F1, F2, F3. Directing attention to FIG. 1, function F1 may be manipulating the hydraulic cylinder associated with the boom 20, function F2 may be controlling fluid to the hydraulic cylinder associated with the stick 26, while function F3 may be associated with providing hydraulic fluid to the cylinder which curls and extends the bucket 28. Nevertheless, when the function of each control valve 58, 60, 62 and the associated accessories/tools are determined, design of the hydraulic system to perform this task is relatively straightforward and a controller capable of selectively opening and closing each of the control valves 58, 60, 62 is also relatively simple.

With the expense associated with a construction machine 10, construction machine owners desire to maximize the flexibility of the construction machine 10, not only to alleviate the need to purchase multiple construction machines, but furthermore, to permit the machine owner to purchase a set of complete tools and accessories that may be used on a single construction machine 10.

Additionally, in the past and at best, when different construction machines 10 performed different functions, depending upon the manufacturer of the construction machine and the design of the controller for the control valves, the motion of the joysticks for example, could be different from manufacturer to manufacturer. As a result, the machine operator would be required to learn the protocol of each controller associated with each manufacturer's construction machine prior to using that machine even though the final function between two machines would be identical. This not only provides a substantial learning curve for each different machine, but furthermore, introduces an element of risk when a machine operator changes between different construction machines. A construction machine is needed with the versatility to accept any number of different accessories and/or tools and, furthermore, to provide a central controller capable of controlling each of these functions in a relatively uniform and logical fashion. This would permit a machine operator to learn a protocol associated with each operation, wherein such a protocol will be the same between different machines utilizing the same design.

SUMMARY OF THE INVENTION

One embodiment of the subject invention is directed to a system for activating hydraulic circuits necessary for different functions on a construction machine. The construction machine has a boom as a first member pivotally moved by a first hydraulic cylinder, a stick as a second member pivotally moved by a second hydraulic cylinder, a hydraulic tank with fluid therein, and a hydraulic pump for providing fluid to hydraulic supply lines. Each hydraulic supply line has a related hydraulic return line for returning the fluid to the hydraulic tank thereby defining hydraulic line pairs and each pair of hydraulic lines ends at a terminal adapted to control a hydraulically operated accessory. At least two fixed-function hydraulic line pairs are dedicated to providing fluid to control predetermined machine functions. A first open-function hydraulic line pair for provides fluid to one of a bucket branch line pair or to a tool branch line pair, wherein the fluid in the bucket branch line pair controls a third hydraulic cylinder for curling/extending a bucket extending from the end of a second member and wherein the tool branch line pair controls reciprocating fluid to a dual purpose hydraulic line pair for operating a hydraulic tool. A diverter valve is associated with the first open function line pair for diverting fluid to one of the bucket or tool branch line pairs. There is a first open-function flow control valve for the first open function hydraulic line pair wherein the valve is between the diverter valve and the pump and wherein the flow control valve reciprocates the flow in the open function line pair thereby reciprocating the flow in the bucket branch line or in the tool branch line pair. A hammer fixed line pair provides hydraulic fluid in a single direction for operating a hydraulic hammer, wherein the hammer fixed line pair merges with the dual function hydraulic line pair at a shuttle check valve, such that only one at a time of the hammer fixed line pair or the tool branch line pair may communicate with the dual purpose hydraulic line pair. A flow control valve for the hammer fixed line pair permits pressurized hydraulic fluid to travel in a single direction to the hammer.

Another embodiment of the subject invention is directed to a system for activating hydraulic circuits necessary for different functions on a construction machine. The construction machine has a boom as a first member pivotally moved by a first hydraulic cylinder, a stick as a second member pivotally moved by a second hydraulic cylinder, a hydraulic tank with fluid therein, a hydraulic pump for providing fluid to hydraulic supply lines, wherein each hydraulic supply line has a related hydraulic return line for returning the fluid to the hydraulic tank thereby defining hydraulic line pairs and, wherein each pair of hydraulic lines ends at a terminal adapted to control a hydraulically operated accessory. The system has at least a first and a second main control valve, wherein each main control valve is connected to and reciprocated by one of a separate first and second pair of pilot lines. The system also has a hydraulic supply line pair extending from a pilot pump and branching to connect with and supply fluid to the at least first and second main control valves. A separate pressure reducer module is connected between each of the first pair of pilot lines and the hydraulic supply line pair. A separate pressure reducer module is connected between each of the second pair of pilot lines and the hydraulic supply line pair. The fluid flow from each of the main control valves may be varied by varying the pressure from the pressure reducer module into the main control valve. The pressure modules utilize one of a number of predetermined settings for a particular size and type of hydraulically operated accessory attached to the terminal.

DETAILED DESCRIPTION OF THE INVENTION

Figure 1:
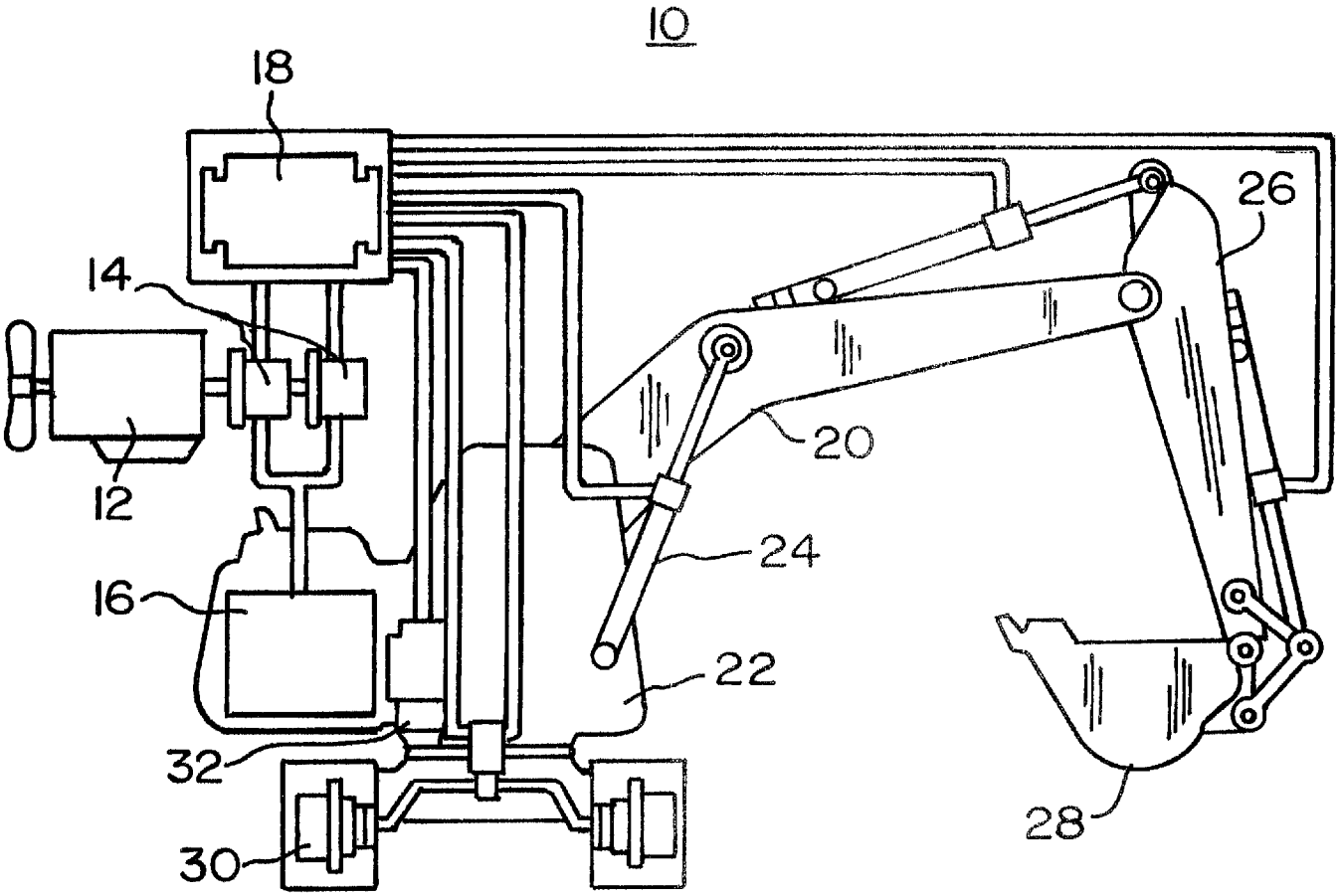
FIG. 1 PRIOR ART
FIG. 1 is prior art and is a sketch of a construction machine used for manipulating a bucket.
Figure 7:
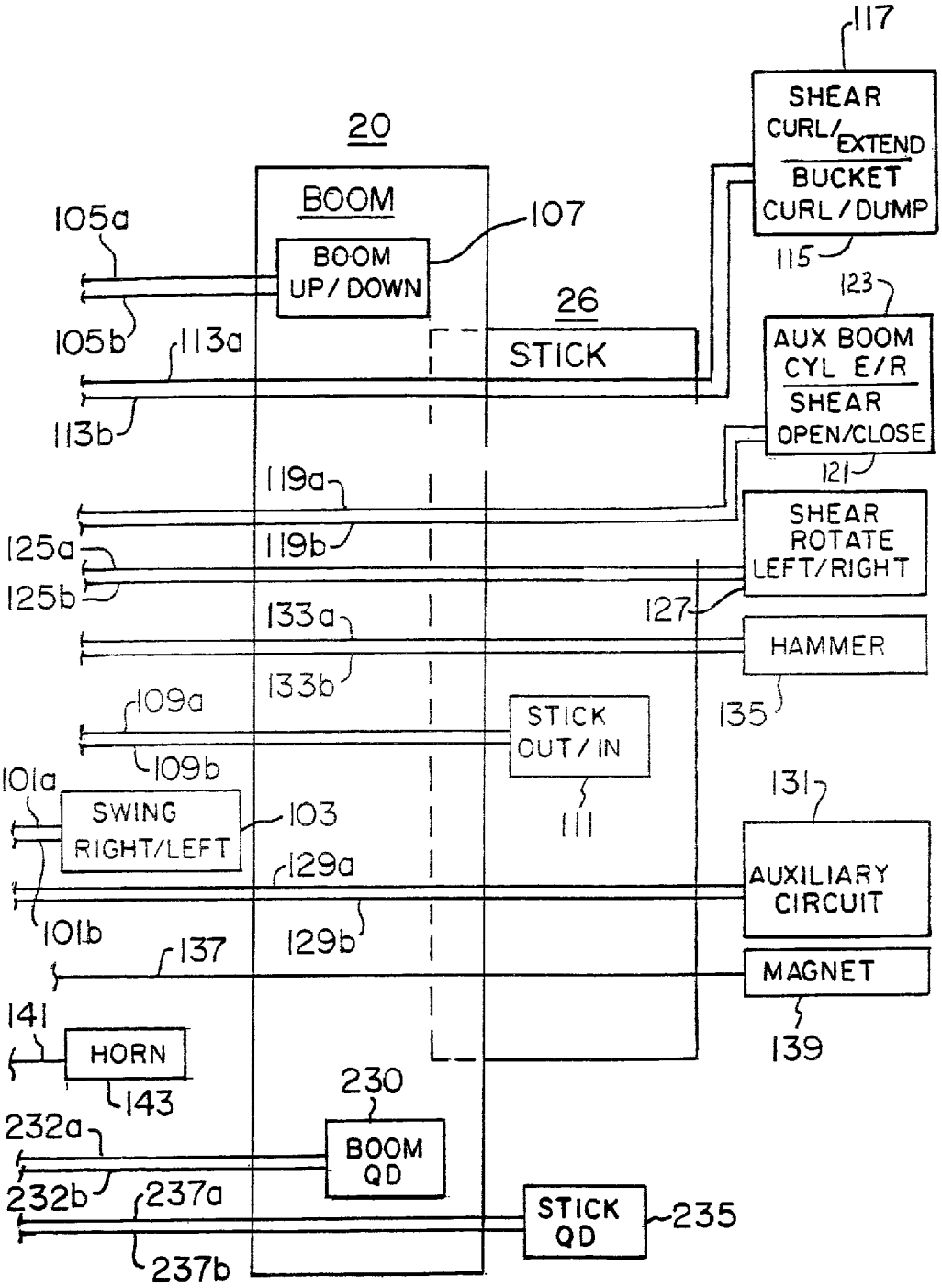
FIG. 7 is a sketch of typical hydraulic lines that may be associated with a construction machine in accordance with the subject invention.

From inspection of FIG. 1, it should be appreciated that the hydraulic line powering the accessories and tools of a construction machine 10 must be able to provide pressurized fluid to many different locations on the construction machine 10. Briefly stated, the hydraulic lines associated with the boom 20 terminate at the hydraulic cylinder 24 controlling the boom 20, the hydraulic lines feeding the cylinder controlling the stick 26 terminate at a different location, and the hydraulic lines to the cylinder controlling the bucket 28 terminate at a different location. In accordance with the subject invention, numerous pairs of hydraulic lines are positioned throughout the construction machine 10 and at locations that will be suitable for accessories and tools with many different configurations. In particular, what will be described in FIG. 7 are hydraulic lines for a number of custom configurations, but it should be appreciated that this is only representative of these configurations and should not in any way limit the number of different configurations for which this subject invention may be applied.

Each pair of hydraulic lines will include a supply line (101*a*, for example) provided from the hydraulic pump (not shown) and a return line (101*b*, for example) which flows into the hydraulic tank (not shown). For ease in identification, the supply lines will be a reference number with an "a" suffix while the return lines will be the same return lines with a "b" suffix. The hydraulic arrangement illustrated in FIG. 7 may be used, for example, with each of the construction machines 10 illustrated in FIGS. 1-5 without the need to add additional hydraulic lines or without the need to physically modify the controller which operates the hydraulic control valves.

The hydraulic line pair 101*a*, 101*b* is used to control the swing function whereby, with attention given to FIG. 1, the platform 22 pivots, or swings, about the base 30.

The hydraulic line pair 105*a*, 105*b* is associated with the hydraulic cylinder attached to the boom 20 to move the boom up and down for boom up/down function 107.

The hydraulic line pair 109*a*, 109*b* is used to control the hydraulic cylinder associated with the stick 26 to move the stick 26 out and in for the stick out/in function 111.

The hydraulic line pair 113*a*, 113*b* is used to control the hydraulic cylinder attached to the bucket 28 for the bucket curl/dump function 115. It should be noted that the same hydraulic line pair 113*a*, 113*b* may also be utilized with the arrangement illustrated in FIG. 2 to curl and extend the shear 35. Note at this time, that even though the bucket curl/dump function 115 and the shear curl/extend function 117 utilize the same hydraulic line pair 113*a*, 113*b*, with the embodiment illustrated herein, each will require a distinct controller motion for activation. Worded differently, a joystick motion will be utilized to activate the bucket curl/dump function 115 while a button on a pistol grip will be utilized to activate the shear curl/extend function 117.

The hydraulic line pair 119*a*, 119*b* is used to control the hydraulic cylinder associated with the shear 35 for the shear open/close function 121. Additionally, the same hydraulic line pair 119*a*, 119*b* may be utilized to control the hydraulic cylinder mounted upon the boom 24 and to provide an auxiliary boom extend/retract function 123 to control an accessory or tool attached to the boom 24. Once again it should be noted, that the same hydraulic line pair 119*a*, 119*b* is used to control both the shear open/close function 121 and the auxiliary boom cylinder extension/retraction function 123. However, as it will be explained in more detail, each of these functions will be performed by a different motion of the controller. In particular, the shear open/close function 121 will be controlled by the lateral motion of the right side joystick while the auxiliary boom cylinder extension/retraction 123 will be controlled by a button on the pistol grip of the left joystick.

The hydraulic line pair 125*a*, 125*b* is used to control the shear rotation function 127 for the shear 35.

The hydraulic line pair 129*a*, 129*b* is used for auxiliary hydraulic lines at the stick 26 for other functions, as needed. Such other functions are identified by auxiliary circuit 131.

The hydraulic line pair 133*a*, 133*b* is used to control the hammer 47 (FIG. 4) through the hammer function 135.

As previously mentioned, the construction machine 10 may have a magnet attached thereto and an electrical line 137 extends along the frame of the construction machine 10 to reach the magnet 50 (FIG. 5) to provide a magnet function 139. Finally, an electrical line 141 extends to the horn (not shown) to provide a horn function 143.

In FIG. 7, the general outline of the boom 20 and stick 26 is provided to give an indication of where each pair of hydraulic lines is connected to an accessory or tool.

Figure 8:
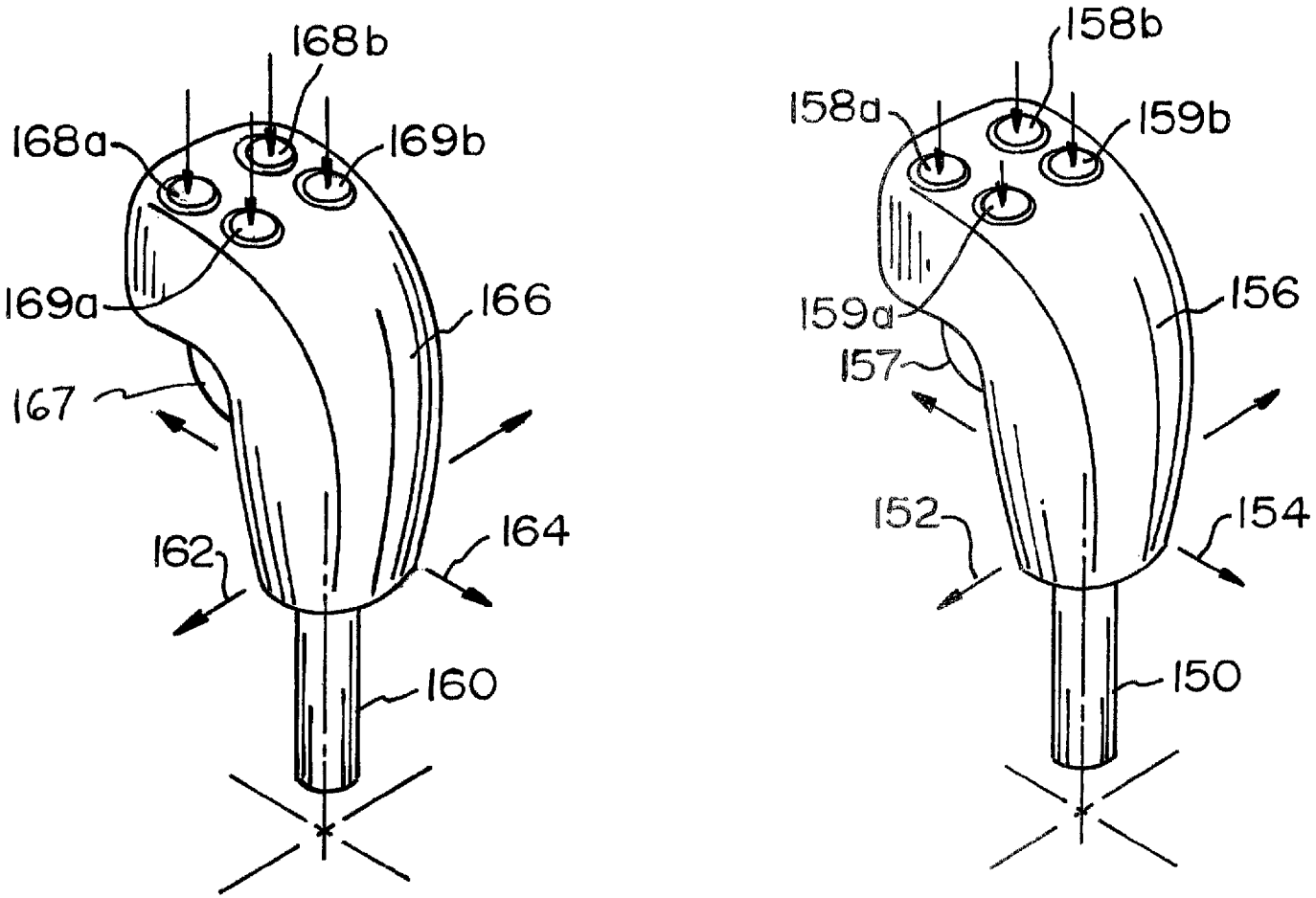
FIG. 8 is a sketch of two joysticks each with a pistol grip associated therewith, used as controllers for the hydraulic valves of a construction machine.

As previously mentioned, it is typical for hydraulically operated construction machines 10 to have joysticks with pistol grips attached thereto for controlling the multiple functions of a construction machine 10. FIG. 8 illustrates the right joystick 150 capable of reciprocating lateral motion indicated by arrow 152 in one direction and reciprocal lateral motion in an orthogonal direction indicated by arrow 154. Attached to the right joystick 150 is a pistol grip 156 having mounted thereupon four control buttons 158*a*, 158*b*, 159*a*, 159*b*. Each pair 158*a*, 158*b*, 159*a*, 159*b* is intended to control a separate function and each button within a pair to provide fluid for that function in one direction or another.

It should be noted that the reciprocating lateral motion indicated by arrow 152 of the joystick 150 and the reciprocating lateral motion indicated by arrow 154 are each intended to control a single function, but to provide a forward and reverse direction depending upon the position of the joystick 150.

Directing attention to the left hand joystick, the description of the lateral motion of the joystick 160 is identical to that as previously described with respect to joystick 150 and, for convenience, the identical directions of the joystick identified by reference numbers incremented by ten, i.e., reference number 162 in joystick 160 is equivalent to reference number 152 in joystick 150, and the like. Likewise, the operation of the buttons on the pistol grip 166 are similar to those on pistol grip 156 and, as a result, have been identified with reference numbers incremented by ten, i.e., 168*a*, 168*b*, 169*a* and 169*b* (similar to 158*a*, 159*b*, 159*a* and 159*b*). The buttons 158*a*, 158*b*, 159*a*, 159*b*, 168*a*, 168*b*, 169*a*, 169*b* on each pistol grip 156, 166 are essentially controller on/off switches, which produce commands that may operate the hydraulic control valves.

Additionally, pistol grip 156 includes a hammer trigger 157 intended to function to provide hydraulic fluid to the hammer, while trigger 167 in the left pistol grip 166 is intended to act as a switch to provide electricity to the horn.

Figure 9:
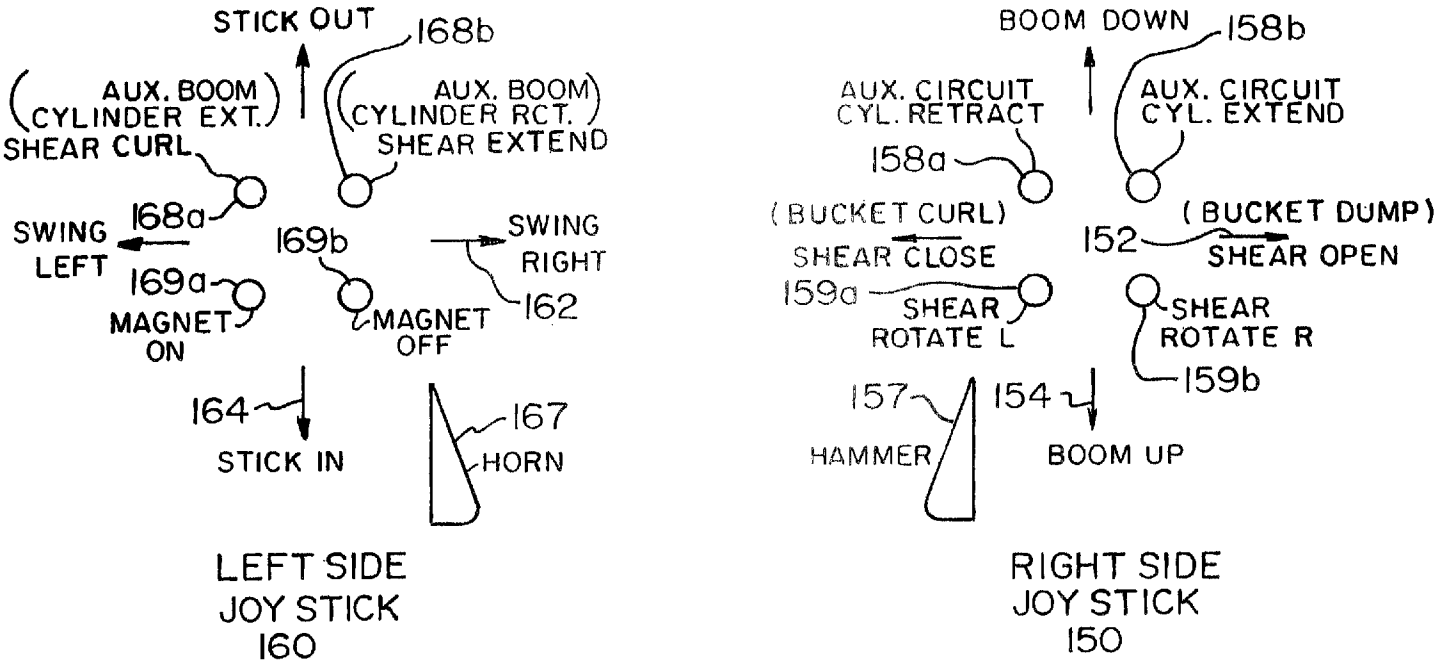
FIG. 9 is a sketch illustrating the function of the joysticks and pistol grips illustrated in FIG. 8.

FIG. 9 is a schematic of the function of the right side joystick 150 and associated pistol grip 156 and left side joystick 160 and associated pistol grip 166 found in FIG. 8. The reference numerals associated with the joystick motion and the buttons of the pistol grips are also found in FIG. 9. It should be noted that certain activation motions of the joystick/pistol grip control two separate functions. In particular, motion of the right side joystick 150 in the direction 152 (FIG. 8) in one instance opens and closes the shear that may be mounted to the boom 20 or the stick 26 and, in the other instance, this motion operates the function to curl or dump the bucket 28. On the other hand, directing attention to the left side joystick 160, activation of buttons 168*a*, 168*b*, in one instance, operates to curl or extend the shear 135 while, in another instance, operates to extend or retract the auxiliary boom cylinder. It should be appreciated that the hydraulic lines 119*a*, 119*b* used to extend or retract the auxiliary boom cylinder may be used for any available function.

This is a very important feature of the subject invention. There are certain stick/pistol grip activation motions that machine operators generally associate with certain functions on the construction machine. In particular, when a bucket 28 is mounted upon the construction machine 10, the machine operator expects to curl and dump the bucket by lateral motion of the right side joystick in the direction 152. Additionally, when a shear is mounted upon the construction machine, the machine operator expects that same motion of the right side joystick to open and close the jaws of the shear. If the joystick motion was only associated with a single function, such a reassignment would be impossible. Through the subject invention, the inventor has arrived at a design whereby, through the flip of a switch on a master control panel, the function of these controls may be changed.

Directing attention to the left side joystick 160 and to buttons 168*a*, 168*b*, once again, when a shear 35 is mounted upon a construction machine 10, the machine operator expects that these buttons 168*a*, 168*b* are available to curl and extend the shear 35. However, in the same manner, if there is not a shear 35 mounted upon the construction machine, the same buttons 168*a*, 168*b* may be utilized to extend an auxiliary cylinder associated with the boom 20.

Figure 10:
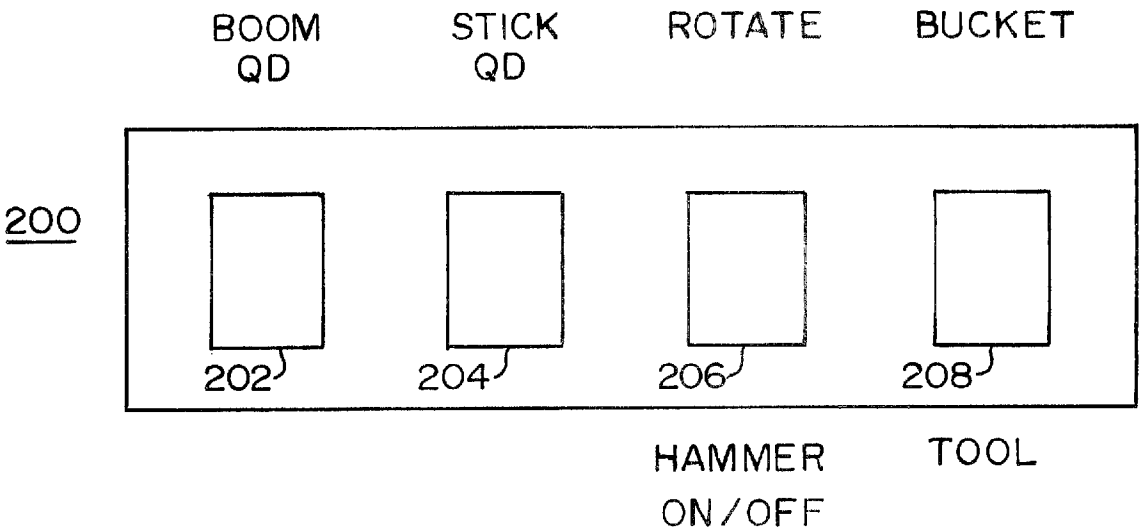
FIG. 10 is a sketch of a master controller utilized to reassign the function of different motions of the joysticks/pistol grip buttons for customization to a particular task.

Directing attention to FIG. 10, a master control panel 200 includes four separate toggle switches, the boom quick disconnect toggle switch 202, the stick quick disconnect toggle switch 204, a rotate/hammer toggle switch 206, and a bucket/tool toggle switch 208. The boom quick disconnect toggle switch 202 and the stick quick disconnect toggle switch 204 operate hydraulic lines associated with hydraulic couplings at the boom 20 and stick 26 for ease of removal of accessories attached thereto. Of particular interest in the subject invention, however, are the rotate/hammer toggle switch 206 and the bucket/tool toggle switch 208.

Figure 11:
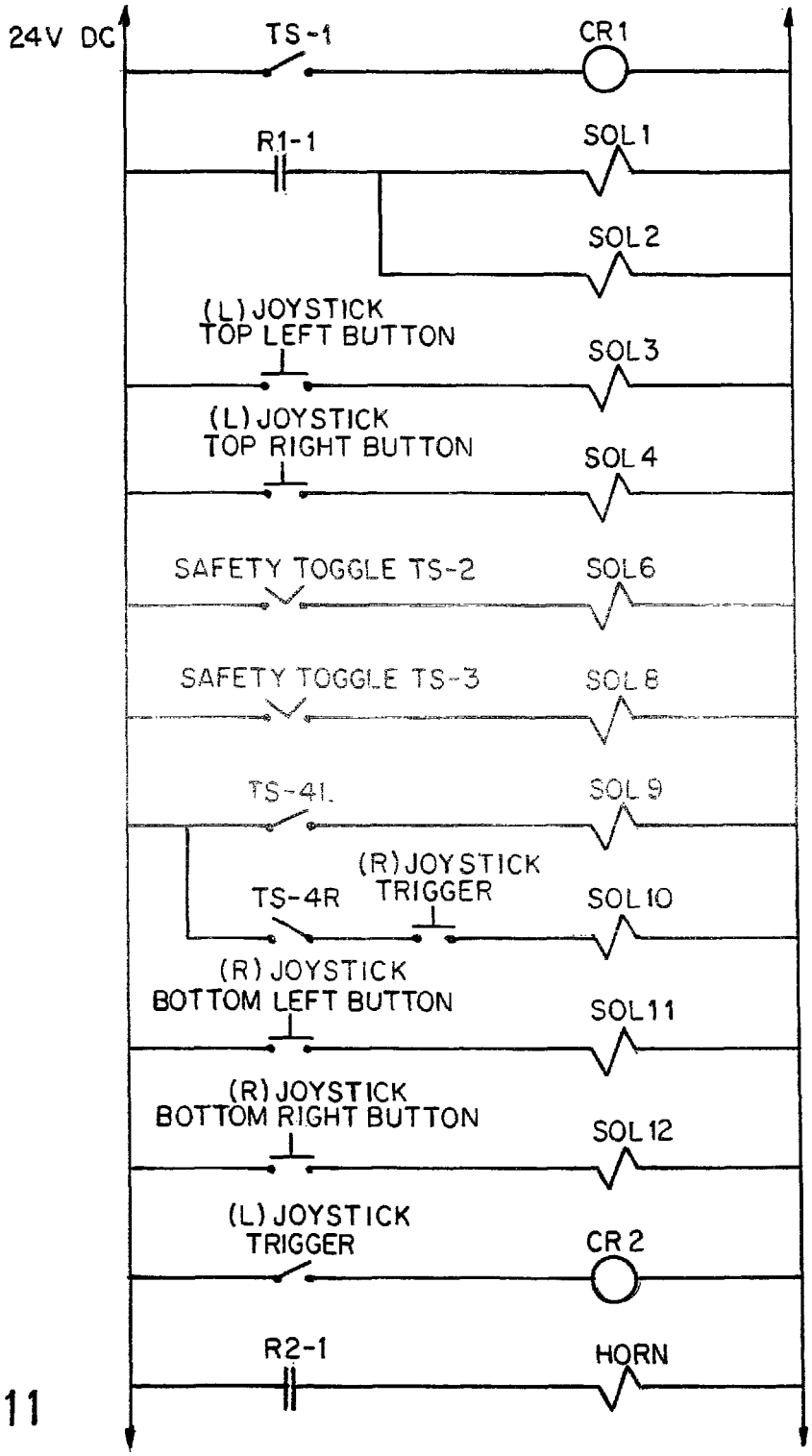
FIG. 11 is a sketch of the electric circuitry associated with controlling the hydraulic valves.
Figure 12:
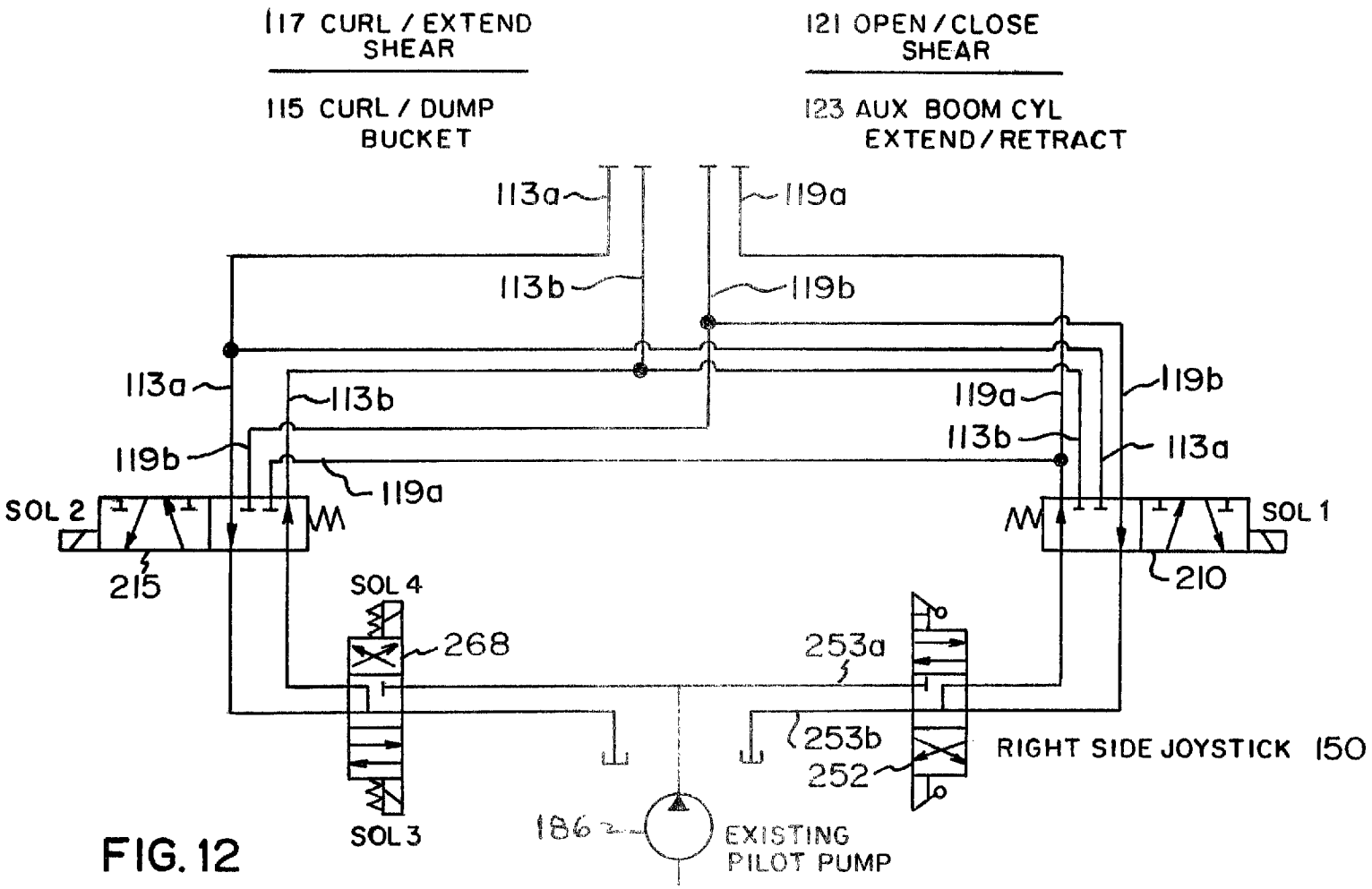
FIG. 12 is a hydraulic circuit associated with lateral motion of the right joystick and activation of buttons on the left pistol grip.

FIG. 11 illustrates the electronic circuitry of the system in accordance with the subject invention, while FIG. 12 illustrates the hydraulic circuitry associated with the bucket/tool toggle switch 208 in FIG. 10. Two modes of operation associated with the toggle switch 208 will now be described. In the first mode of operation, a shear 38 (FIG. 2) is secured to the stick 26 and, with the diverter valves 210, 215 in the biased positions, shown in FIG. 12, the hydraulic lines 113*a*, 113*b* are associated with the curl/extend shear function 117 while hydraulic lines 119*a*, 119*b* are associated with the open/close shear function 121. In the second mode of operation, a bucket 28 (FIG. 1) is secured to the stick 26 and with the diverter valves 210, 215 in the activated or un-biased positions opposite to those shown in FIG. 12, the hydraulic lines 113*a*, 113*b* are now associated with the bucket curl/dump function 115 while hydraulic lines 119*a*, 119*b* are associated with the auxiliary boom extend/retract function 123. This boom extend/retract function 123 may be another function utilizing hydraulic line pairs 119*a*, 119*b*. By using the bucket/tool toggle switch 208, the flow diverter valve 210 and the diverter valve 215 will change fluid flow from the first mode of operation activating the shear open/close function 121 using hydraulic line pairs 119*a*, 119*b* and activating the curl/extend shear functions 117 using hydraulic line pairs 113*a*, 113*b* to the second mode of operation activating the bucket curl/dump function 115 using hydraulic line pairs 113*a*, 113*b* and activating the auxiliary boom cylinder extend/retract functions 123 using hydraulic lines 119*a*, 119*b*. In particular and with attention given to FIG. 11, by activating the bucket/tool toggle switch 208 (TS-1) in the direction of the "tool" label as indicated in FIG. 10, then toggle switch TS-1 will remain open and solenoid SOL1 and solenoid SOL2 will not be energized so that the flow diverter valve 210 and the flow diverter valve 215 will remain in the biased position illustrated in FIG. 12. For example, in the first mode of operation, when the right side joystick 150 is moved in the lateral direction indicated by arrow 152 in FIG. 8, the control valve 252 will move back and forth from a straight flow to a reverse flow position, thereby providing fluid to perform the open/close shear function 121. It should be appreciated that the general description of "tool" on the master control panel 200 merely indicates that flow through hydraulic line pair 119*a*, 119*b* will be available for whatever tool or accessory is connected to those lines.

Furthermore, in the first mode of operation, the flow control valve operated by buttons 168*a*, 168*b* in the pistol grip 166 on the left joystick 160 close a circuit to activate solenoid SOL3 and solenoid SOL4 to position the control valve 268 to provide fluid through hydraulic line pairs 113*a*, 113*b* for the curl/extend shear function 117.

Under the circumstances, where the button/tool toggle switch 208 (TS-1) is moved in the direction of the "bucket" label, then toggle switch TS-1 (FIG. 11) will be closed and solenoid SOL1 and solenoid SOL2 will be energized, thereby operating the flow diverter valves 210, 215 to redirect flow. In particular, with the flow diverter valve 210 moved to a second position, fluid traveling past control valve 252 will now be redirected to hydraulic line pair 113*a*, 113*b* for the second mode of operation activating the bucket curl/dump function 115.

On the other hand, with flow diverter valve 215 displaced to its second position, fluid traveling through control valve 268 will be redirected to hydraulic line pair 119*a*, 119*b* for the second mode of operation and available for the auxiliary boom cylinder extend/retract functions 123.

It should be appreciated that what has just been described is the reassignment of the lateral motion 152 of the right side joystick 150 from the open/close shear function 121 (first mode of operation) to the curl/dump bucket function 115 (second mode of operation). At the same time, buttons 168*a*, 168*b* on the pistol grip 166 of the left hand joystick 160 has been reassigned from the shear curl/extend function 117 (first mode of operation) to the auxiliary cylinder boom extend/retract function 123 (second mode of operation), which may or may not be implemented with use of the curl/dump bucket function 115.

As a result of this design, the lateral motion in the direction 152 of the right side joystick 150 has been made available for two distinct functions which include the curl/dump bucket function 115 and the open/close shear function 121. Additionally, the activation of buttons 168*a*, 168*b* on the pistol grip 166 of the left hand joystick 160 have been made available from two distinct functions which include the shear curl/extend function 117 and the auxiliary cylinder boom extend/retract function 123.

Figure 2:
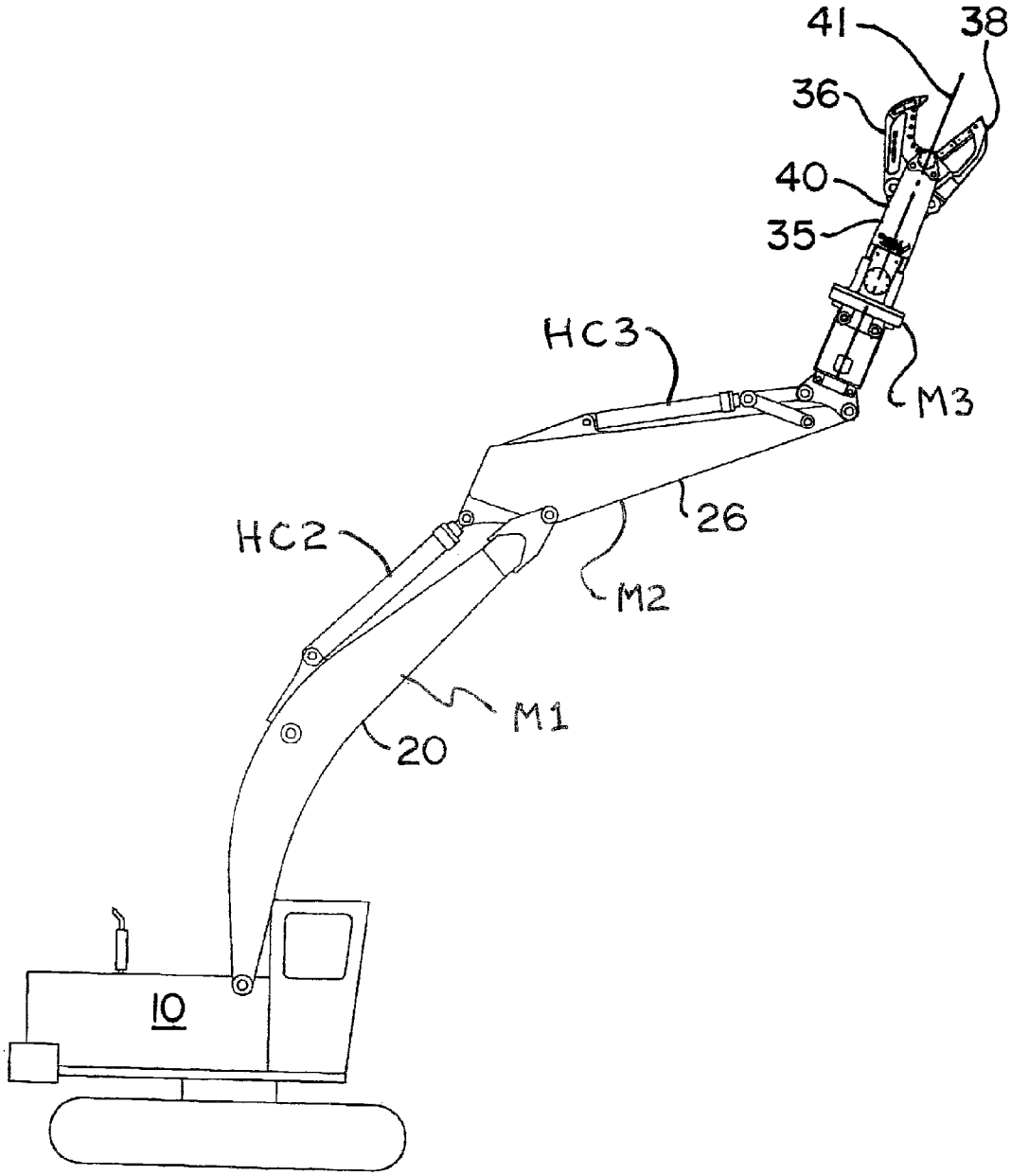
FIG. 2 PRIOR ART
FIG. 2 is prior art and is a sketch of a construction machine utilized for manipulating a shear.
Figure 3:
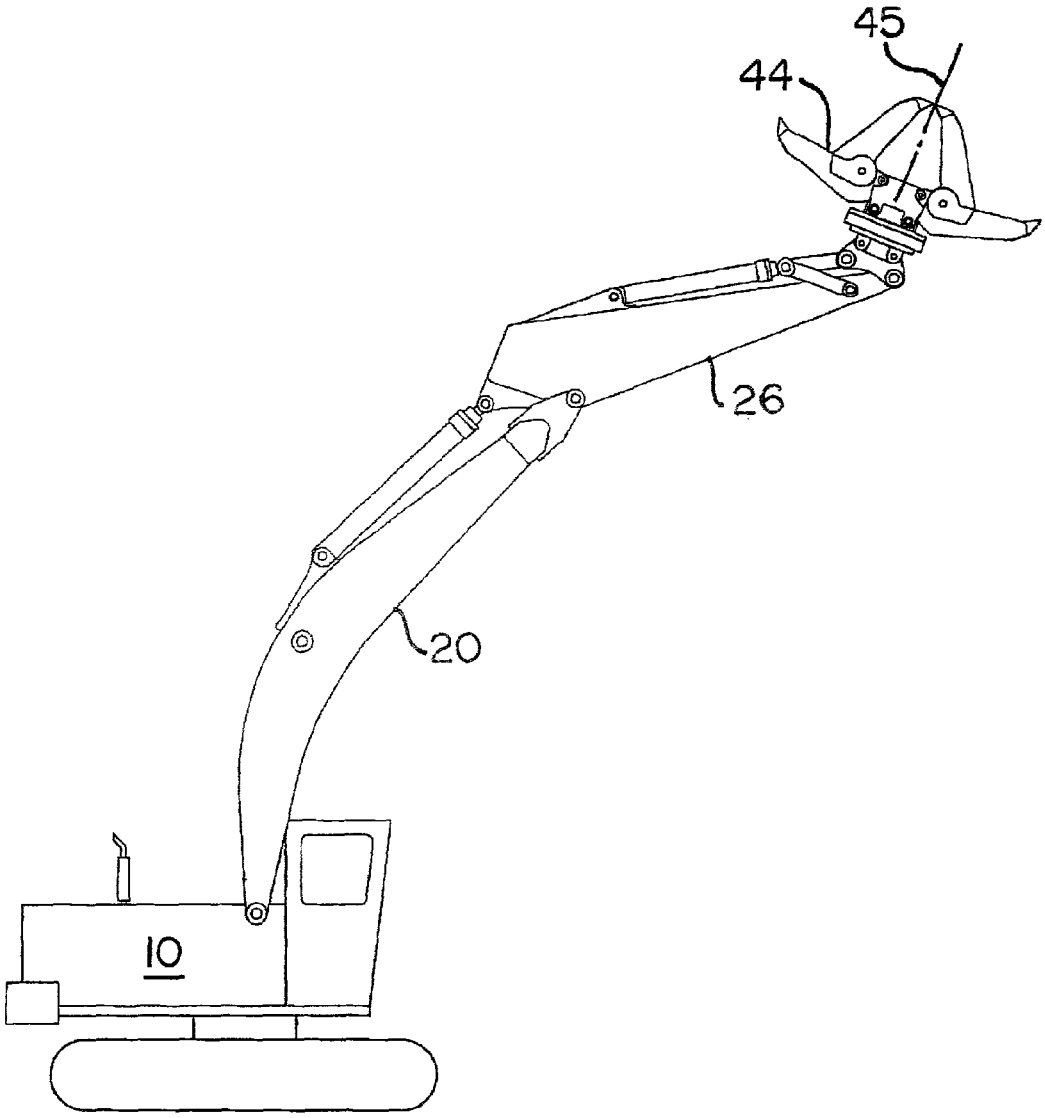
FIG. 3 PRIOR ART
FIG. 3 is prior art and is a sketch of a construction machine used to manipulate a grapple.

What has just been described is the reassignment of stick motion or pistol grip button motion to perform an entirely different function. In accordance with another aspect of the subject invention, rather than have a single controller motion control two different functions, it is also possible for two different controller motions to operate the same function. Referring to FIG. 12, it should be appreciated that the curl/dump bucket function 115 merely controls the hydraulic cylinder connected to the stick 26 (FIG. 1) to move the bucket 28 between the curl and dump positions. The same cylinder attached to the stick 26 which moves the bucket 28 between the curl and dump positions may also move the shear 35 in the curl/extend position as illustrated in FIG. 2. As a result, this same hydraulic cylinder motion, with different tools attached, may be controlled by control valve 252 or pistol grip buttons 168*a*, 168*b*, depending upon the position of the bucket/tool toggle switch 208.

There are certain functions that do not generally require reassignment of controller motion but do require hydraulic fluid flow sufficient that if such functions are not being utilized, the entire circuit is deactivated. The shear rotate left/right function 127 and the hammer function 135 are two such examples. Directing attention to FIGS. 10, 11 and 13, when the rotate/hammer toggle switch 206 (TS-4L) is toggled toward the "rotate" label, then toggle switch TS-4L (FIG. 11) is closed such that solenoid SOL9 is activated and the flow divider valve 220 divides hydraulic flow such that a portion of the flow is directed through hydraulic line pair 125*a*, 125*b* for use with the shear rotate left/right function 127, utilizing control valve 259. In particular, when buttons 159*a*, 159*b* on the pistol grip 156 of the right side joystick 150 are activated, solenoid SOL11 and solenoid SOL12 are activated, thereby toggling the control valve 259 back and forth between a straight flow and a reverse flow condition. By doing so, the shear rotation direction occurs in one direction or another.

Figure 14:
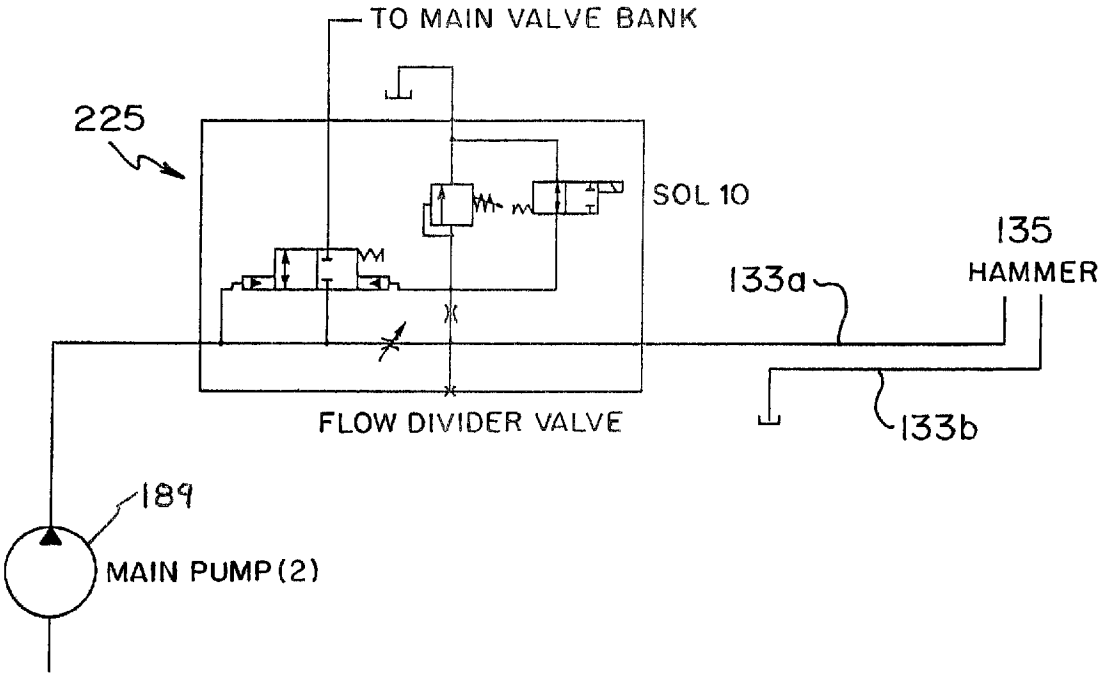
FIG. 14 is a sketch of the hydraulic circuit for activating/deactivating the hammer.

Directing attention to FIGS. 10, 11, and 14, if the hammer function 135 is desired, then the rotate/hammer toggle switch 206 (TS-4R) is toggled to the position closer to the "hammer" label, thereby closing toggle switch TS-4R such that when the trigger 157 on the pistol grip 156 on the right side joystick 150 is depressed, the circuit is completed and solenoid SOL10 is energized, thereby activating flow divider valve 225 and diverting a portion of the flow to hydraulic line pair 133*a*, 133*b* associated with the hammer function 135. It should be noted that unlike the other circuits, the hammer function 135 does not include a control valve since the motion of the bit in the hydraulic hammer is a constant reciprocating motion, which does not need directional control.

Figure 15:
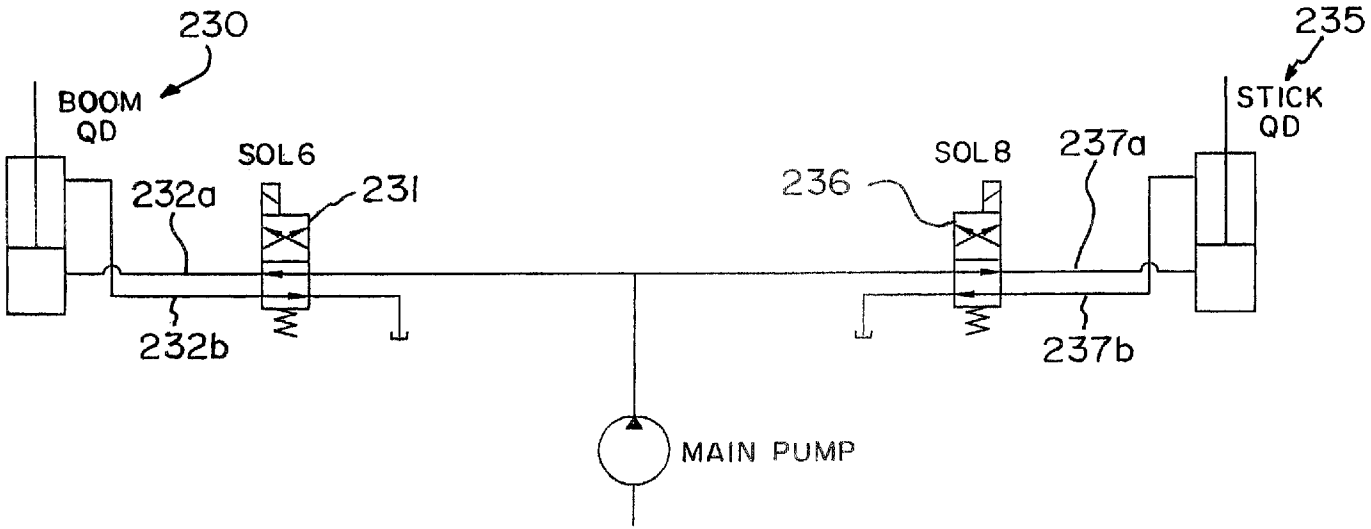
FIG. 15 is a hydraulic circuit for activating/deactivating the quick disconnect couplings associated with the boom and stick attachments.

Directing attention to FIGS. 10, 11, and 15, when the boom quick disconnect toggle switch 202 (TS-2) is activated, safety toggle TS-2 closes the circuit such that solenoid SOL6 is energized, thereby shifting control valve 231 to reverse the flow through hydraulic line pairs 232*a*, 232*b*, thereby activating a cylinder to release the quick connect coupling at the boom 20 (FIG. 1). It should be noted that control valve 231 associated with the boom quick disconnect function 230 is spring biased to a position that urges the quick disconnect coupling to a locked position and, whenever the construction machine is in operation, control valve 231 is active. The boom quick disconnect function 230 and the stick quick disconnect function 235 utilize hydraulically activated couplings to secure the stick 26, and to secure attachments to the stick 26, such as a bucket 28.

Directing attention to the stick quick disconnect function 235 illustrated in FIG. 15, when safety toggle TS-3 is activated, solenoid SOL8 is activated, thereby shifting the position of control valve 236 and reversing the flow of hydraulic fluid within the hydraulic line pair 237*a*, 237*b* and, as a result, moving the cylinder associated with the stick quick disconnect function 235 to the opposite direction, thereby unlocking the coupling. Just as noted before with respect to the boom quick disconnect function 230, control valve 236 associated with the stick quick disconnect function 235 is spring biased to a position, whereby the stick quick disconnect is locked. It should also be pointed out once again, that the control valve 236, whenever the machine is operating, has a supply of pressurized hydraulic fluid.

Figure 16:
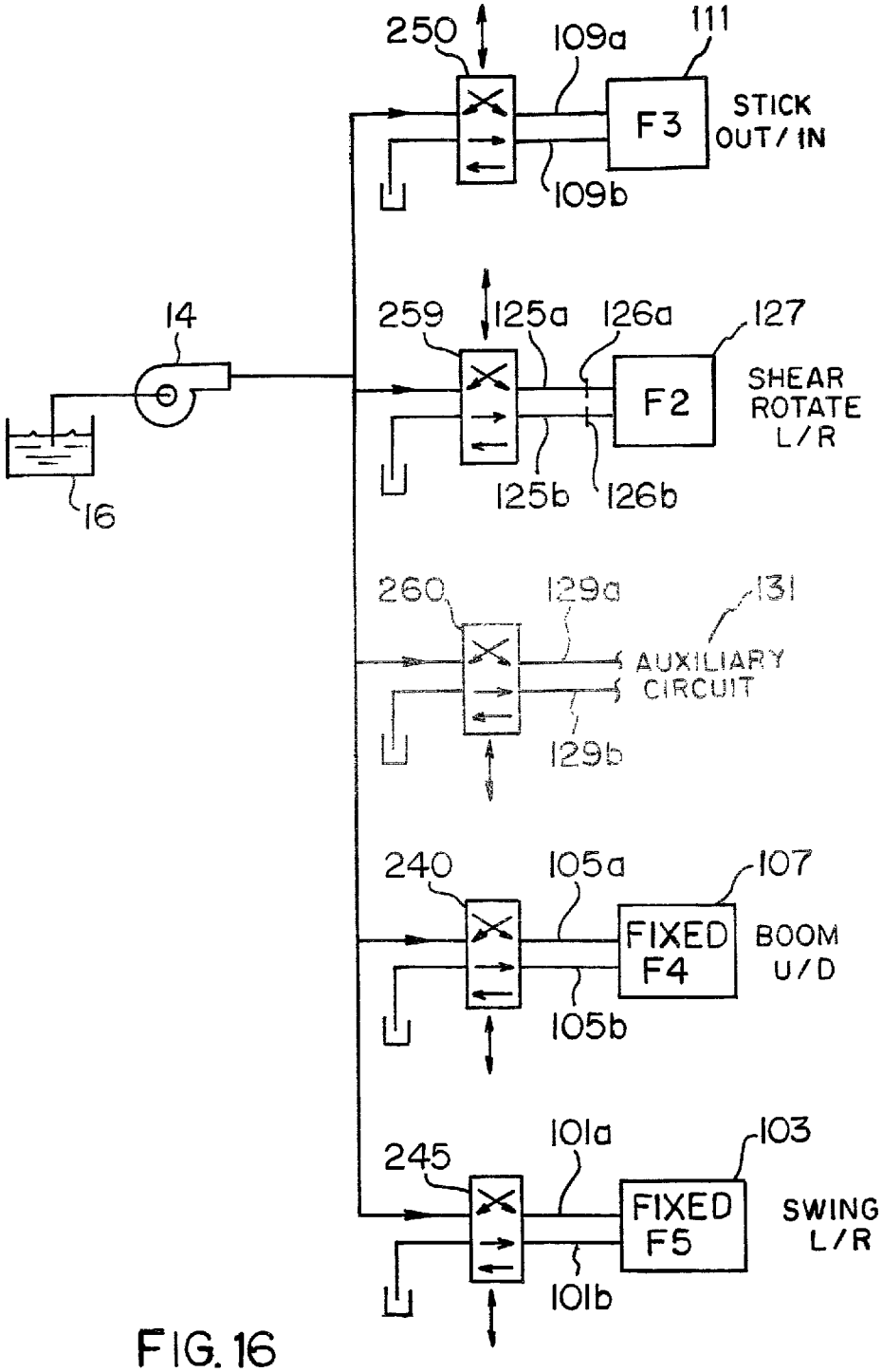
FIG. 16 is a sketch of the hydraulic circuit in which all branches are energized but only some branches are used with accessories or tools.

FIG. 16 illustrates a schematic for activating hydraulic circuits necessary for different functions F2, F3, F4 and F5 on construction machines 10 having a hydraulic tank 16 with fluid therein and a hydraulic pump 14 for providing fluid to hydraulic supply lines. For purposes of explanations, specific functions will be utilized with respect to FIG. 16, however, it should be appreciated that different functions with a construction machine 10 may be substituted and the scope of protection afforded this invention extends beyond the specific assignment of functions discussed with respect to FIG. 16, and also to upcoming FIGS. 17-19.

Directing attention to FIG. 16, each hydraulic line pair as illustrated with respect to the boom up/down function 107 has a supply line 105*a* and a return line 105*b*, wherein the supply line 105*a* receives fluid from the pump 14 while the return line 105*b* returns the hydraulic fluid to the hydraulic tank 16. The return line 105*b* in the Fig. is not extended all of the way to the hydraulic tank 16, but it should be understood that this feature exists. Each pair of hydraulic lines 125*a*, 125*b*, for example, ends at a terminal 126*a*, 126*b* adapted to be connected to a hydraulically operated accessory. For example, function F2 is associated with the shear rotate left/right function 127. Hydraulic line pair 125*a*, 125*b* includes hydraulic line ends 126*a*, 126*b* to define terminal(s) which are adapted to be connected to the hydraulically operated accessories associated with shear rotate left/right function 127. It should be appreciated that the shear rotate left/right function 127 may be replaced with another function that may utilize the same hydraulic line pair 125*a*, 125*b* if the machine operator decides to seek another configuration.

FIG. 16 illustrates at least two fixed function hydraulic pairs 105*a*, 105*b* and 101*a*, 101*b* dedicated to providing fluid for predetermined machine functions F4, F5. A plurality of open-function hydraulic line pairs 109*a*, 109*b*, 125*a*, 125*b*, 129*a*, 129*b* are available providing fluid for other machine functions. As seen, lines 109*a*, 109*b* and 125*a*, 125*b* are connected at their terminals to an accessory, in particular, those associated with functions F2 and F3, for operating that accessory. The remaining open-function hydraulic line pair 129*a*, 129*b* is an auxiliary circuit 131 and is not connected to an accessory. A hydraulic control valve 250, 259, 260, 240, 245 is associated with each hydraulic line pair 109*a*, 109*b*, 125*a*, 125*b*, etc., wherein each hydraulic control valve reverses the flow of hydraulic fluid between the first line and the second line of the associated hydraulic line pair. A controller (not shown) is capable of selectively opening and closing the control valves 250, 259, 260, 240, 245 associated with the hydraulic line pairs, thereby controlling the fluid flow to both the open functions F2, F3 hydraulic line pairs and for the predetermined machine functions F4, F5, along with the unassigned line pair 129*a*, 129*b*.

The construction machine 10 has a base rotationally mounted about the tractor 30 and a boom 20 pivotally attached to the base 22. The fixed function hydraulic line F4, F5 are dedicated to rotating or swinging the base 22 about the tractor 30 and for pivotally moving the boom 20 up and down.

Although line pairs 129*a*, 129*b* are not attached to any particular accessory or tool, it is possible to attach these lines to other tools or accessories as needed or as desired.

In another embodiment, an accessory may be connected directly to the boom 20 or connected directly to the stick 26 attached to the boom 20. The tool may consist of a bucket 28, a shear 35 (FIG. 2), or a hammer 47 (FIG. 4), wherein at least one pair of open-function hydraulic lines is associated with a tool.

In accordance with the subject invention, one pair of hydraulic lines 101*a*, 101*b* is dedicated to swinging the base 22 about the tractor 30 while another pair of hydraulic pairs 105*a*, 105*b* is dedicated to removing the boom 20 up and down. These functions are considered critical in a hydraulic construction machine 10 and, for that reason, there will always be hydraulic lines dedicated to them. On the other hand, a construction machine 10 in accordance with the subject invention has a plurality of other hydraulic line pairs which are not always dedicated to the same function. The interchangeability of the functions in these lines is the basis for referring to these lines as open-function lines.

When the tool is a shear 35, there is at least one pair of hydraulic lines connected to the jaw set of the shear to open and close the jaws, and another set of hydraulic line pairs to rotate the shear 35.

As previously discussed with respect to FIG. 8, the controller is comprised of two joysticks 150, 160, each of which moves laterally to produce controller signals and a series of switches 158, 159 on joystick 150 and switches 168, 169 on joystick 160, that may be depressed to produce additional controller signals, wherein each of these signals operates a control valve.

In the embodiment illustrated in FIG. 16, it should be pointed out that all of the hydraulic line pairs are energized, wherein only some of the hydraulic line pairs are connected to a function. The hydraulic line pair 129*a*, 129*b* for example, has associated with it a control valve but, there is neither a tool nor an accessory attached to hydraulic line pair 129*a*, 129*b*, even though lines 129*a*, 129*b* are energized by the pump 14.

Figure 17:
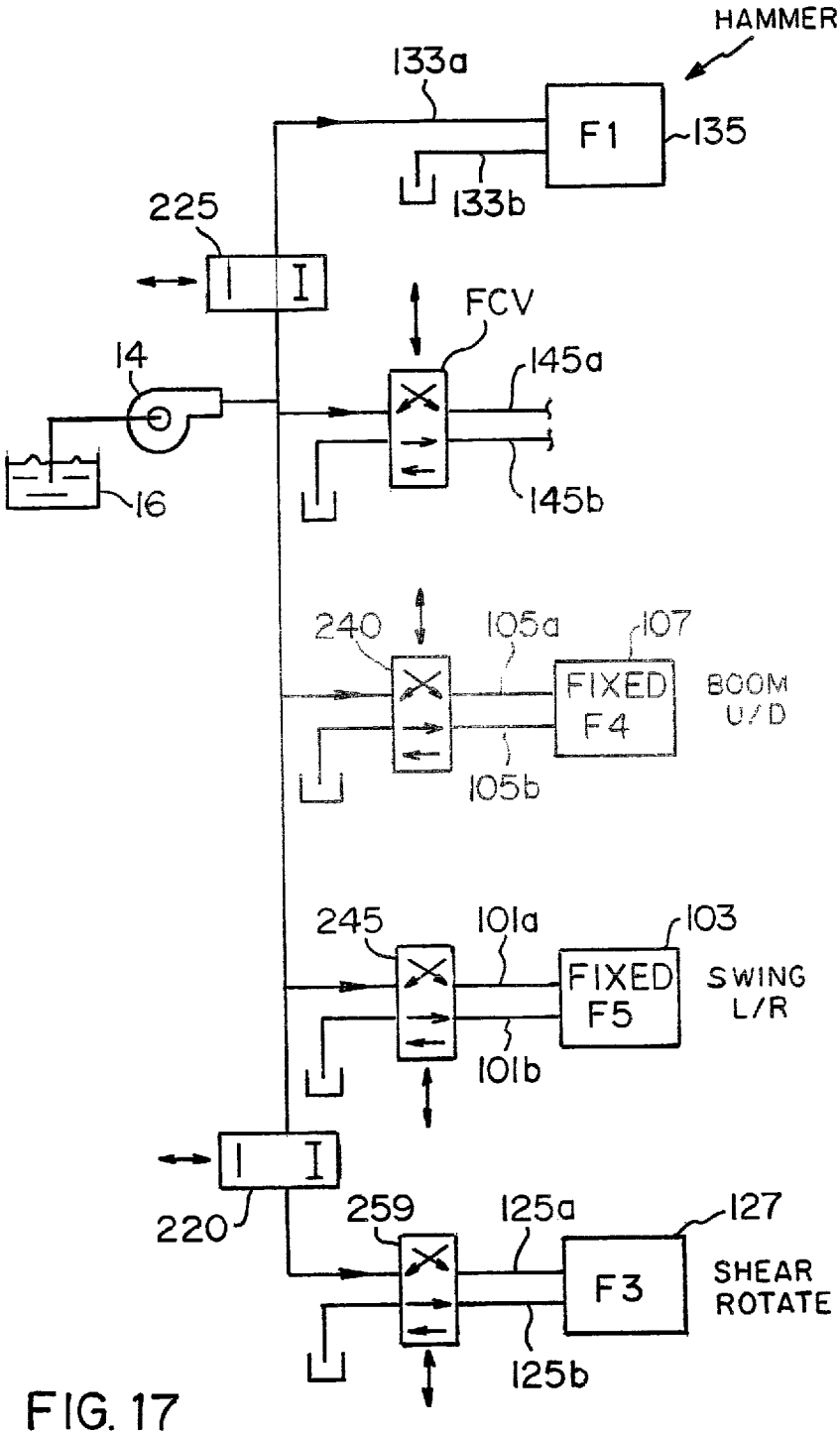
FIG. 17 is a sketch of a hydraulic circuit whereby select branches are activated/deactivated.

FIG. 17 illustrates another embodiment similar to that embodiment illustrated in FIG. 16, whereby however, while certain hydraulic line pairs are present the hydraulic fluid supply to them is severed by a flow divider valve.

Figure 13:
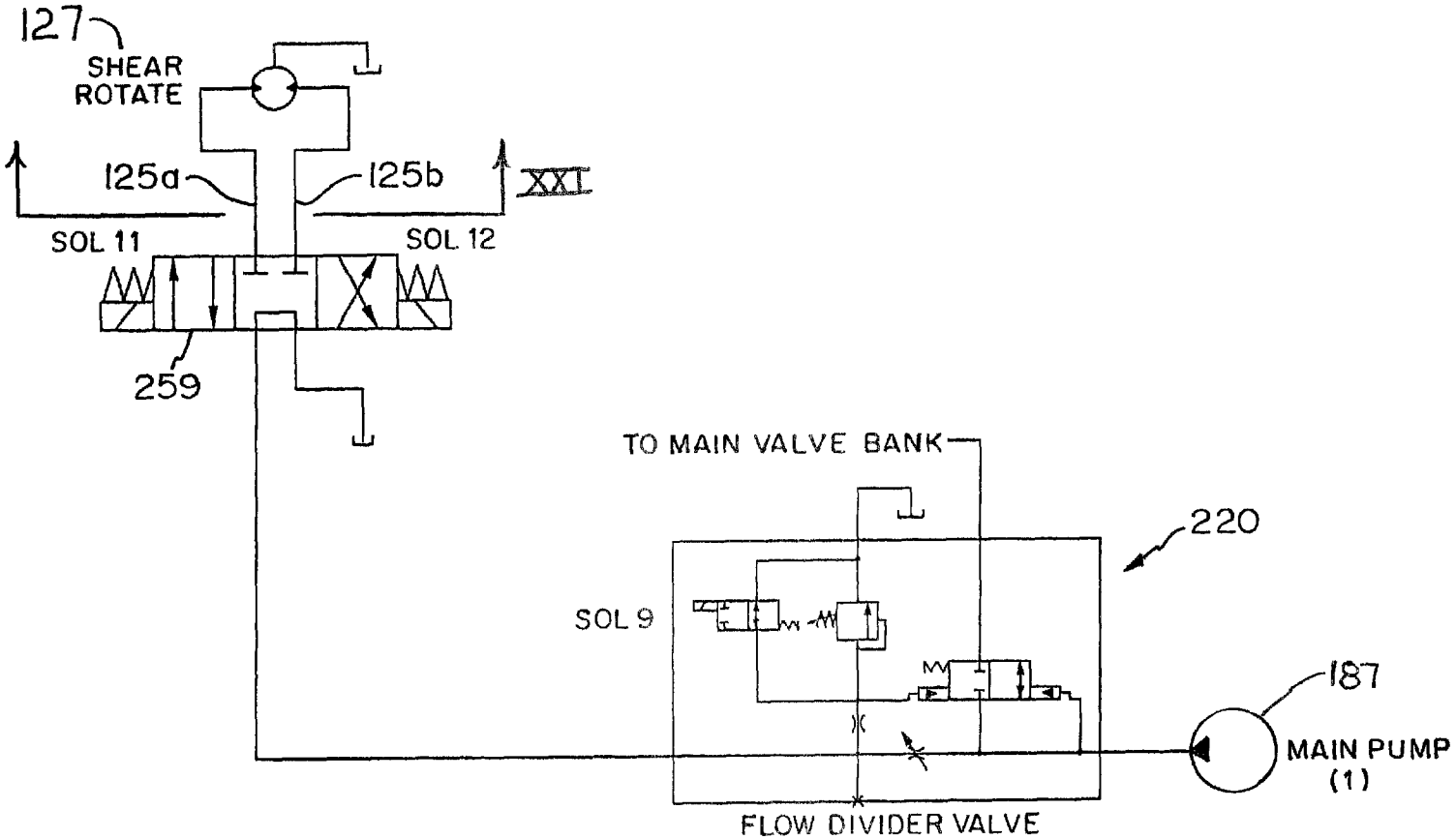
FIG. 13 is a sketch of the hydraulic circuit for activating/deactivating the shear rotate functions.

Directing attention to FIG. 17, this schematic focuses on the arrangement generally illustrated in FIGS. 13 and 14. At least two fixed hydraulic line pairs 105*a*, 105*b* and 101*a*, 101*b* are dedicated to providing fluid for predetermined machine functions, in particular, the swing right/left function 103 of the platform and the boom up/down function 107. These hydraulic lines 105*a*, 105*b*, 101*a*, 101*b* are activated during normal system operation. A plurality of open-function hydraulic line pairs 133*a*, 133*b*, 125*a*, 125*b* and 145*a*, 145*b* are available for providing fluid for other machine functions. These open-function hydraulic line pairs 133*a*, 133*b*, 125*a*, 125*b* and 145*a*, 145*b* have hydraulic pair ends at terminals adapted to be connected to other hydraulic accessories, such as the hammer function 135 or the shear rotate function 127.

Directing attention to the hammer function 135, a flow divider valve 225 is associated with hydraulic line 133*a*, 133*b* and is downstream of the pump 14. The flow divider valve 225 is operable to divide the flow and to supply fluid to the hydraulic line pair 133*a*, 133*b* associated with the hammer function 135, while at the same time, permit fluid that has not been diverted to other functions on the construction machine 10. It should be noted that at least with respect to the hammer function 135, there is no hydraulic control valve because the hammer function 135 merely reciprocates the hammer without respect to any particular direction. However, each of the remaining pairs of hydraulic lines may have associated therewith a hydraulic control valve. A master controller (not shown) manipulates the flow diverter valve 225 to selectively activate the associated open function line pair 133*a*, 133*b* to activate the hammer function 135.

Additionally, a controller (not shown) is capable of selectively controlling all of the hydraulic flow control valves 240, 245, 259 associated with the hydraulic lines and unassigned lines 145*a*, 145*b*. As illustrated in FIG. 17, the accessory associated with the flow divider valve 225 may be a hammer function 135, while the accessory associated with the flow diverter valve 220 may be the shear rotate function 127. It should be noted that the hammer function 135 does not require a control valve between the hammer function 135 and the pump 14, wherein the control valve 259 reverses the flow of the hydraulic fluid between the first line 125*a* and the second line 125*b* of the hydraulic pair.

Figure 18:
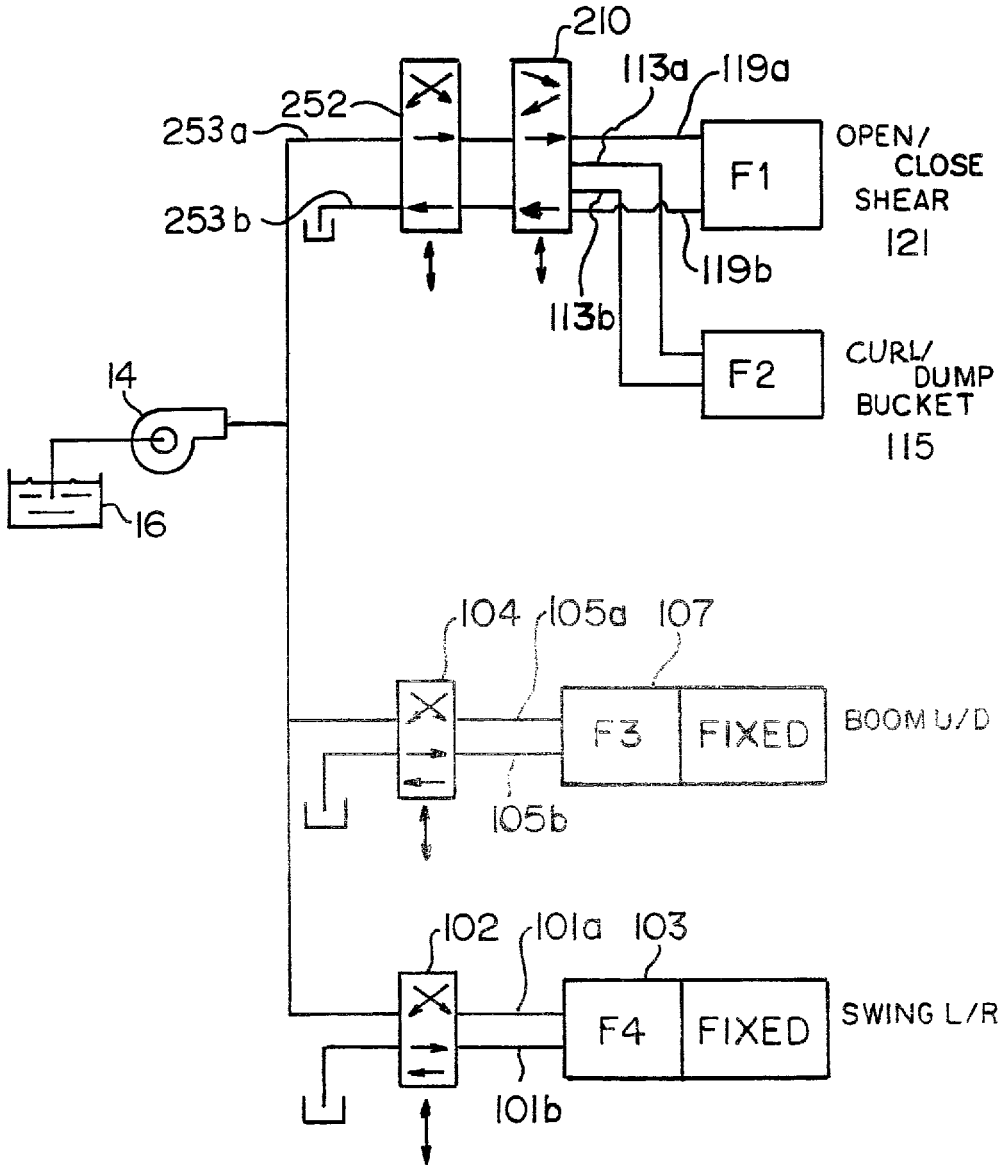
FIG. 18 is a sketch of a hydraulic circuit whereby one flow control valve controls two separate functions.

In another embodiment of the subject invention, a single controller action may be used to perform different functions. One such example will be illustrated with respect to FIG. 12 and FIG. 18. A hydraulic control valve 252 controls the flow for hydraulic feeder line pairs 253*a*, 253*b*. Additionally, a flow diverter valve 210 diverts flow from the pair of feeder lines 253*a*, 253*b*, wherein in the first position the flow diverter valve 210 diverts flow from the feeder lines 253*a*, 253*b* to a first pair of branch hydraulic lines 119*a*, 119*b* and in a second position, the flow diverter valve 210 directs flow to a second pair of hydraulic branch lines 113*a*, 113*b* with each pair of branch lines 113*a*, 113*b*, 119*a*, 119*b* adapted to receive an accessory attached thereto. It should be noted here that control valve 252 associated with the pair of feeder hydraulic lines 253*a*, 253*b* is positioned between the flow diverter valve 210 and the pump 14. Control valve 252 reverses the flow of hydraulic fluid between the first line 253*a* and the second line 253*b* of a hydraulic pair. As illustrated in FIG. 18, there are two fixed function lines, one associated with the boom up/down function 107 and another associated with the swing left/right function 103.

Once again, a master controller (not shown) is used to manipulate the flow diverter valve 210 to tend to selectively activate the associated hydraulic pair 119 or 113. The joystick/pistol grip controllers are capable of selectively controlling the hydraulic control valves 252, 104, 102 associated with the hydraulic lines.

In the embodiment illustrated in FIG. 18, the single control valve 252 is capable of controlling two functions depending upon the position of the flow diverter valve 210. In a first position of the flow diverter valve, function F1, which may be the open/close shear function 121, is activated while in a second position of the flow diverter valve 210, function F2, which may be a curl/dump bucket function 115 is activated.

Figure 19:
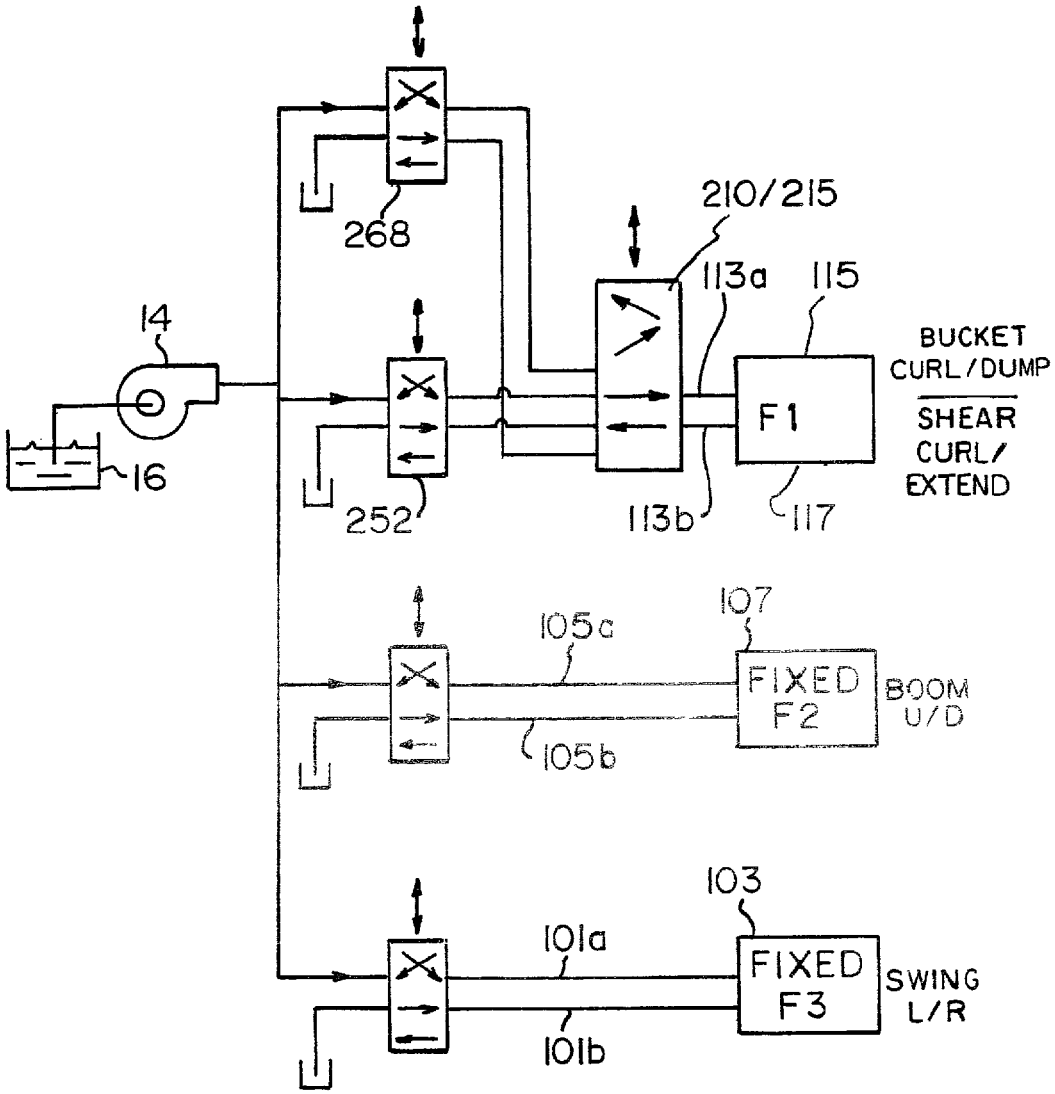
FIG. 19 is a sketch of a hydraulic circuit whereby two flow control valves control the same function.

In yet another embodiment, it is possible for two control valves to control a single function. Directing attention to FIGS. 9 and 19, the bucket curl/dump function 115 is activated by lateral motion of the right hand joystick 150 which operates the same hydraulic cylinder that would be operated by the buttons 168*a*, 168*b* on the left side joystick 160 referred to as shear cylinder curl/extend. Directing attention to FIGS. 12 and 19, both the curl/dump bucket function 115 and the curl/extend shear function 117 are controlled by hydraulic fluid provided through line pairs 113*a*, 113*b*. Depending upon the position of flow diverter valves 210, 215 (see FIG. 12 also) either control valve 268 or control valve 252 will operate function F1, so that either the curl/dump bucket function 115 or the curl/extend shear function 117 is implemented. It should be noted that while FIG. 12 illustrates two separate flow diverter valves 210, 215, the concept of controlling a single function with two separate control valves still applies as illustrated in FIG. 19.

In general, what has been described is a construction machine 10 having at least two fixed functions which have been defined as the swing left/right of the base 22 on the tractor 30 and the pivotal movement of the boom 20 up and down. A controller for the control valves discussed herein is the joystick 150 with the pistol grip 156 attached thereto with a plurality of buttons, wherein the lateral motion of one of the joysticks or the depression of one of the buttons on the pistol grips may act to energize the control valve.

In the instance where a shear is utilized with the construction machine, the shear typically is capable of rotating, opening and closing, and pivoting about an axis. Under these circumstances it should be appreciated that three open-function hydraulic lines will be dedicated to providing fluid to the shear to achieve these tasks.

In the instance where the tool is a bucket 28, then the bucket 28 must be capable of pivoting or extending and this single task is achieved through one open-function hydraulic line dedicated to providing fluid to the bucket to achieve this task.

In yet another embodiment, the hydraulic hammer 47 must be capable of pivoting about the structural element to which it is attached, and furthermore, to provide repetitious impact. For that reason, when the hammer is utilized, two open-function hydraulic line pairs are dedicated to provide fluid to the hammer 47 to achieve these tasks.

The configurations of tools and accessories illustrated on the construction machine 10 in FIGS. 1-5 are only intended to illustrate a few of the many construction machine 10 configurations possible in accordance with the subject invention and should not be construed as limiting the scope of the subject invention. As another example, the stick 26 may be removed and each tool illustrated in FIGS. 1-5, as attached to the stick 26, could be attached directly to the boom 20.

What has been described is a system utilizing a series of manual switches to manipulate valves for controlling tools and accessories of a construction machine. These manual switches could be replaced through PLC logic and such a modification would be obvious to one skilled in the art of hydraulic systems.

Figure 20:
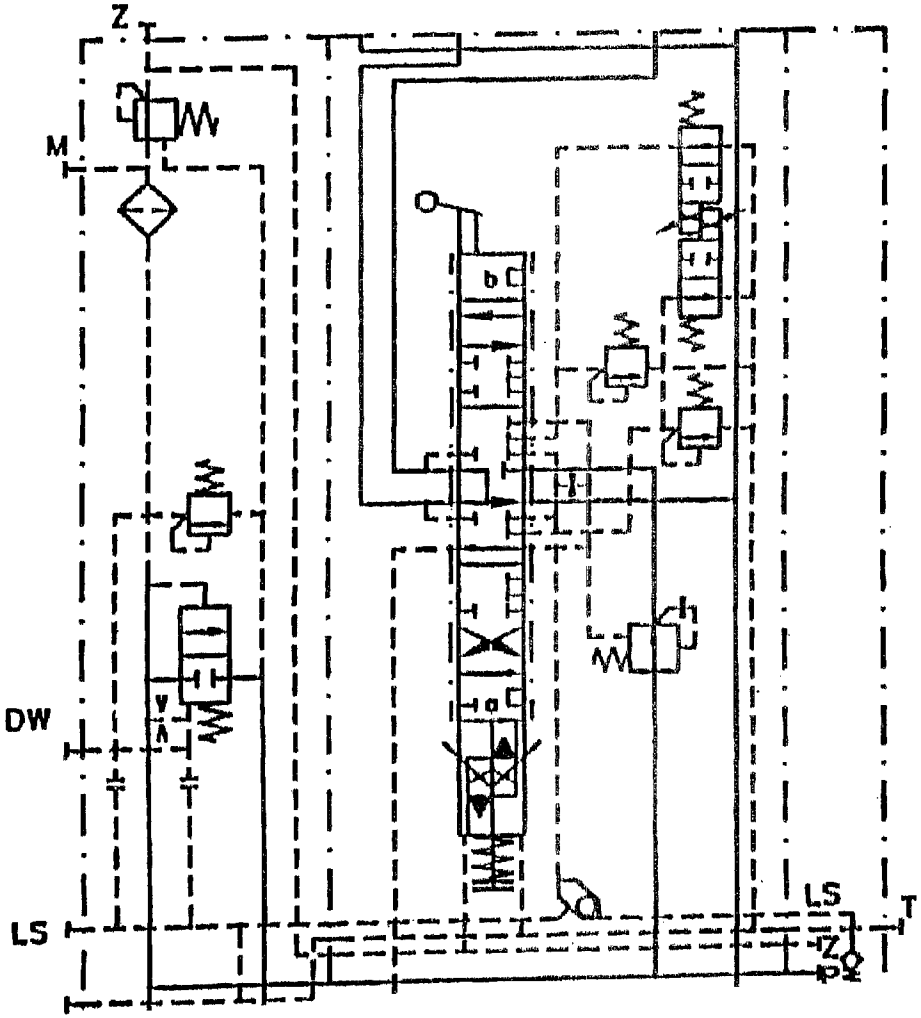
FIG. 20 is a schematic of a proportional control valve that may be substituted for the control valve 268 illustrated in FIG. 12.

FIG. 12 illustrates a control valve 268 to provide reversing flow of fluid through hydraulic line pairs 113*a*, 113*b* or 119*a*, 119*b*, depending upon the position of diverter valve 215. It is possible to substitute this control valve 268 with the proportional control valve 800 illustrated in FIG. 20. This valve 800 provides multiple control functions in a remote hydraulic spool shifting circuit. This electrically controlled valve has features that integrate a pressure reducing/relieving function, a 4-way directional control function and it will accept a soft shift ramp signal from an amplifier control board and provide an independently adjustable pilot pressure to the A and B work ports. The valve 800 may be rated to 6000 PSI at 10 GPM.

The valve 800 is electrically operated, with one electrical connection for the "directional control" function and another electrical connection for the "reduced pressure function". The valve 800 has manual overrides on both functions so trouble-shooting in the field is easy to accomplish, i.e., the valve 800 can be manually operated if there is a question of its electrical functionality.

The valve 800 is suited for the pressure and flow of the hydraulic pilot circuits commonly found on construction equipment. The valve 800 can also be incorporated into higher pressure circuits if required.

An electrical control box may also be utilized to operate the valve 800. The box would contain a lockable NEMA 4 enclosure and contain the two amplifier boards for proportionately controlling the signals to the directional and pressure limiting functions of the control valve 800. The adjustments may be mounted internal to the control box. The full pressure from the excavator would be selected when in bucket mode and reduced pilot pressure would be sent through the valve when in tool mode. The pilot pressure amplifier board would permit independent pre-set of the outlet pressure signals to the A and B ports from as low as 200 PSI up to the maximum of the machines pilot pressure of 600 PSI. A separate amplifier board also allows for dampening the "shift time" of the 4-way function of the control valve 800. This "shift time" adjustment is up to approximately 4 to 5 seconds from the center to full shift in both directions.

The electrical enclosure may have a seal tight connection and/or grommets for the incoming and outgoing wiring. The electrical connections may be the input voltage and ground wires, incoming signals from the buttons on the joy sticks, the outgoing wires to the 4-way function and to the pressure control function plus the incoming selection signal from the tool or bucket switch.

Figure 21:
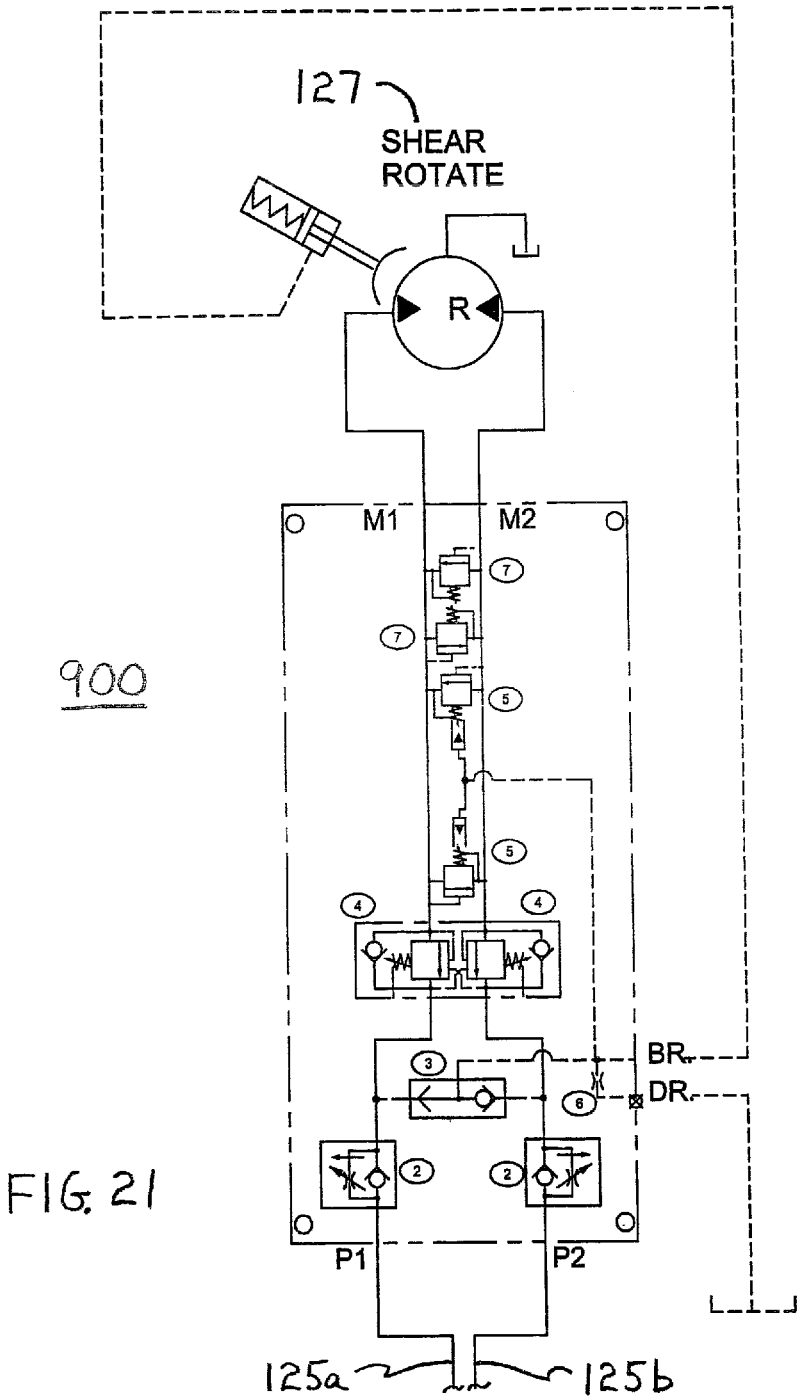
FIG. 21 is a schematic of a substitute control circuit as part of the shear rotation circuit.

Directing attention to FIG. 13, arrows XXI-XXI indicate a section of the shear rotation circuit that may be replaced with the substitute control circuit 900 illustrated in FIG. 21. The point of attachment of the circuit 900 is at line pair 125*a*, 125*b*. The substitute control circuit 900 provides speed, pressure and rotation control while minimizing the shock loads into the rotation drive components. Two identical valves with different pressure settings are used based on the size of the shear.

The substitute control circuit 900 works as follows. A hydraulic circuit manifold provides adjustable pressure-compensated, restrictive-style flow controls (FLOW-CONTROLS) on the input to the shear rotate motor/motors. The manifold further provides a shuttle valve to sense pressure in order to pilot open the spring applied brake on the shear rotate drive and to pilot close the low pressure braking relief valves (SHUTTLE VALVE). The manifold further provides counter-balance valves which allow free flow to the shear rotate hydraulic motor/motors and prevents the motors from running away from the oil-supply during over-hung, over-running loads on the rotate drive-shear assembly. The manifold further provides two sets of relief valves, one set to limit the maximum pressure to the drive motor/motors while rotating the shear and the second set to provide lower pressure control for the deceleration of the shear. These lower pressure relief cartridges which are only active during stopping the shear and/or holding the shear provide for a softer braking of the rotating mass. The manifold further provides a fixed dampening orifice to allow the low pressure relief valves' pilot and spring chambers, plus the brake release pilot pressure to drain to the tank when the shear is not rotating.

FIG. 12 illustrates hydraulic lines provided with fluid through a pilot pump. It is well known to those familiar with construction machines having hydraulically operated attachments that it is more efficient to utilize a lower pressure supplied by a pilot pump and the associated smaller and less expensive hydraulic lines to operate main control valves. These main control valves control the high pressure main pump fluid to associated hydraulic pistons which operate the extension members or tool members of the construction machine. Such an arrangement is more efficient than utilizing the high pressure fluid associated with the main pump for both driving the equipment and also operating the control valves.

Figure 22:
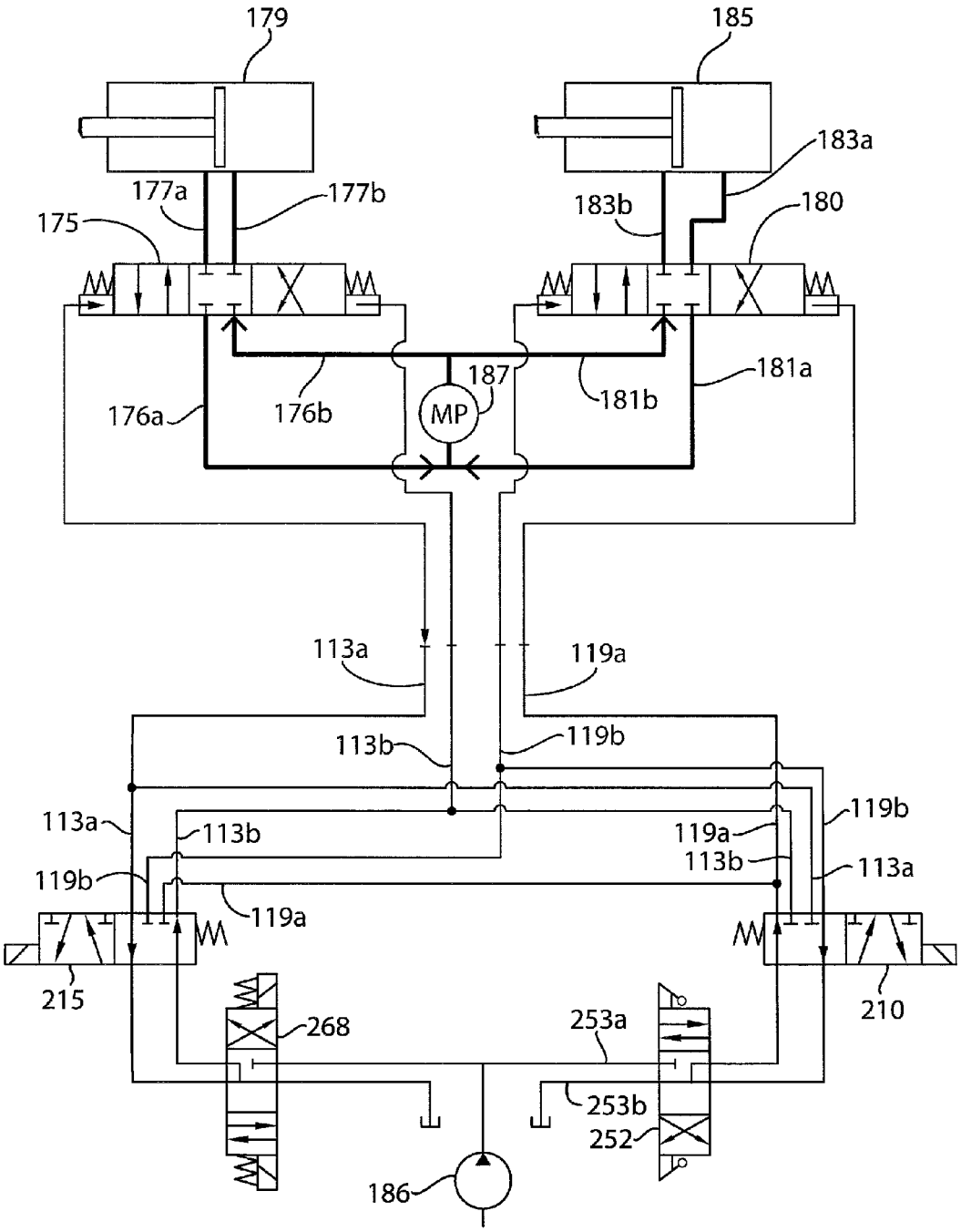
FIG. 22 is a schematic illustrating the transition between the pilot hydraulic lines associated with the pilot pump and the main hydraulic lines associated with the main pump.

FIG. 22 shows an expanded version of FIG. 12. In particular, FIG. 22 is identical to FIG. 12, however, for illustrative purposes, shows the attachment between the hydraulic lines powered by the pilot pump 186 and the hydraulic lines powered by the main pump 187.

In particular, for example, hydraulic line pair 113*a*, 113*b*, both of which are coupled to the pilot pump 186, are connected with main control valve 175, such that pressurized fluid from line 113*a* will slide the valve components to the right which in turn causes line 176*a* to feed hydraulic fluid to line 177*a* and line 176*b* feeds hydraulic fluid to line 177*b*, which in turn perform a function such as reciprocating the hydraulic cylinder 179 or, in the alternative, more simply providing pressurized hydraulic fluid to line pair 177*a*, 177*b* to operate a tool in a different fashion, such as, rotating a tool. As a result, even though the fluid flow in the pilot hydraulic lines 113*a*, 113*b* travels in a fashion similar to that of the fluid flow in the main lines 177*a*, 177*b*, using reduced pilot line pressures is an effective way of controlling the main control valve 175 without the need to utilize the high pressure supplied by the main pump 187. Furthermore, when fluid is supplied to pilot line 113*b*, the main control valve 175 shifts to the left, thereby sending fluid from line 176*b* to 177*a* and sending fluid from line 176*a* to line 177*b*, and reversing the fluid flow to the cylinder 179.

The same mechanism applies to lines 119*a*, 119*b* which control main control valve 180 by shifting to the left or to the right depending upon whether fluid is supplied under pressure to line 119*a* or to line 119*b*. Just as before, when fluid is supplied to line 119*b* the valve shifts to the right, thereby providing a direct feed from line 181*b* to 183*b* and a direct feed from line 181*a* to line 183*a*. When fluid is supplied to line 119*a* the valve shifts to the left such that the flow from line 181*b* enters line 183*a* and the flow from line 181*a* enters line 183*b*, thereby providing reverse flow to the cylinder 185. It should be noted that lines 176*a*, 176*b* and lines 181*a*, 181*b* are supplied by the main pump 187 and typical pressure supplied by the main pump 187 is around 5,000 psig while the pressures supplied by the pilot pump 186 is on the order of 200-600 psig.

What has so far been discussed is the use of a construction machine having a standard configuration utilizing a first member which is the boom and a second member which is the stick with a terminal member attached to the stick. Such terminal members may include any number of devices that would be engaged by a third cylinder on the second member and/or that would utilize the hydraulic line pairs available for the third member function.

Figure 23:
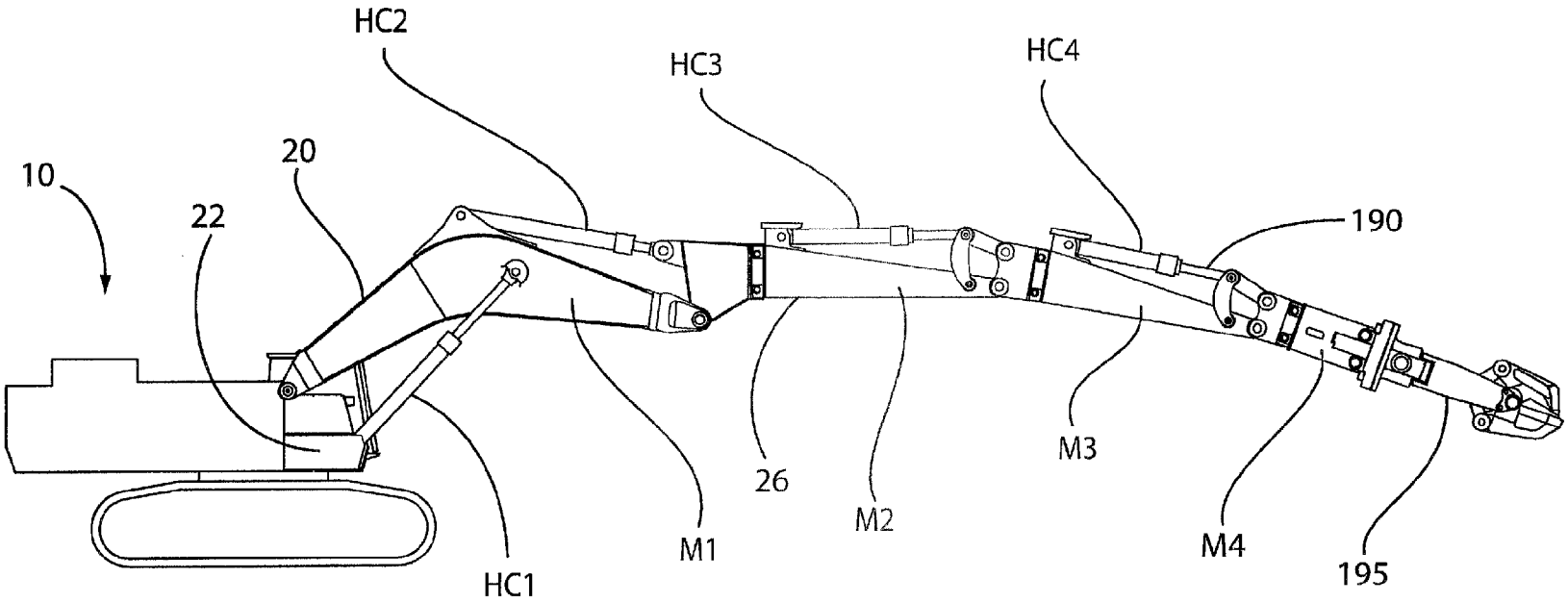
FIG. 23 is a sketch of a construction machine utilizing a third member with a shear attached thereto as a fourth member.
Figure 24:
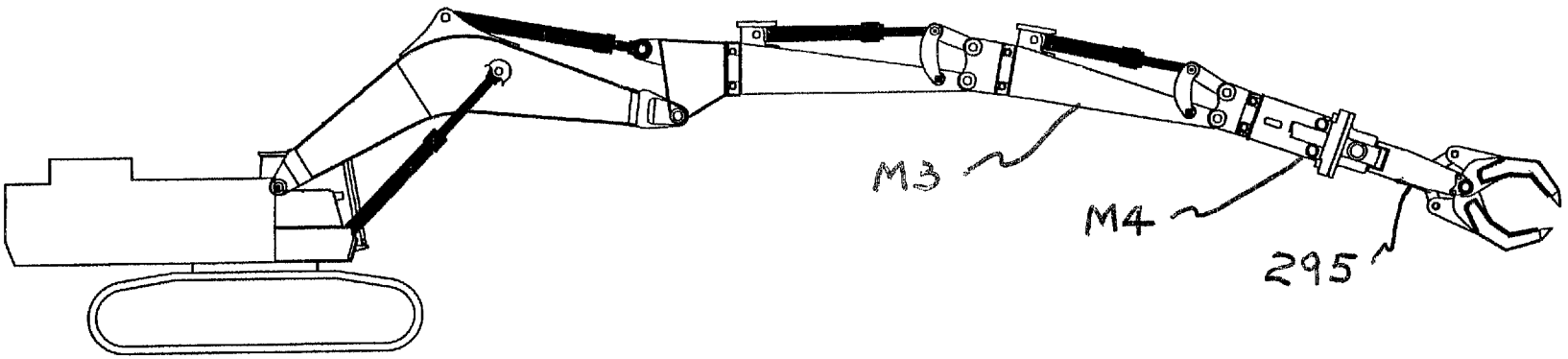
FIG. 24 is a schematic of a construction machine with a third member and a grapple attached thereto as a fourth member.
Figure 25:
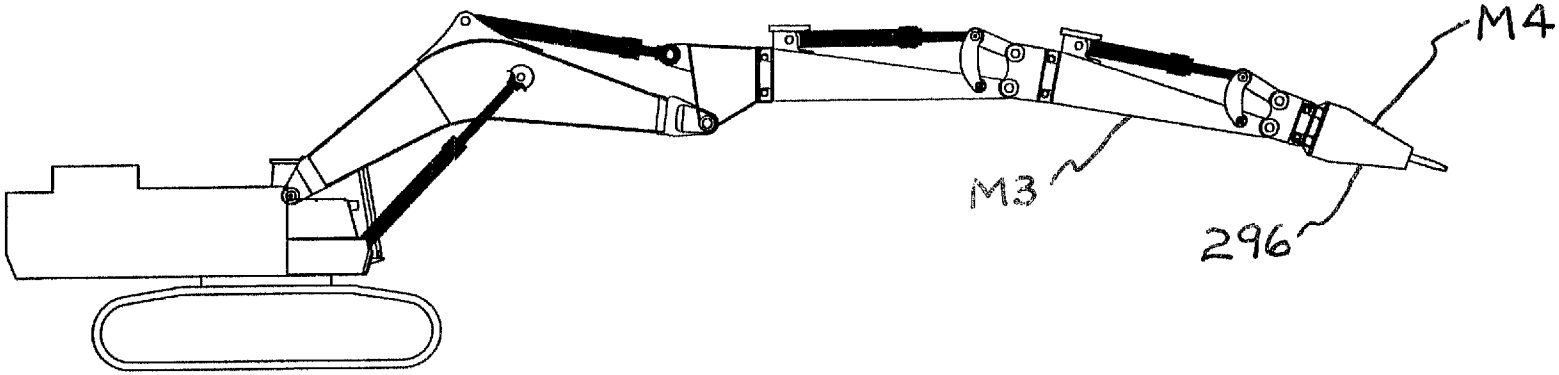
FIG. 25 is a sketch of a construction machine with a third member and a hammer attached thereto as a fourth member.
Figure 26:
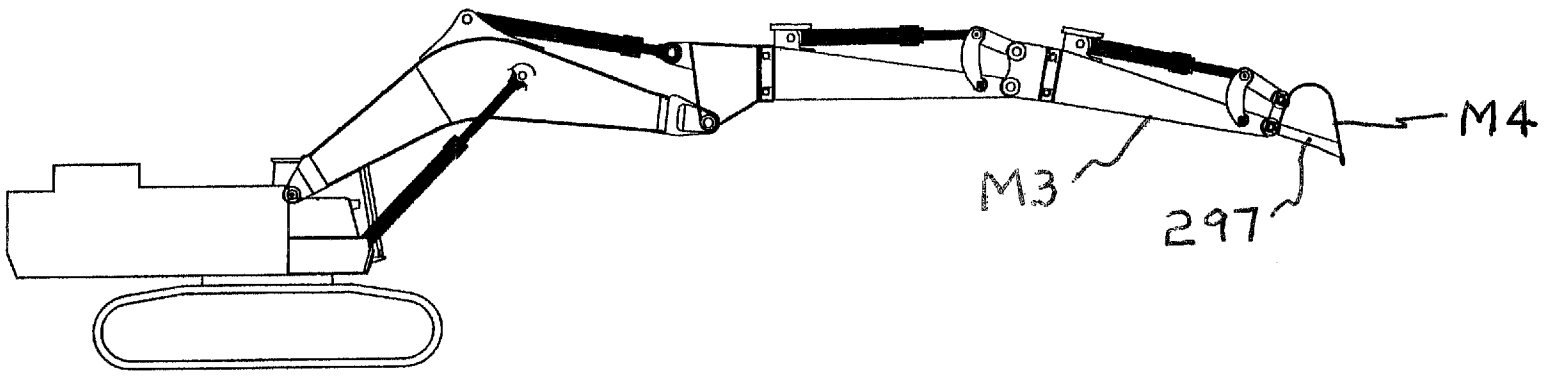
FIG. 26 is a sketch of a construction machine with a third member and a bucket attached thereto as a fourth member.
Figure 27:
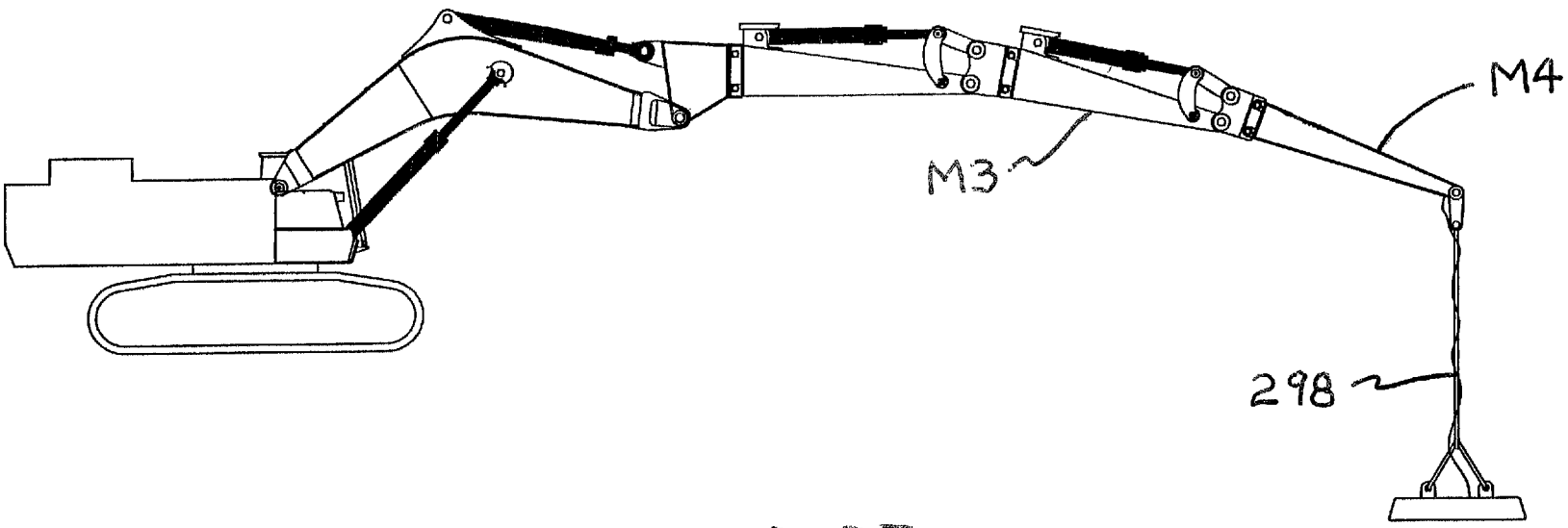
FIG. 27 is a sketch of a construction machine with a third member and a magnet attached thereto as a fourth member.

FIG. 23 illustrates a schematic of a construction machine utilizing an additional member, or third member M3, attached to the stick 26, or second member M2, which itself is attached to the boom 20, or first member M1. The boom, or first member M1, is pivoted by the first hydraulic cylinder HC1, which is attached to the platform 22 of the construction machine 10. The stick 26, or second member M2, is pivoted by the second hydraulic cylinder HC2, which is attached to the first member M1. The third member M3 is pivoted by the third hydraulic cylinder HC3 which is attached to the second member M2. Attached to the third member M3 is a shear 195 or fourth member M4, which is pivoted about the third member M3 by the fourth hydraulic cylinder HC4, which is attached to the third member M3.

For clarification, in some instances a hydraulic cylinder may be used to pivot an adjacent member, such as hydraulic cylinder HC2 pivoting member M2, which is the stick 26. Additionally, hydraulic cylinder HC3 attached to member M2 may be used to pivot third member M3. However, there could be a tool at the end of second member M2 such that the third hydraulic cylinder HC3 would be used to pivot a tool, such as the shear 195. This could equally apply to hydraulic cylinders HC3 and HC4 so that the operation of the third hydraulic cylinder HC3 and fourth hydraulic cylinder HC4 will be referred to as the third cylinder function CF3, and the fourth cylinder function CF4. The same designation will be applied to the functions associated with the second and fifth cylinder functions CF2 and CF5, respectively.

In addition to the pivoting provided by the hydraulic cylinders, individual tools have unique requirements. In particular, the jaws of the shear 195 must be able to operate and, furthermore, the shear must be able to rotate. These two additional functions require two additional hydraulic line pairs.

The hydraulic circuitry, in accordance with the subject invention, is such that the control system can accommodate not only an arrangement with just a boom and a stick but, furthermore, may accommodate the arrangement illustrated in FIG. 23 with an additional third member M3 and a tool 195 attached thereto as member M4.

FIG. 23 illustrates a shear 195 as the fourth member M4, and the hydraulic cylinder HC4 is used to extend and retract the fourth member M4. However, it should be appreciated that, as illustrated in FIGS. 24, 25, 26, and 27, the tool may be a grapple 295, a hammer 296, a bucket 297, a magnet 298, respectively, or any of a number of different tools typically attached to the end of a construction machine member.

Figure 28:
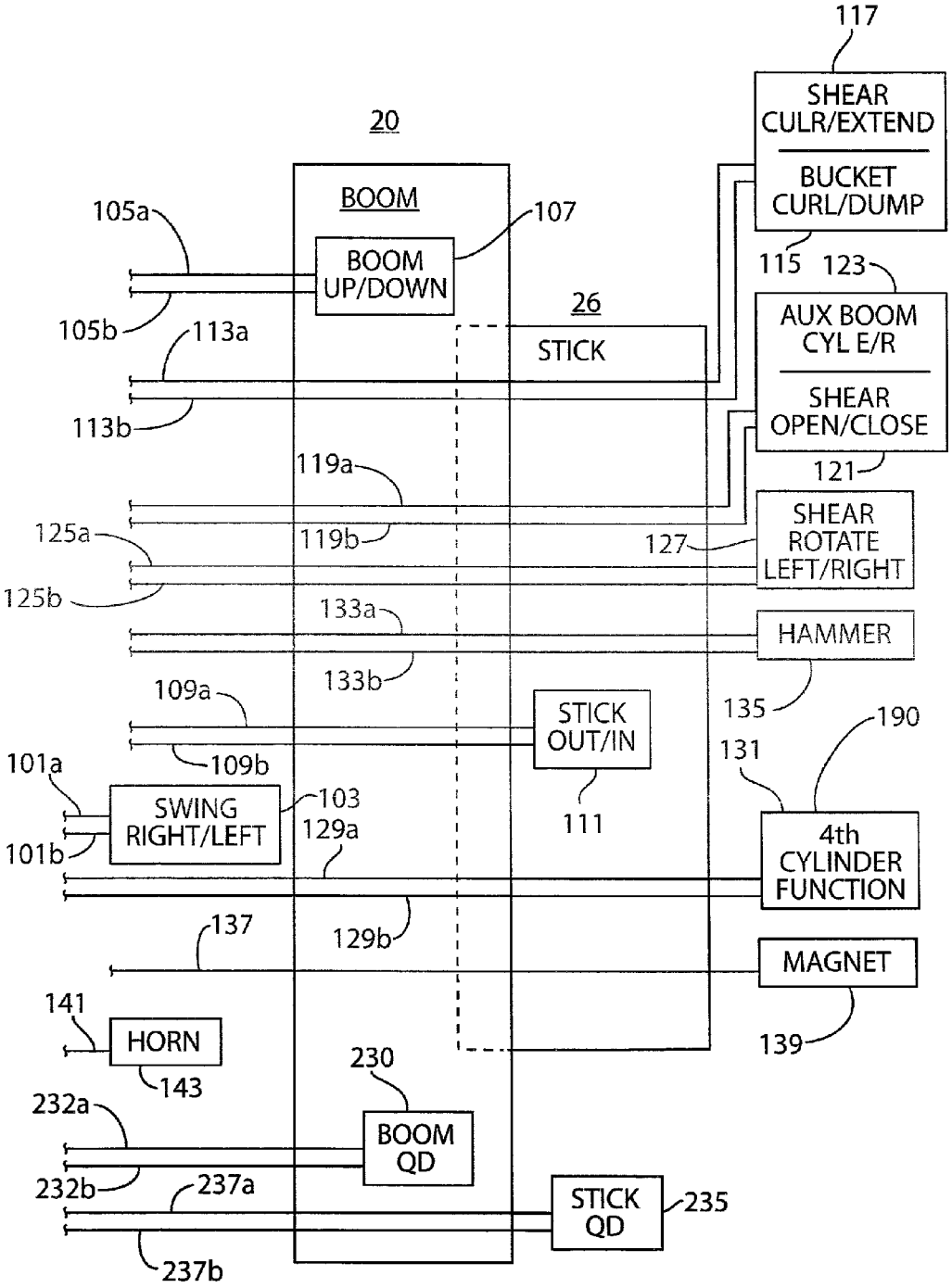
FIG. 28 is a sketch of typical hydraulic lines that may be associated with a construction machine with a third member and having a fourth member as a tool in accordance with the subject invention.

FIG. 28 is a sketch of typical hydraulic lines that may be associated with the arrangement illustrated in FIG. 23. This hydraulic line arrangement is very similar to that arrangement in FIG. 7. However, lines 129*a*, 129*b*, originally available for the auxiliary circuit 131, are now dedicated to the fourth cylinder function 190 utilized to extend or retract the fourth member M4 connected to the third member M3. As illustrated in FIG. 23, this fourth member M4 may be a shear 195.

Figure 29:
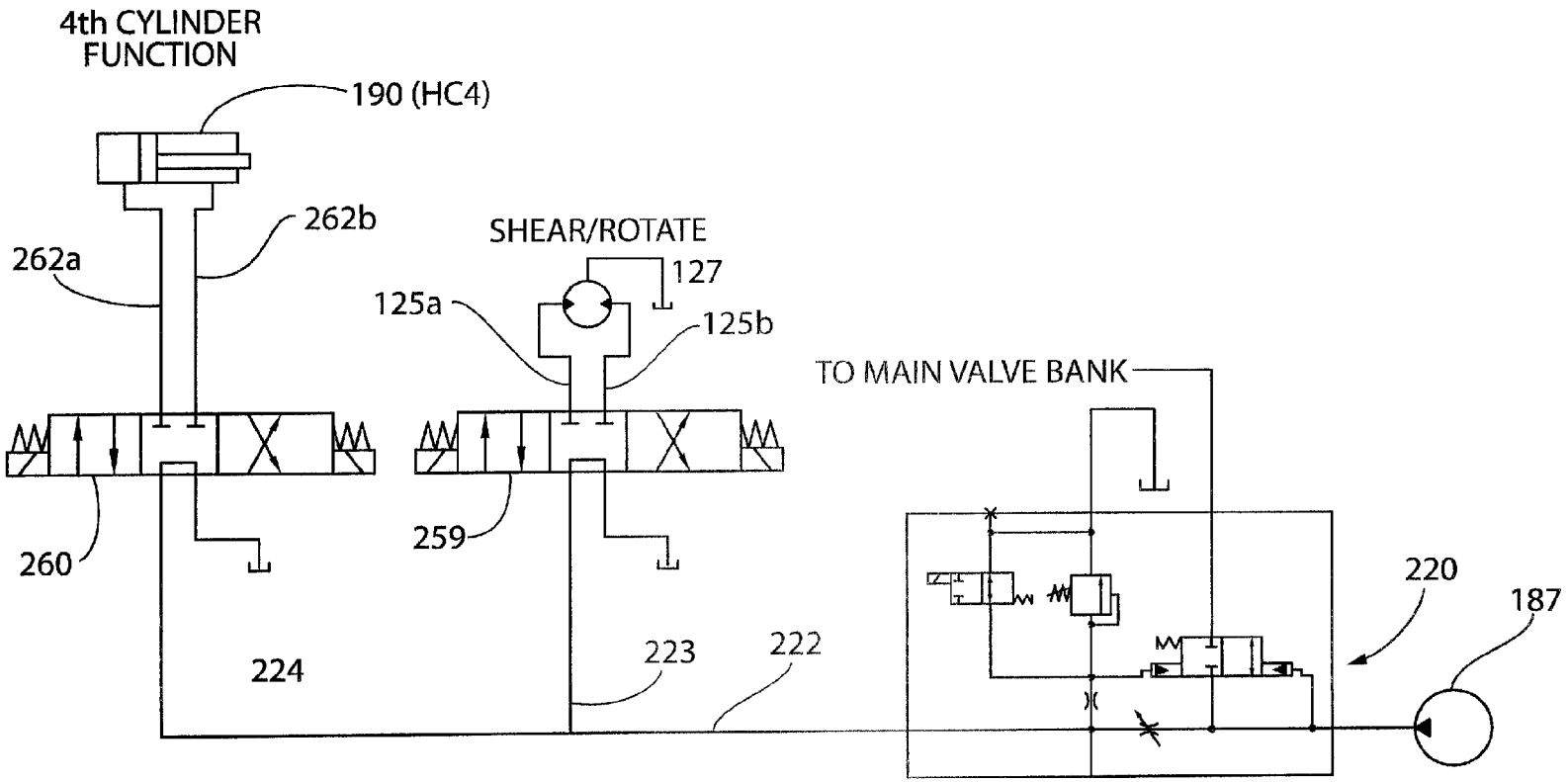
FIG. 29 is a sketch of the hydraulic circuit associated with activating the shear rotate function similar to that of FIG. 13 but additionally including a fourth cylinder function.

FIG. 29 illustrates a manner by which the fourth cylinder function 190, CF4 is energized within the hydraulic system. In particular, the supply line 222 from the divider valve 220 is split into lines 223 and 224, wherein line 223 supplies the shear rotate function 127 while line 224 supplies the fourth cylinder function 190, CF4. Each supply line 223, 224 has associated with it a return line. The flow divider valve 220 splits the flow from the main pump 187 between the main valve bank (main control valves) and line 222 which supplies the shear rotate function 127 and the fourth cylinder function HC4. However, an additional branch may be added to line 222, whereby the flow from the main pump 187 may not only be distributed to the shear rotate function 127, but furthermore, may be distributed to the fourth cylinder function 190, CF4. In particular, the divided flow from the main pump 187 enters line 224 into a flow control valve 260 and, depending upon the orientation of the flow control valve 260, provides flow directly to line pair 262*a*, 262*b* or reverses the flow of hydraulic fluid to lines 262*a*, 262*b*, such that the fourth cylinder function 190, CF4 causes the hydraulic cylinder HC4 to move in one direction or another direction. It is through this arrangement that the original equipment machine with a boom and a stick may be modified to accommodate a third member M3 that is not a tool but an extension member to which a fourth member tool may be attached.

Briefly directing attention to FIG. 23, it should be appreciated that the shear 195 required the dedication of three separate line pairs. In particular and also with reference to FIG. 28, the shear 195 requires line pair 113*a*, 113*b* to be curled and extended 117 utilizing hydraulic cylinder HC4, the shear 195 requires line pair 119*a*, 119*b* for the shear jaws to open and close 123, and the shear 195 requires line pair 125*a*, 125*b* to rotate 127.

However, at least two of these functions, in particular, the shear open/close 123 and the shear rotate 127, are functions internal to the shear 195 and do not require a separate hydraulic cylinder, such as HC4, but do require hydraulic line pairs that must be connected to the shear 195. Because certain functions, such as shear open/close 123 and shear rotate 127 require only energized hydraulic line pairs and not separate external cylinders, then it is relatively easy to extend these energized line pairs to any terminal member on a machine. As a result, certain functions available with this construction machine configuration may be associated with a tool such as a shear, for example, regardless of where the shear 195 is connected within the system. In particular, the shear 195 may be connected to the first member M1, the second member M2, or the third member M3 and, while the hydraulic cylinders attached to the penultimate member would be able to curl and extend the shear, the two other line pairs required to open and close the shear 123 and to rotate the shear 127 are merely hydraulic lines that can be easily connected or disconnected along different lengths to accommodate the shear 195 mounted at the end of any of the members M1, M2, M3.

For clarification of nomenclature, the fourth cylinder function CF4 will be directed to reciprocating motion that can be provided by the fourth hydraulic cylinder HC4, while the term "tool function" will describe open ended hydraulic lines that may be connected to a tool so that internal mechanisms of the tool may be energized to provide particular functions such as jaw open/close 123 or tool rotate 127 available with the shear 195.

Figure 30:
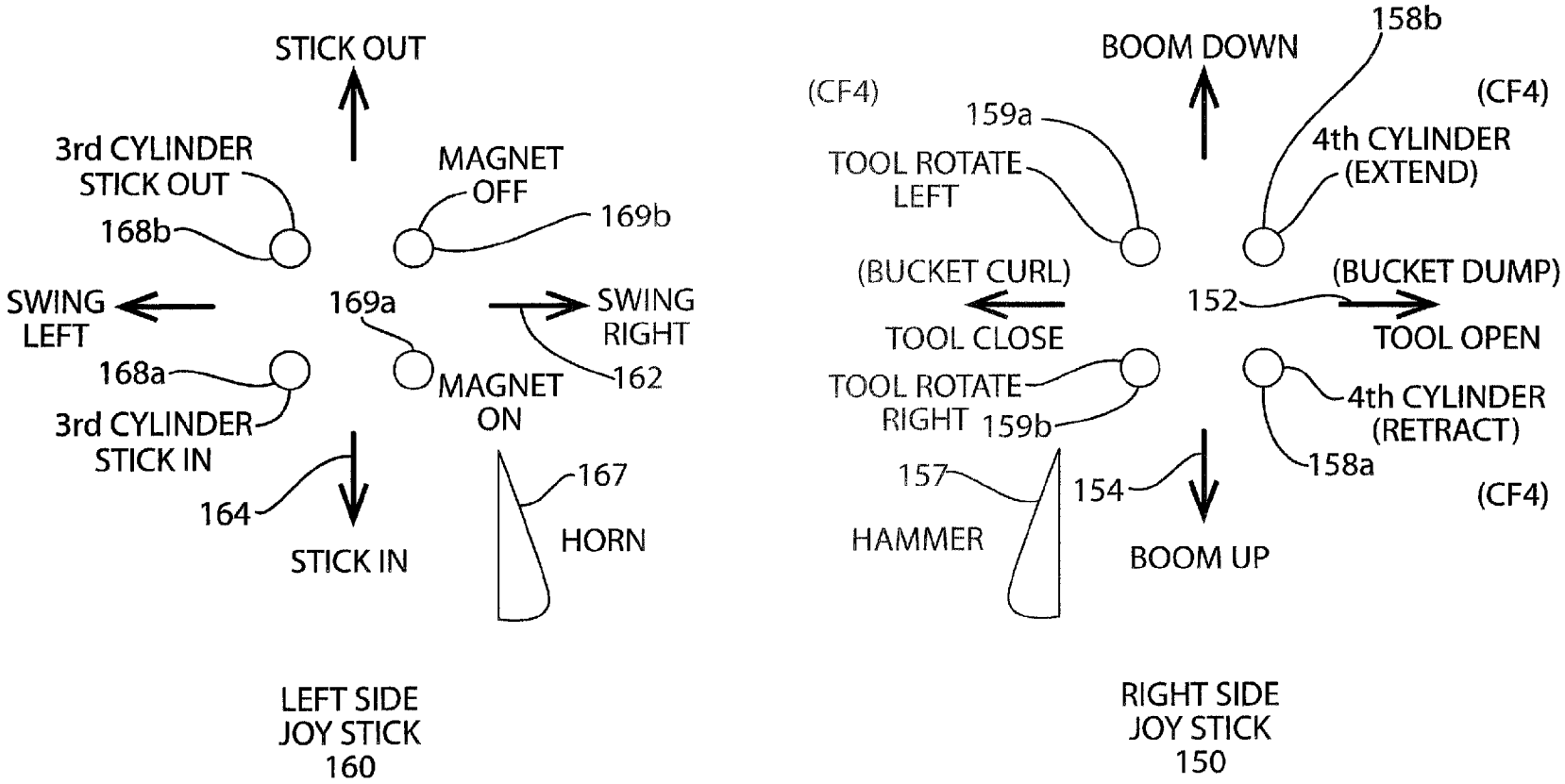
FIG. 30 is a sketch illustrating the function of the joysticks and pistol grips shown in FIG. 8 with the addition of a fourth cylinder function and with the controls for certain functions shifted to different buttons.
Figure 31:
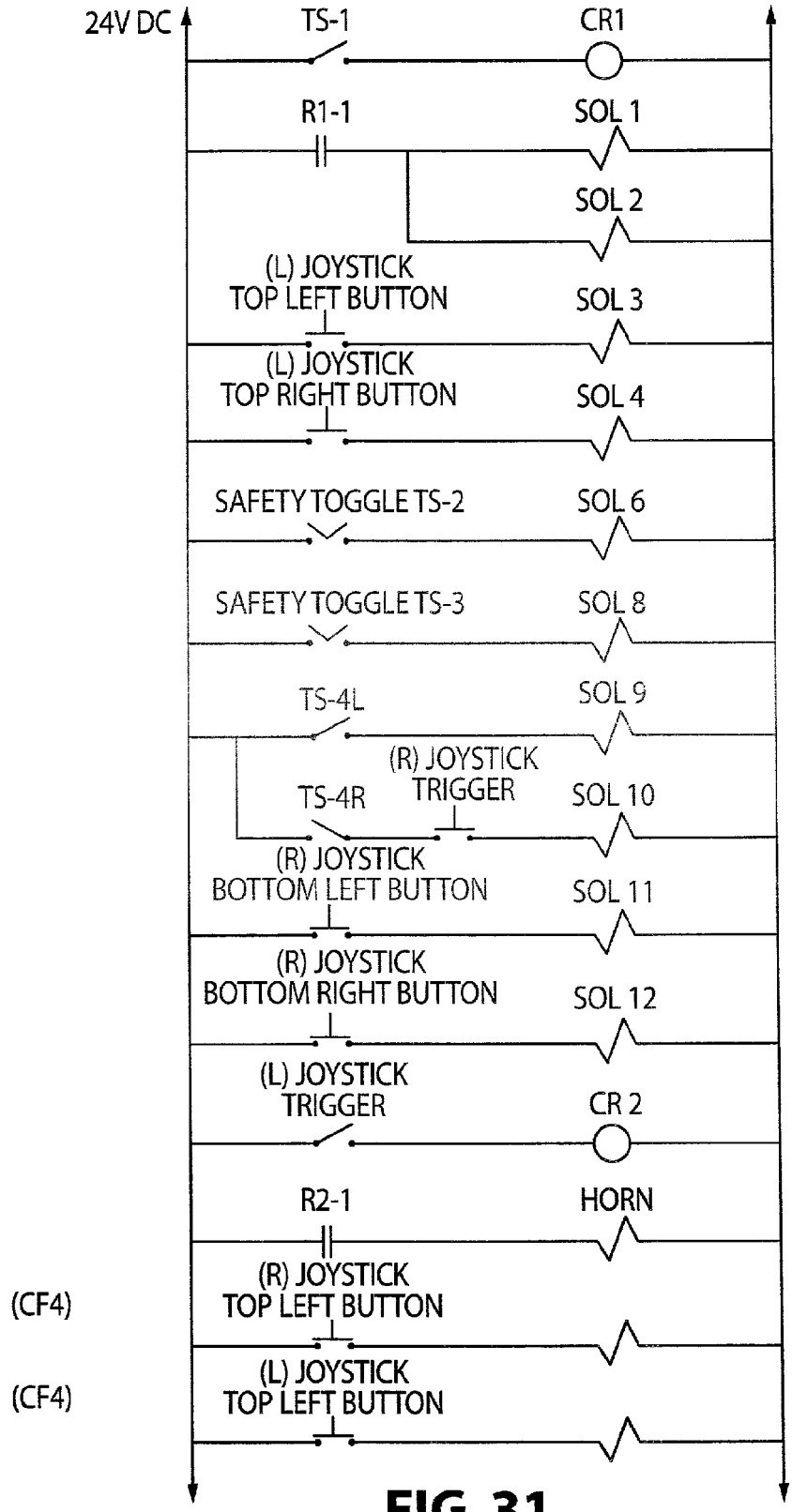
FIG. 31 is a sketch of the electric circuitry associated with controlling the hydraulic valves including circuitry associated with the fourth cylinder function.

FIG. 30 illustrates the joystick motions and buttons similar to those shown in FIG. 9 but with the addition of the fourth cylinder function CF4 operated by buttons 158*a*, 158*b* and with the controls for certain functions shifted to different buttons. These buttons 158*a*, 158*b* were previously dedicated to the auxiliary circuit cylinder extend/retract. Additionally, the electric circuitry shown in FIG. 31 is similar to that of FIG. 11, however, circuitry for the fourth cylinder function CF4 using the joystick buttons 158*a*, 158*b* (FIG. 30 has been added.

In accordance with the subject invention, it is also possible to add yet another extension member beyond member M3 illustrated in FIG. 23.

Figure 32:
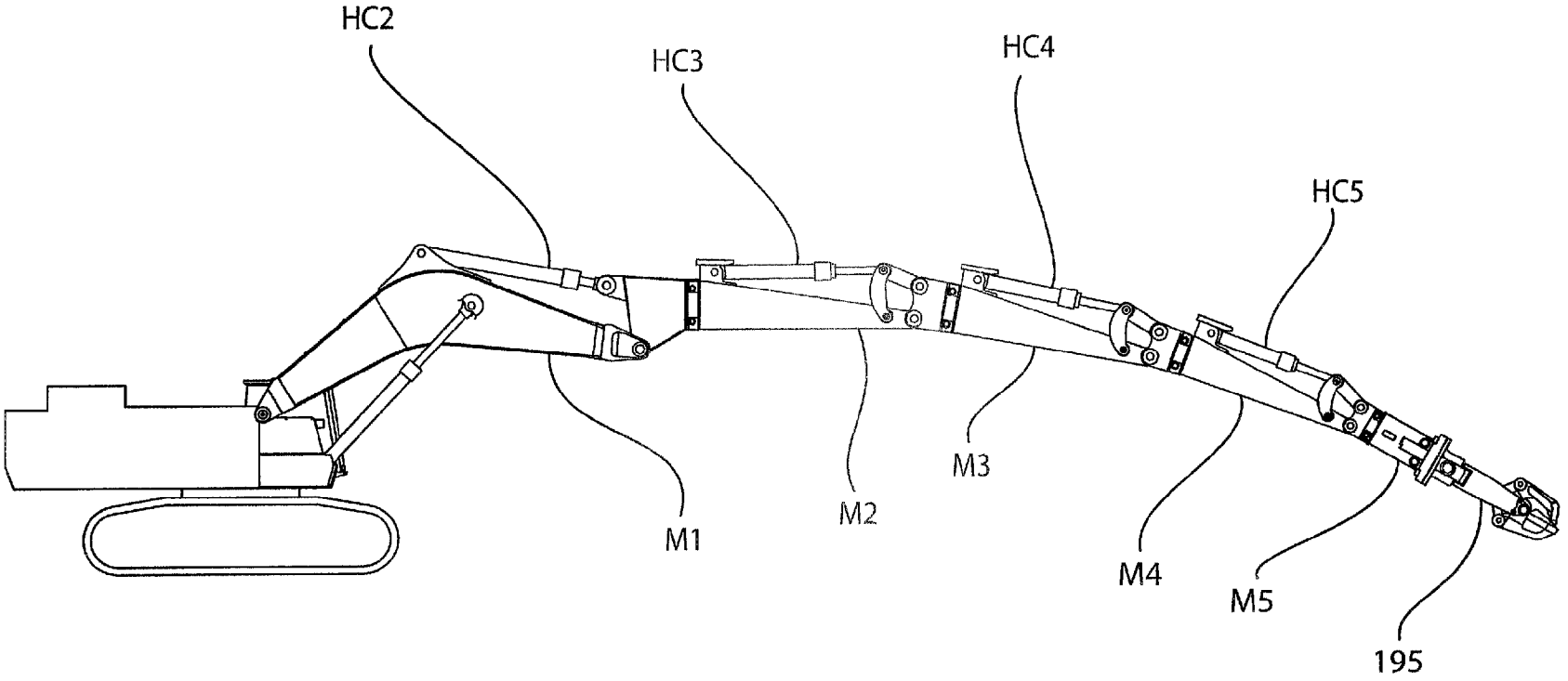
FIG. 32 is a sketch of a construction machine utilizing both a third member and a fourth member with a fifth member shear attached to the fourth member.

FIG. 32 illustrates a construction machine with a fifth member M5, which is a shear 195, attached to a fourth member M4 and controlled by the fifth hydraulic cylinder HC5. The addition of member M4 with the attached tool member M5 requires the dedication of an additional hydraulic cylinder HC5 to pivot the fifth member M5. Control of this hydraulic cylinder HC5 requires the addition of a line pair.

In one embodiment of the subject invention two functions, which are dedicated to two separate line pairs, are consolidated to a single set of line pairs. This is possible because the two functions never occur together.

Figure 4:
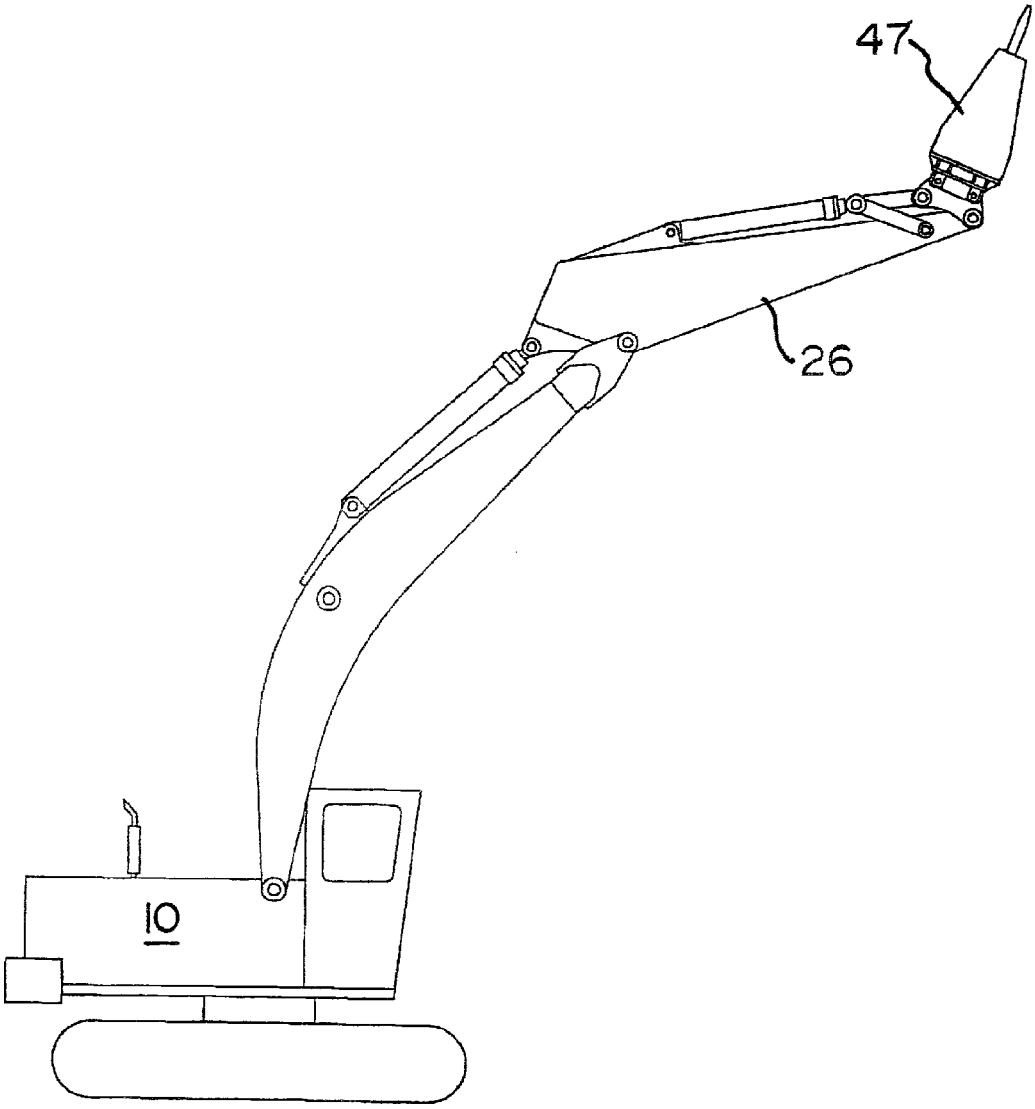
FIG. 4 PRIOR ART
FIG. 4 is prior art and is a sketch of a construction machine used to manipulate a hydraulic hammer.
Figure 5:
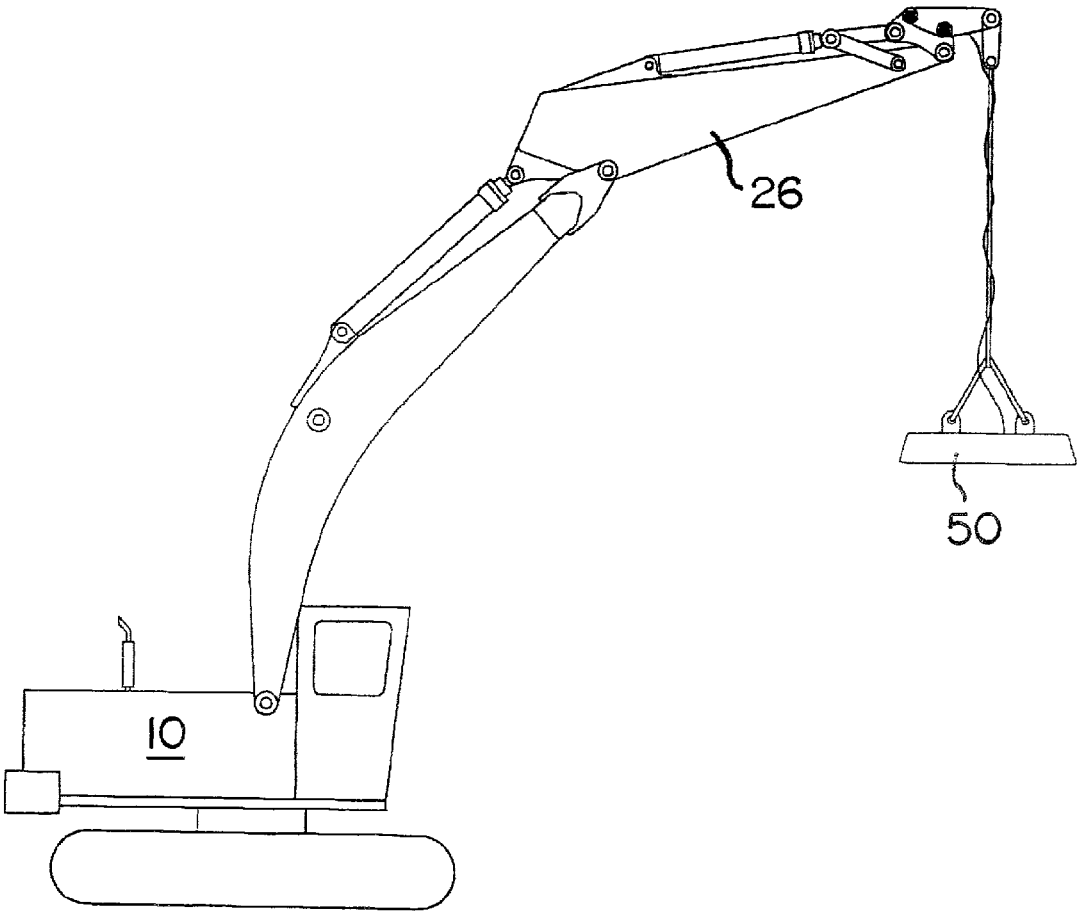
FIG. 5 PRIOR ART
FIG. 5 is prior art and is a sketch of a construction machine utilized to manipulate an electric magnet.
Figure 6:
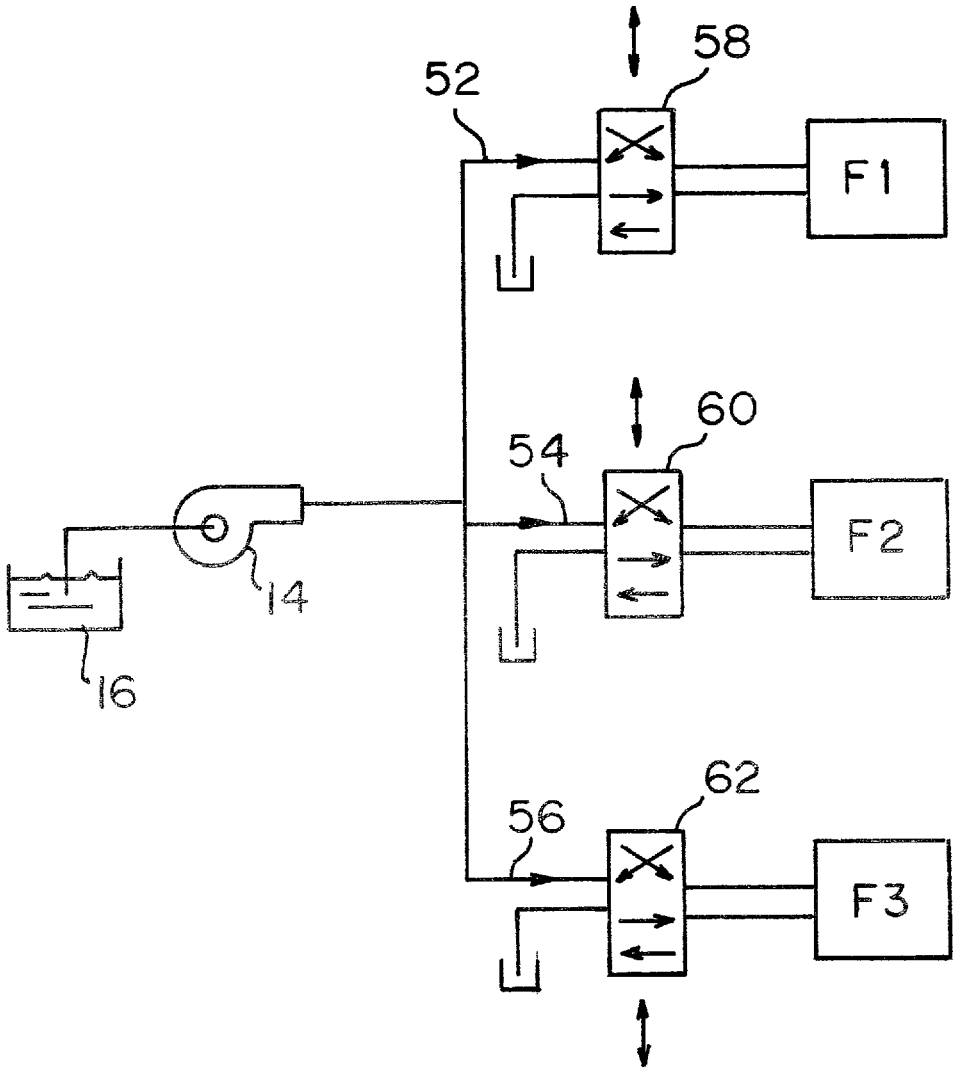
FIG. 6 PRIOR ART
FIG. 6 is prior art and is a schematic of the hydraulic circuit associated with a simple construction machine.

Briefly directing attention to FIG. 2 and FIG. 4, it should be obvious that the shear 35 (FIG. 2) may be attached to the stick 26 or member M2, or in the alternative, the hammer 47 (FIG. 4) may be attached to the stick 26 or second member M2, but they can never be attached at the same time.

Directing attention to FIG. 12, it can be seen that in one mode of operation the two line pairs 113*a*, 113*b* and 119*a*, 119*b* are dedicated to curling/extending the shear 117 and opening and closing the shear 121 or, and in another mode of operation, are dedicated to, curling or dumping the bucket 115. Lines 113*a*, 113*b* are associated with a particular hydraulic cylinder, such as HC3 in FIG. 2, while lines 119*a*, 119*b* are pressurized hydraulic lines suitable for tool functions. In an earlier embodiment illustrated in FIG. 14, the hammer 135 was supplied by fluid divided from main pump 189 fluid. Since the hammer 135 is operated by pressurized hydraulic lines, then the Applicants have realized it is possible to operate the hammer 135 and provide the other tool functions provided by line pair 119*a*, 119*b* using the same line pair 119*a*, 119*b*. By doing so, the line pair 133*a*, 133*b* originally dedicated to the hammer 135 may be freed up to be used for another function.

With the addition of each extra member, it is necessary to dedicate a hydraulic cylinder to operate the associated cylinder function for that additional member. FIG. 32 illustrates an arrangement with five members M1, M2, M3, M4, M5. To accommodate additional members without the need to add additional hydraulic line pairs, the Applicant has realized that it is possible to supplement the function of the line pairs 113*a*, 113*b* and 119*a*, 119*b* (FIG. 12) so that they too are available to operate the hammer 135, thereby freeing up high pressure lines 133*a*, 133*b* previously dedicated to the hammer 135 for another operation.

As a result, with attention to FIG. 14, the hammer 135 associated with line pair 133*a*, 133*b* may be transferred to a hydraulic line pair already dedicated for a tool function at the end of the construction machine. As a result, line pair 133*a*, 133*b* associated with the main pump 189 would be freed up for other purposes.

Figure 33:
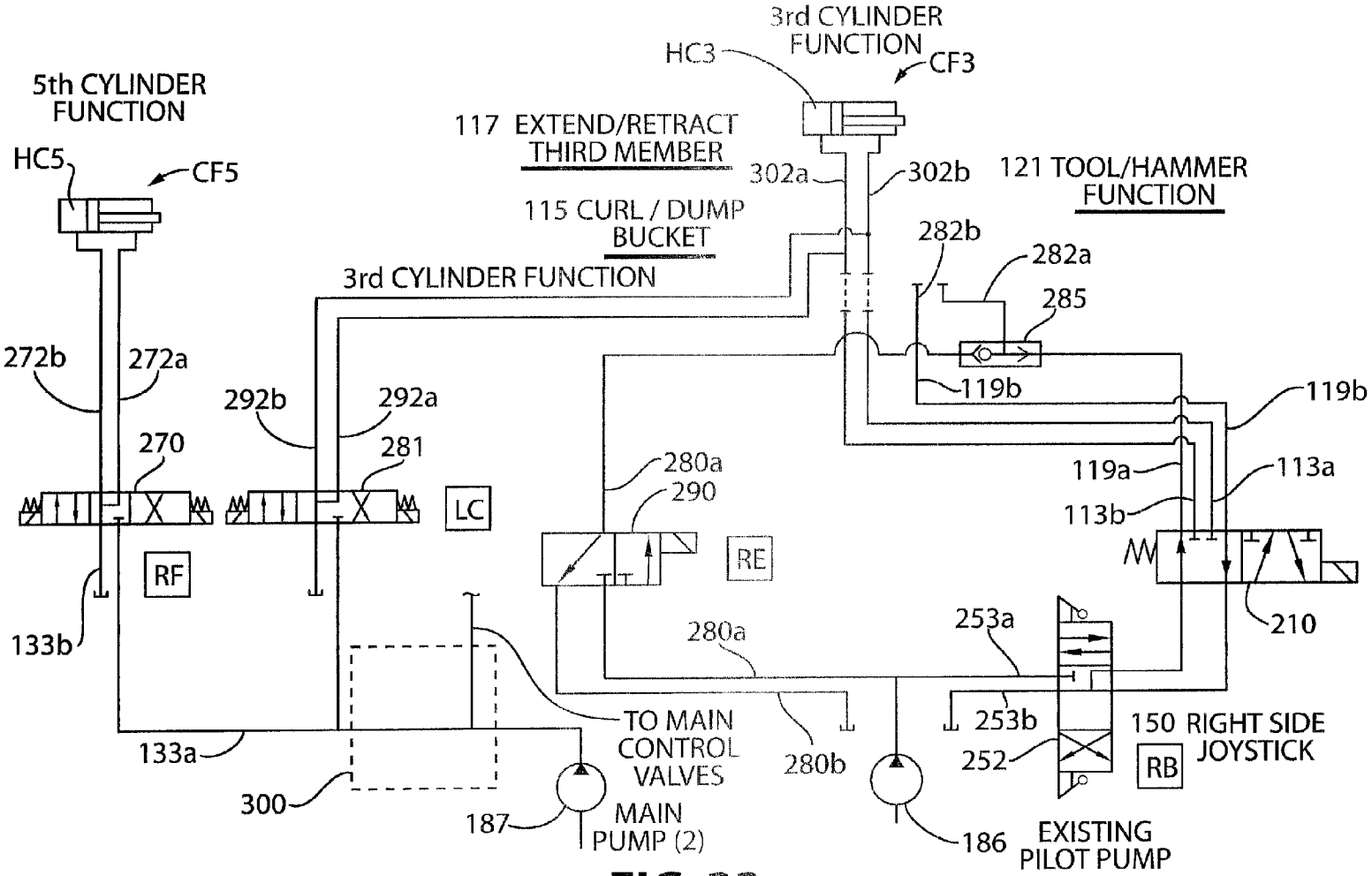
FIG. 33 is a sketch of the hydraulic circuit associated with lateral motion of the right joystick and activation of the fifth cylinder function associated with a fifth member tool that is attached to the fourth member.

The freed-up line pair 133*a*, 133*b* could be used to operate a hydraulic cylinder associated with another member that could be added to the configuration. As illustrated in FIG. 32, a fifth member M5 is attached to a fourth member M4. As illustrated in FIG. 33, this freed-up line pair 133*a*, 133*b* may be used to control the hydraulic cylinder HC5 mounted to the fourth member M4 to operate the fifth cylinder function CF5.

Directing attention to FIG. 33, lines 133*a*, 133*b* can now accommodate operation of the fifth cylinder function CF5 to operate the fifth cylinder HC5 which would be used for example, to curl and extend a tool M5 pivotally attached to the fourth member M4. Fluid from line 133*a* would provide control valve 270 with pressurized fluid such that control valve 270 in a first position would provide fluid directly to line 272*a*, while in the reverse position control valve 270 would provide fluid directly to line 272*b*. In each configuration the line that is not provided with fluid acts as a discharge line discharging fluid to line 133*b*, where it is drained.

As illustrated in FIG. 33, a hammer fixed line pair 280*a*, 280*b* provides hydraulic fluid for operating the hydraulic hammer (not shown), wherein the supply line 280*a* of the hammer fixed line pair 280*a*, 280*b* mergers with a dual function hydraulic line pair 282*a*, 282*b* at a shuttle check valve 285 such that only one at a time of the hammer fixed line pair 280*a*, 280*b* or the tool branch line pair 119*a*, 119*b* may communicate with the dual purpose hydraulic line pair 282*a*, 282*b*. A flow control valve 290 for the hammer fixed line pair 280*a*, 280*b* permits pressurized hydraulic fluid to travel in a single direction to the hammer (not shown).

Of additional interest, with respect to FIG. 33, is the manner by which the pilot pump 186 provides fluid to not only control the hammer function using lines 280*a*, 280*b* but, furthermore, to provide fluid for other tool functions using brand lines 253*a*, 253*b* while, at the same time, providing fluid for a third cylinder function CF3 using lines 253*a*, 253*b*.

Directing attention to FIG. 33, a first open function hydraulic line pair 253*a*, 253*b* provides fluid to one of a bucket branch line pair 113*a*, 113*b* or to a tool branch line pair 119*a*, 119*b*. The fluid in the bucket branch line pair 113*a*, 113*b* controls a third hydraulic cylinder HC3 through the third cylinder function CF3 for curling/extending member, such as a bucket, extending from the end of a member and, wherein the tool branch line pair 119*a*, 119*b* controls reciprocating fluid to a dual purpose hydraulic line pair 282*a*, 282*b* for operating a hydraulic tool. A diverter valve 210 associated with the first open function line pair 253*a*, 253*b* is used for diverting fluid to one of the bucket line pair 113*a*, 113*b* or the tool branch line pair 119*a*, 119*b*. A first open function flow control valve 252 for the first open function hydraulic line pair 253*a*, 253*b* is located between the diverter valve 210 and the pilot pump 186. The flow control valve 252 reciprocates the flow in the open function line pair 253*a*, 253*b*, thereby reciprocating the flow in the bucket branch line 113*a*, 113*b* or in the tool branch line 119*a*, 119*b*.

As further disclosed in FIG. 33, a third hydraulic cylinder HC3 associated with the third cylinder function CF3 has a line pair 113*a*, 113*b* for providing hydraulic fluid to the third hydraulic cylinder HC3 for extending/retracting a third member M3. Additionally, a flow control valve 252 for the third hydraulic cylinder HC3 fixed line pair 113*a*, 133*b* permits pressurized hydraulic fluid to travel through the fixed line pair 113*a*, 113*b* in a reciprocating fashion.

The hydraulic tool attached to the terminal member may be, as illustrated in FIGS. 25, 26, 27, and 28, a grapple 295, a hammer 296, a bucket 297, a magnet 298, or any of a number of different tools typically attached to the end of a construction machine member.

While the flow control valves illustrated throughout the application, are schematics which essentially show an on/off valve, these schematics are only intended to illustrate function and it should be appreciated that this type of on-off valve is available but, furthermore, there are proportional valves available by which the flow rate through the valve is proportional to the displacement of a control lever on the valve. This type of valve is called a proportional valve and anywhere herein a flow control valve is illustrated or discussed, a proportional valve may be substituted in its place to provide a wider range of control for the operator to vary the flow rate through the valve in either direction. Such proportional valves may be provided with a lever or a sliding switch, such that the placement of the lever or the sliding switch determines the amount of fluid that is permitted to pass through each of these valves. One particular application for such a proportional valve known as a proportional slider switch would apply to the flow control valve 281 associated with the third cylinder function lines 292*a*, 292*b* for the third cylinder function CF3.

Just as in earlier embodiments, the diverter valve 210 still permits the flow control valve 252 to operate on either line pair 113*a*, 113*b* or 119*a*, 119*b*. However, with the introduction of a third member M3, which itself may accommodate a tool, then when the flow control valve 252 is assigned to the tool/hammer function 121, it is necessary to control the third hydraulic cylinder HC3 for the third cylinder function FC3 through another circuit.

To achieve this, a divider valve 300 splits flow from the main pump 187, which was originally dedicated solely to providing fluid to the main control valves, to the flow control valve 281 which is in fluid communication with the line pair 292*a*, 292*b* connected to the third hydraulic cylinder HC3 which controls the third cylinder function CF3. In this fashion, with a tool attached to the third member M3, as illustrated in FIG. 23, it is possible to extend/retract the third member M3 with the flow control valve 281 using the third cylinder function CF3 and to control the internal tool operation of the tool attached to the third member M3 using either flow control valve 210 for the tool function or flow control valve 290 for the hammer function.

It should be noted in FIG. 33, that, while there is a direct line from line pair 292*a*, 292*b* to the third hydraulic cylinder HC3, there is a broken line between line pair 113*a*, 113*b* and line pair 302*a*, 302*b* associated with the third hydraulic cylinder HC3. Line pair 292*a*, 292*b* receives fluid directly from the main pump 187 at a pressure of approximately 5,000 psi, which is sufficient to operate the third hydraulic cylinder HC3. However, line pair 113*a*, 113*b* is part of a network of hydraulic lines receiving fluid from the pilot pump 186 at a much lower pressure and these lines, in turn, control the main control valves (not shown) which provide high pressure fluid to the line pair 302*a*, 302*b*.

It should be noted that a single line pair 282*a*, 282*b* provides either a tool function 121 which requires reciprocating hydraulic fluid, or, in the alternative, provides a hammer function which requires pressurized fluid only in a single direction.

As illustrated in FIGS. 23 and 32, the construction machine may have a fourth member M4 made up of either a tool, such as shear 195 in FIG. 23, or an extension member as shown in FIG. 32. In either instance, the fourth cylinder function CF4 made up of a fourth hydraulic cylinder HC4 will be utilized to extend/retract the member M4. The manner for controlling the extend/retract of the fourth member M4 is similar whether the fourth member M4 is a tool or an extension member.

Figure 34:
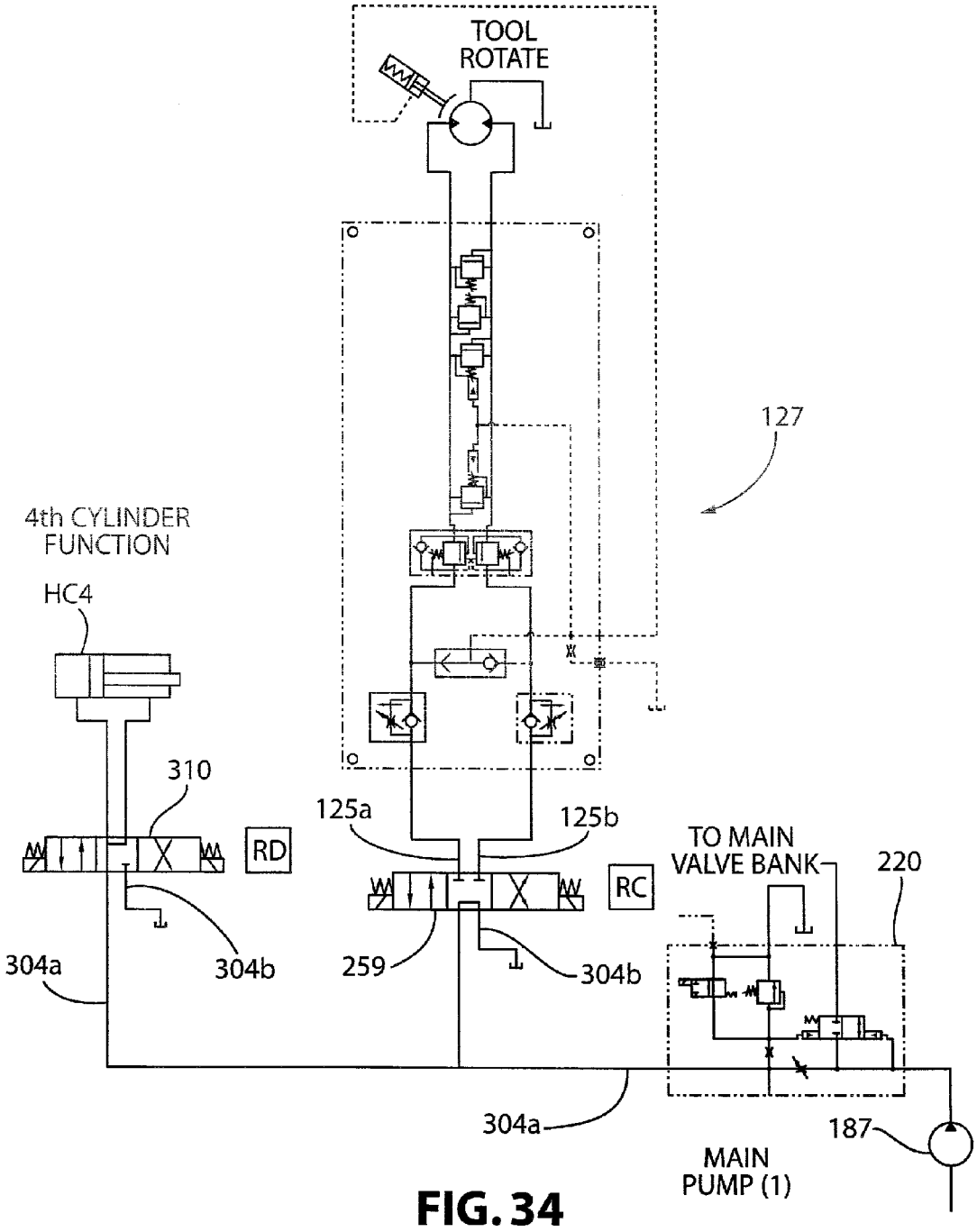
FIG. 34 is a sketch of hydraulic circuit associated with the tool rotate function and the fourth cylinder function.

As a result, the details of FIG. 34, which is representative of the fourth member M4 as an extension member, is similar to the details of FIG. 29, which is representative for the fourth member M4 as a tool, such as a shear.

As shown in FIG. 34, the circuit necessary for controlling the fourth hydraulic cylinder HC4 is a line 304*a* extending from the divider valve 220 from the main pump 187. A flow control valve 310 for the fourth hydraulic cylinder HC4 permits pressurized hydraulic fluid to travel through the fixed line pair 304*a*, 304*b* in a reciprocating fashion.

The fourth hydraulic cylinder HC4 is controlled by flow control valve 310 which, is a line 304*a* extending from the divider valve 220 which may also supply fluid to the tool rotate function 127.

The flow control valve 310 for the fourth hydraulic cylinder HC4, or any other flow control valve, may be operated to simulate proportional control valves. In particular, control cards may be pre-programmed to provide a "ramp-up" delay in the buttons 158*a*, 158*b* when they are held down for activation.

Directing attention to FIG. 33, the hammer fixed line pair 280*a*, 280*b* is connected to line pair 282*a*, 282*b* when the hammer function is operating. Under these circumstances, the high pressure line (not shown) which is controlled by the pilot line pair 282*a*, 282*b* has associated therewith a pressure relief valve set at a pressure less than that provided by the main pump, since the hammer function preferably operates at a pressure around 3,000 psig, while the pressure provided by the main pump is approximately 5,000 psig.

FIG. 32 illustrates a fourth member M4 attached to the third member M3 and the hydraulic tool M5 is pivotally attached to the member M4. As illustrated, member M5 is a hydraulic tool which is a shear 195. However, just as with respect to the attachments for the third member M3, as illustrated in FIGS. 23 and 24-27, it is also possible, as illustrated in FIGS. 39-42, for the hydraulic tool associated with the fifth member M5 to be a grapple 295, a hammer 296, a bucket 297, or a magnet 298, respectively.

It should be appreciated that with the configurations described herein, it is possible to extend the lines associated with the tool function to service hydraulic tools attached to the ends of any members M1, M2, M3, M4 by shortening or lengthening the length of these hydraulic line pairs. For that reason, the tool function is essentially independent of the number of members associated with the construction machine. The difference, however, occurs because each member M1, M2, M3, M4 must have an associated hydraulic cylinder HC1, HC2, HC3, HC4 with a control function CF1, CF2, CF3, CF4. Therefore, while the tool function commands remain the same, with each member added it will be necessary to provide an additional pair of hydraulic lines and an additional flow control valve.

Additionally, the configuration of the subject hydraulic control system is such that the construction machine may easily be returned to the OEM configuration and the motion of the controller (joystick) associated with the bucket extend/curl function will be the same motion utilized in the original equipment before modification in accordance with the subject invention.

Figures 35, 36:
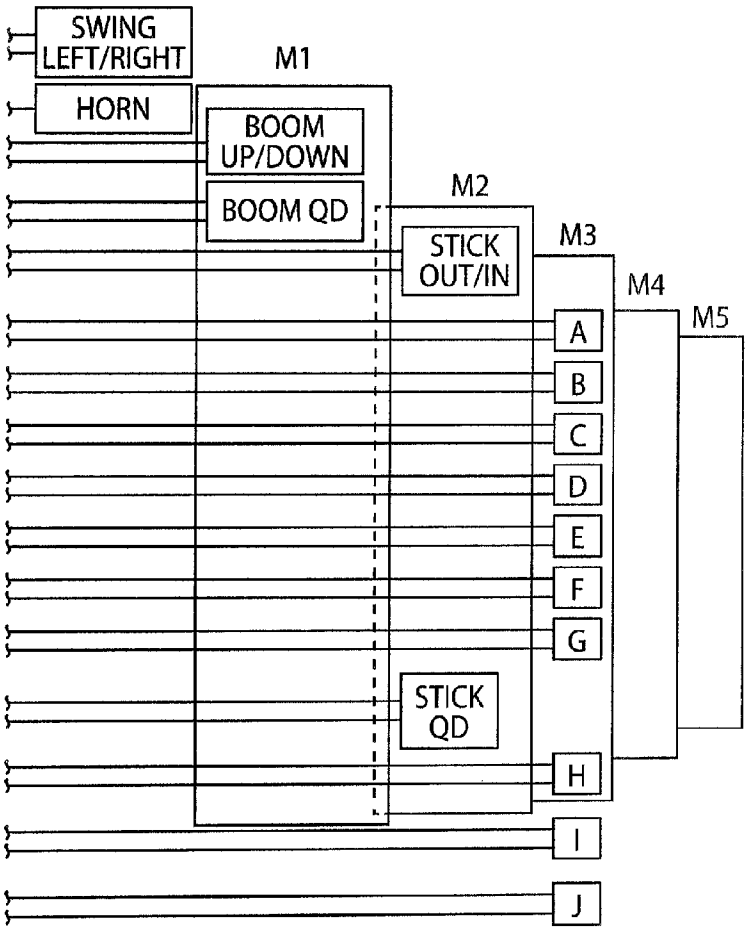
FIG. 35 is a sketch of typical hydraulic lines that may be associated with a construction machine similar to the arrangement in FIG. 7 but including additional hydraulic lines that may be associated with a fourth member and a tool attached thereto as a fifth member.
FIG. 36 is a chart illustrating in what capacity the functions A-K in FIG. 35 may be utilized for a construction machine having both a third and fourth member with a tool attached thereto as a fifth member.

Hydraulic line pairs are identified A-K in FIG. 35 and FIG. 36. FIG. 36 presents a table illustrating how each of these hydraulic line pairs may be utilized for different configurations of the construction machine. In particular, line pairs A, B and C are dedicated to the operation of hydraulic cylinders HC3, HC4, HC5 and, depending upon the configuration of the members, each may be dedicated to pivoting an associated member M3, M4, M5 with operation of hydraulic cylinders HC3, HC4, HC5. However, in the event, for example, only the third member M3 is attached to the machine, then the hydraulic cylinder HC4 will be available to operate a tool such as extending or curling a shear or curling or dumping a bucket. However, in the event a fourth member M4 is mounted, then the fourth cylinder HC4 is dedicated to operating the fourth member M4 and the fifth cylinder HC5 is now available to pivot a tool such as curl/extend a shear or curl/dump a bucket. Additionally, hydraulic lines I, J, and K are dedicated to providing quick disconnect for couplers between members M2 and M3, members M3 and M4, and members M4 and M5, respectively.

From inspection of the table illustrated in FIG. 36, it should be appreciated that the tool function, as previously described, represents a hydraulic line pair to provide fluid to operate a tool; such as the shear rotate, hammer, shear open/closed. These functions may be implemented independent of the location of such a tool relative to the existence of one or more members M2, M3, M4, M5.

Figure 37:
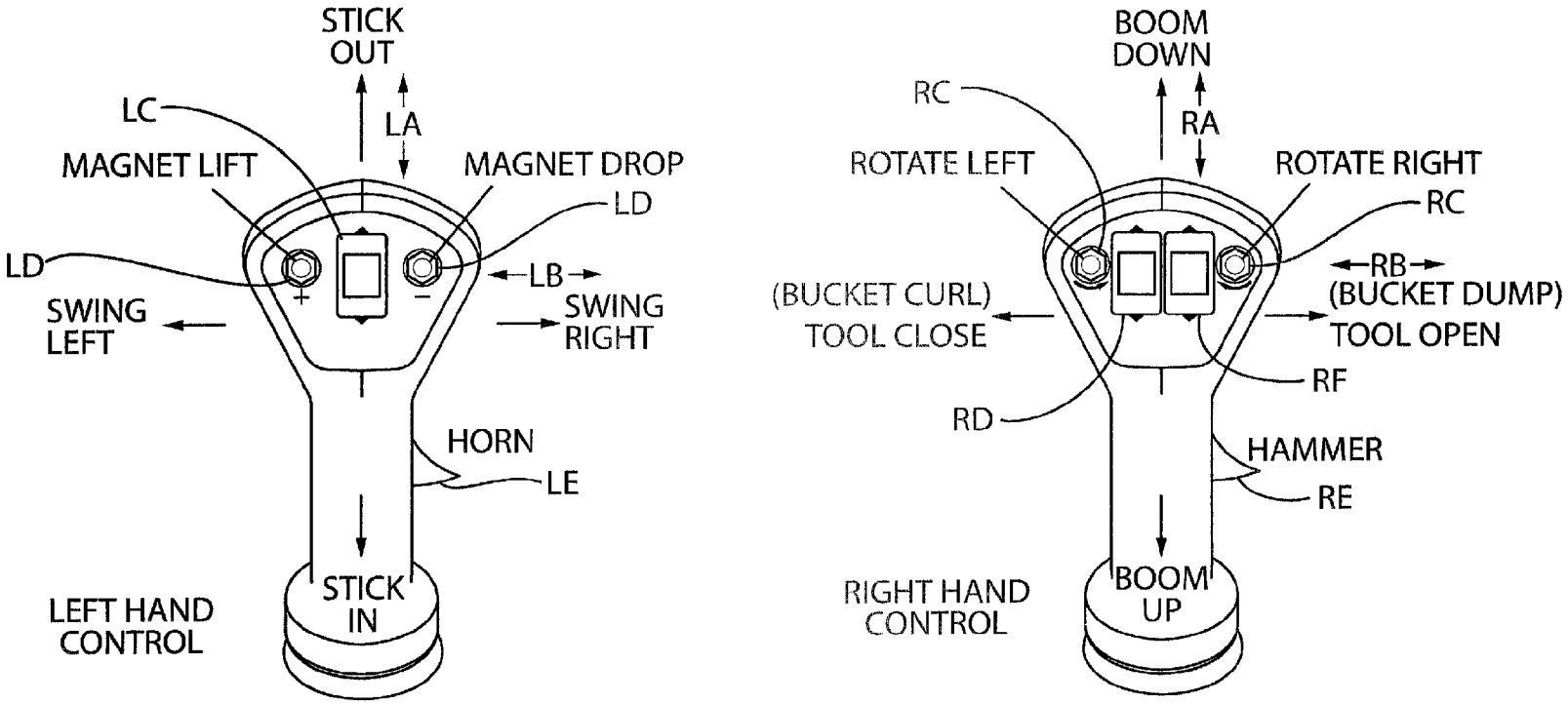
FIG. 37 is a sketch of two joysticks, each with a pistol grip having sliding switches thereupon used as controllers for a construction machine.

While FIG. 30 illustrates the joystick motions and button controls to operate a construction machine having a boom and a stick with a tool attached thereto or having a third member M3 attached to the stick M2, in order to control the operation of members M3, M4, M5, the joysticks illustrated in FIG. 37 may be utilized. The joysticks illustrated in FIG. 37 have additional controllers for the additional cylinder functions associated with adding members to the construction machine. The letter designation found adjacent to the joystick is identified in FIGS. 33 and 34 to correlate the joystick motions or button/switch activation with the operation of a joystick cylinder function, tool function of the construction machine.

Figure 38:
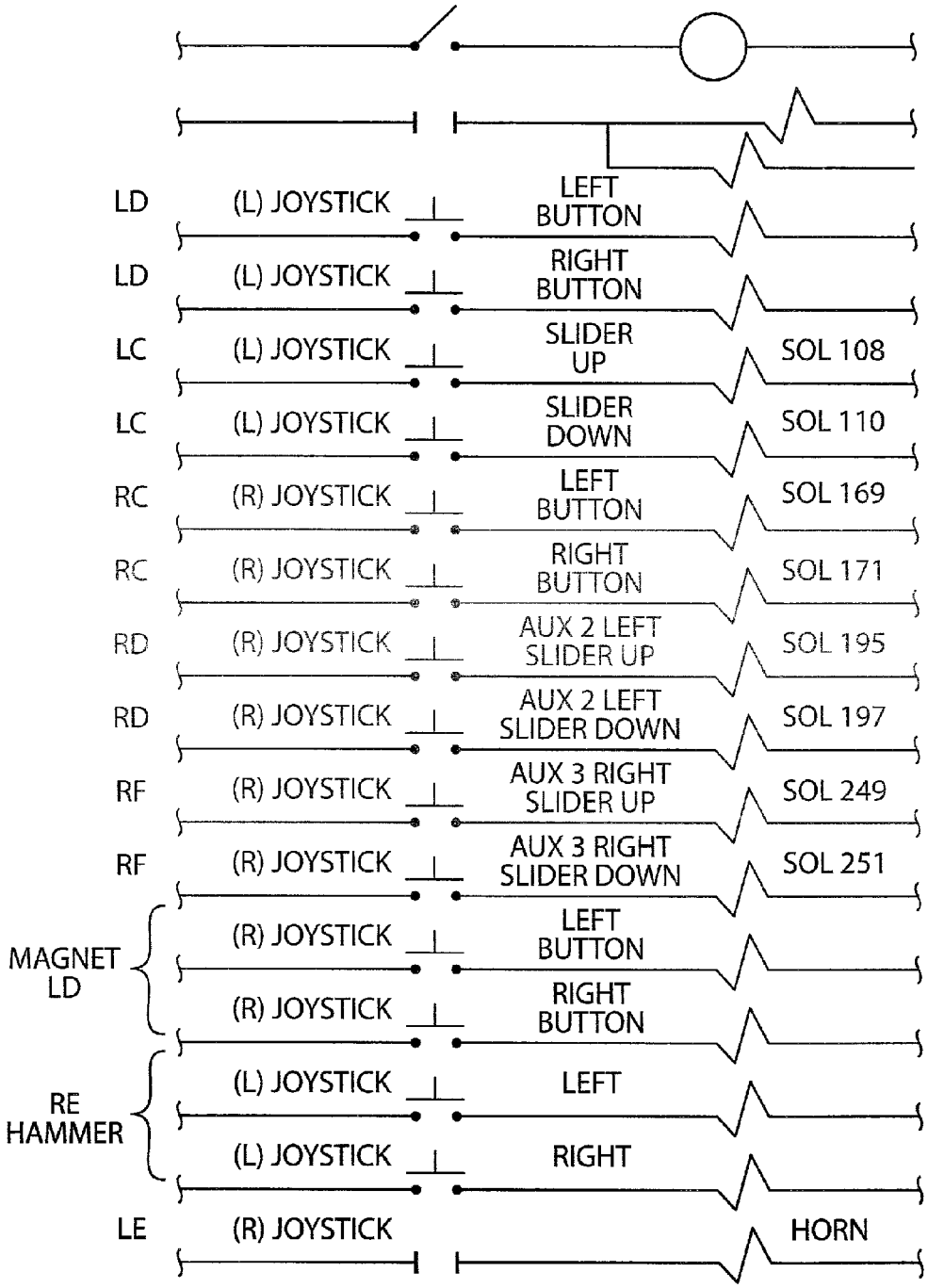
FIG. 38 is a sketch of the electric circuitry associated with controlling the hydraulic valves for an arrangement utilizing both a third member and a fourth member with a fifth member tool attached thereto.
Figure 39:
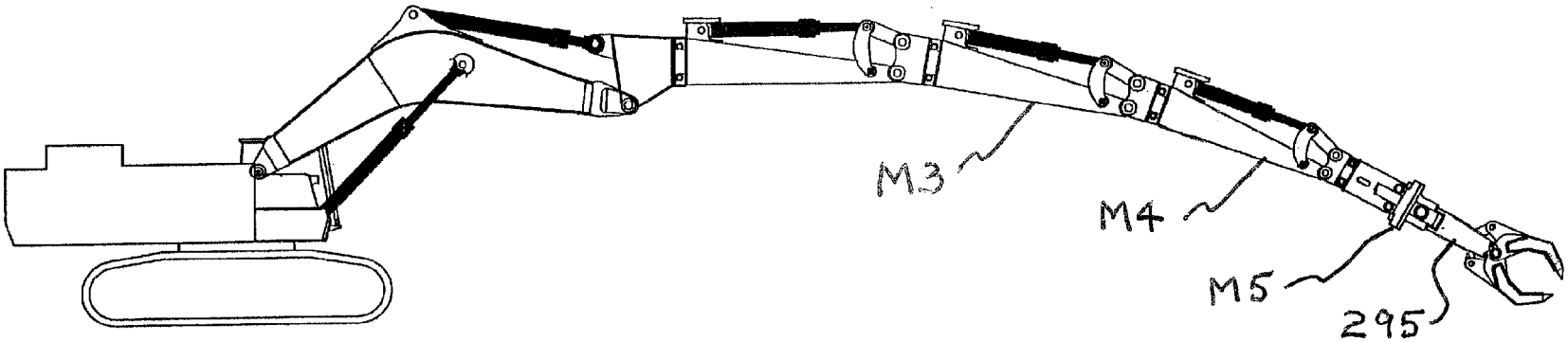
FIG. 39 is a sketch of a construction machine utilizing both a third member and a fourth member with a fifth member grapple attached thereto.
Figure 40:
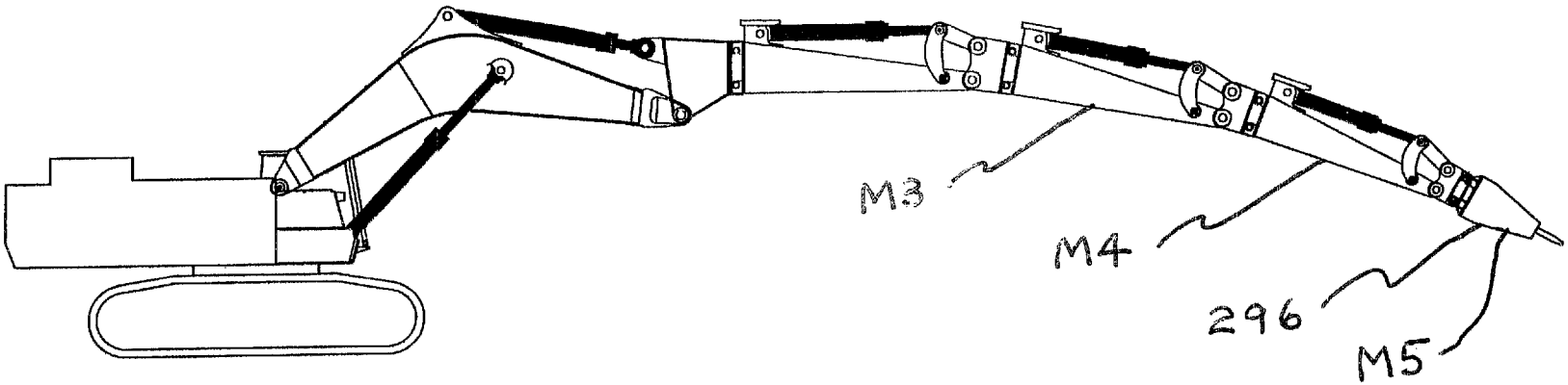
FIG. 40 is a sketch of a construction machine utilizing a third member and a fourth member with a hammer attached thereto as a fifth member.
Figure 41:
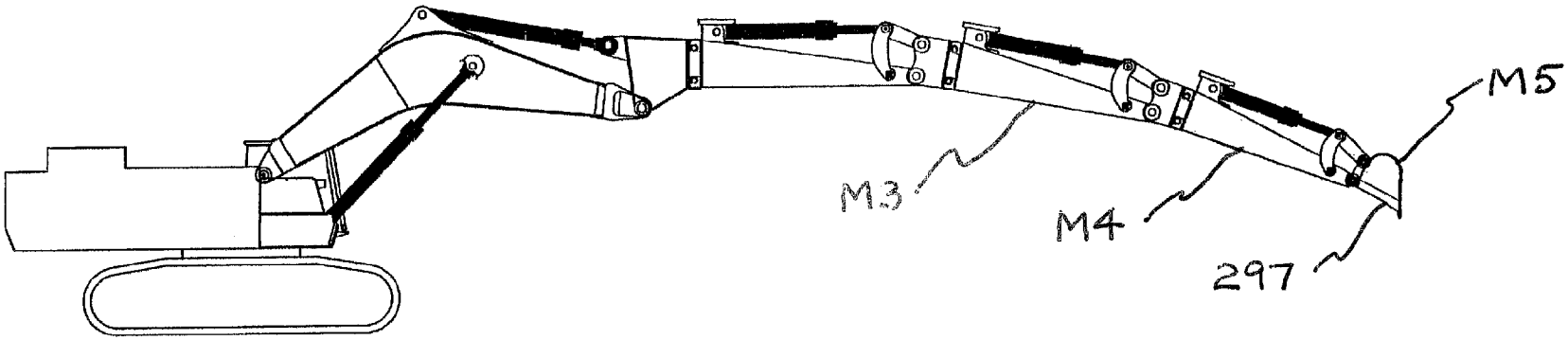
FIG. 41 is a sketch of a construction machine utilizing a third member and a fourth member with a bucket attached as a fifth member thereto.
Figure 42:
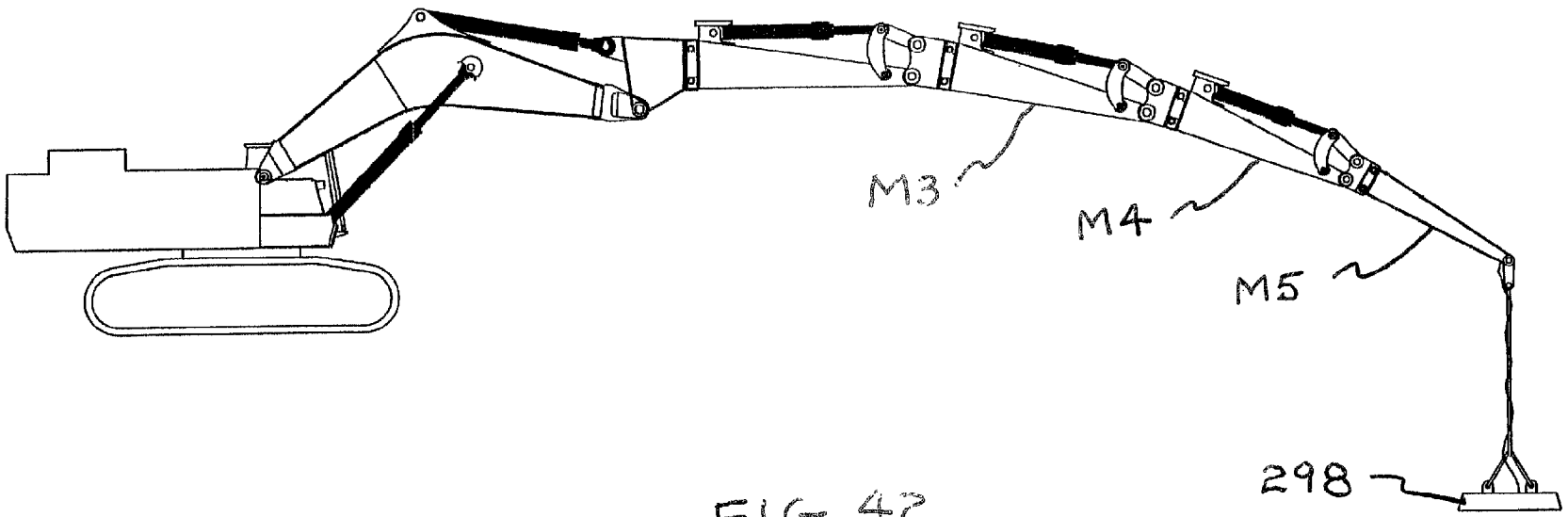
FIG. 42 is a sketch of a construction machine utilizing a third member and a fourth member with a magnet attached as a fifth member thereto.

FIG. 38 illustrates an electronic schematic showing the circuitry of the motion of the joystick or the controls on the joystick initiates with respect to different solenoids and with respect to different operations of the construction machine.

While the subject invention provides the flexibility to utilize tools at the end of any of the members M1, M2, M3, M4, it should be appreciated that with the addition of members, then as more members are added to the construction machine, the cantilevered weight of these members must be considered for stability of the construction machine. As a result, with the addition of each member the maximum allowable weight for a tool at the terminal end must be less. It is possible to attach to the boom member M1 a very large shear which requires a high flow of fluid through the hydraulic lines to achieve maximum power and maximum versatility. However, the size of this tool is limited in part by the weight of the tool relative to the maximum weight the boom can support. As more members are added to the boom M1, then the weight of the tool attached thereto must become smaller and by design, the size of the tool must become smaller. As a result, the fluid flow through the hydraulic line pairs necessary to operate the tool, such as shear open/close, would be much greater for a large tool attached to the boom member M1 than it would be for a tool M5 attached to member M4.

Figure 43:
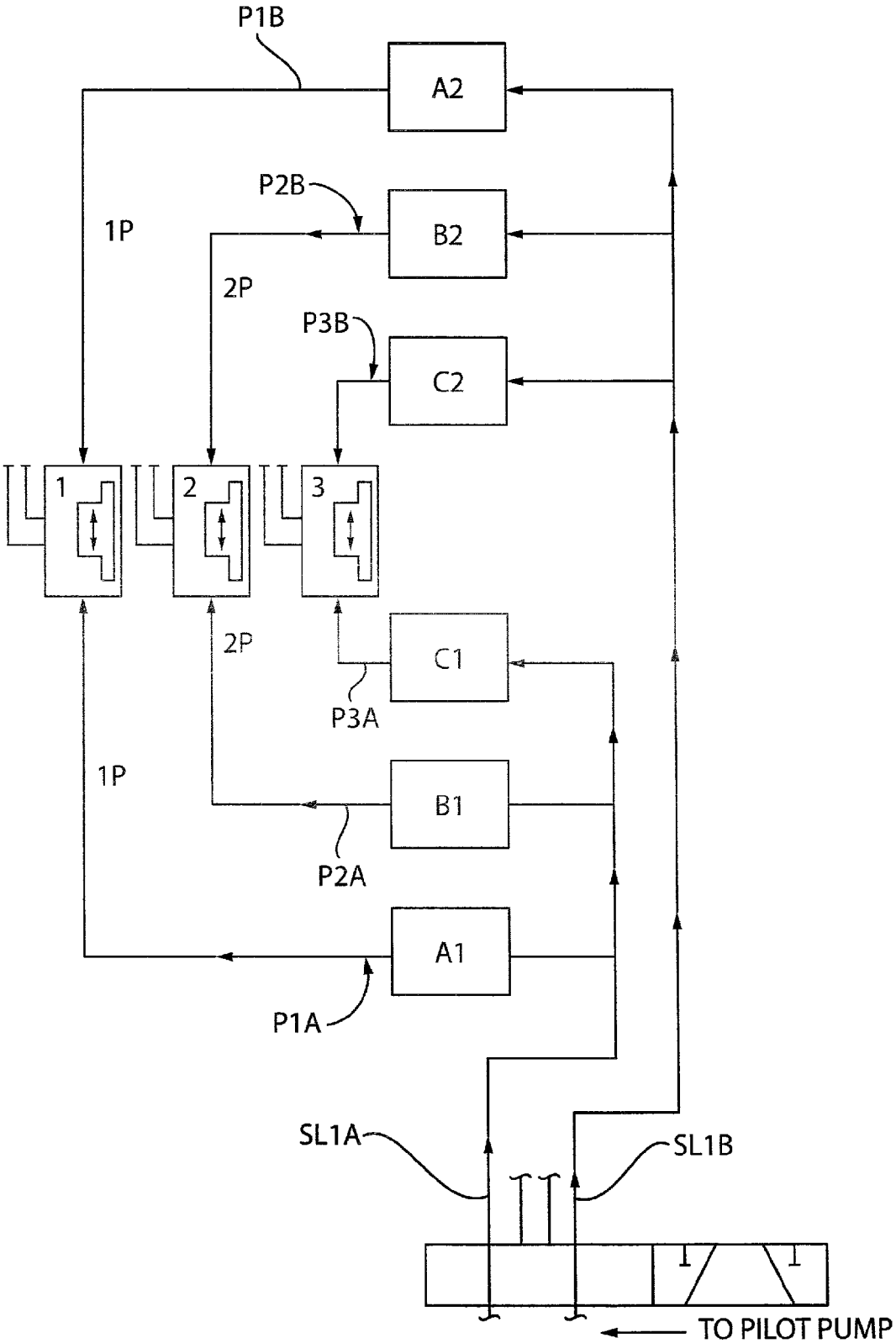
FIG. 43 is a simplified sketch of the hydraulic circuit utilized for selecting a flow rate from a number of predetermined flow rates to accommodate a particular size and a particular type of tool.

The subject invention includes the additional feature of adjusting the fluid flow through the hydraulic line pairs used for the tool function depending upon the number of members M2, M3, M4 from which a tool is secured. In particular, FIG. 43 illustrates a hydraulic schematic, whereby fluid provided by the pilot pump is routed through three pairs of pressure reducers with each pair associated with a main control valve. In particular, pressure reducer pair A1, A2 are directed to main control valve 1, pressure reducer modules B1, B2 are directed to main control valve 2, while pressure reducer modules C1, C2 are directed to main control valve 3. In their fully open state, the complete flow available from the pilot pump will be transferred to the main control valves 1, 2, 3 and each of those main control valves will then permit the maximum amount of fluid from the main pump for use for the tool function. This configuration would be utilized, for example, if a shear was mounted directly to the boom member M1. However, as additional members are added to the boom M1, and the tool size reduces, then it will be necessary to reduce the fluid flow to those tools. The pressure reducer pairs A1-A2, B1-B2, C1-C2 are each capable of reducing the flow by $1/3^{rd}$. Furthermore, each pressure reducer pair may provide full flow or reduce the flow by ½. Then, depending upon whether one or more of these pressure reducer modules are activated, the flow for the tool function may range from $1/16^{th}$ full flow to full flow in increments of $1/16^{th}$ flow for the tool function. These are prearranged settings and are entirely dependent upon the number of members added to the construction machine and these settings are independent from operator intervention. This feature makes possible the addition of multiple members M3, M4, M5 on a construction machine, while at the same time, conveniently adjusting the fluid flow to accommodate the design perimeters of each tool attached thereto.

Figure 44:
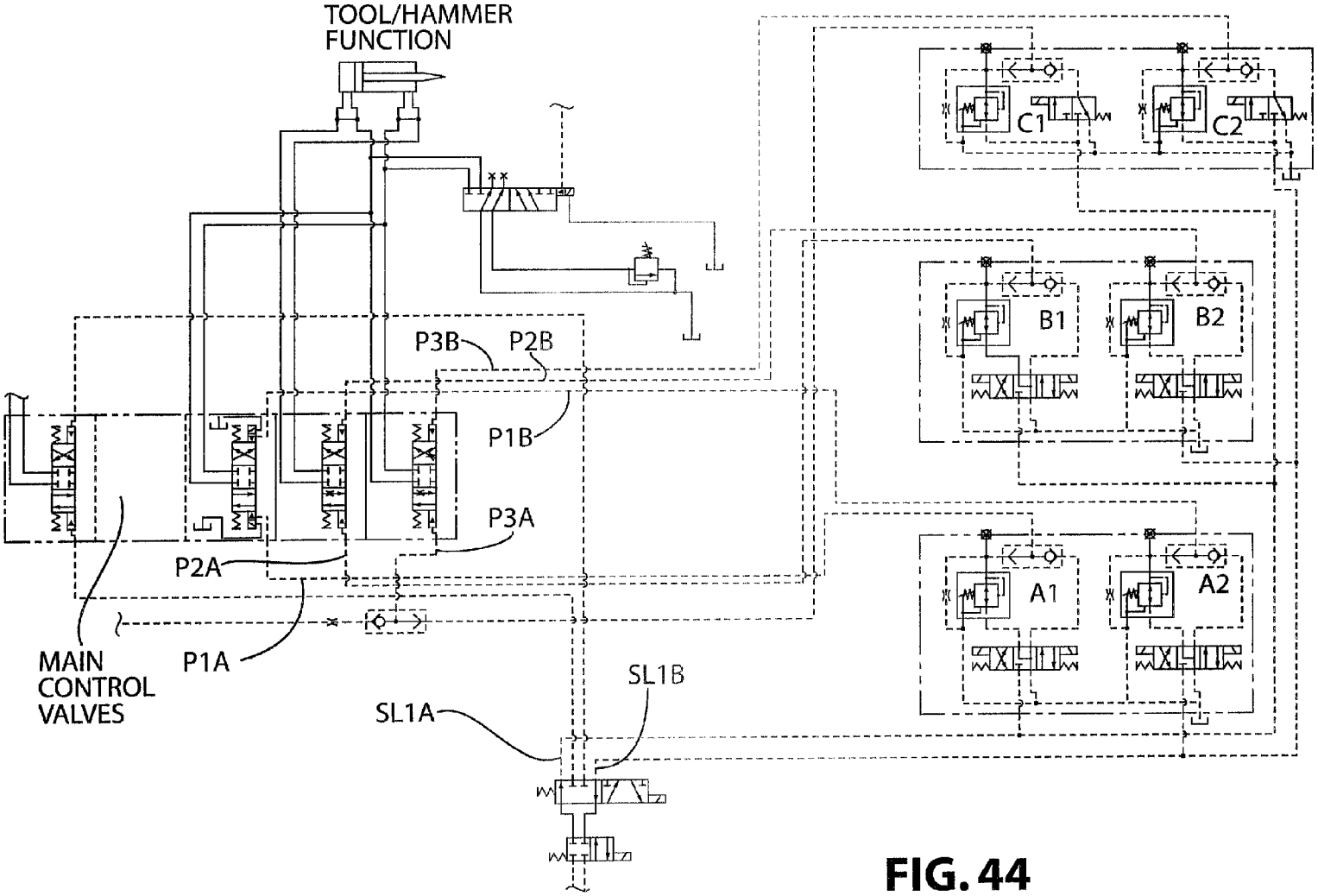
FIG. 44 is a detailed hydraulic circuit drawing of the simplified sketch found in FIG. 43.

FIG. 44 illustrates a detailed hydraulic flow diagram showing details of each of the valves and valve operation.

As a result, the arrangement illustrated in FIGS. 43 and 44 show at least a first and second main control valve 1, 2, wherein each main control valve 1, 2 is connected to and reciprocated by one of a separate first and second pair of pilot lines P1A, P1B and P2A, P2B. A pair of hydraulic supply lines SL1A, SL1B extend from a pilot pump and branch to connect with supply fluid to the at least first and second main control valves 1, 2. A separate pressure reducer module is connected between each of the first pair NA, P1B and the hydraulic supply line SL1A, SL1B. A separate pressure reducer module is connected between each of the second pair P2A, P2B and the hydraulic supply line SL1A, SL1B. The fluid flow from each of the main control valves 1, 2 may be varied by varying the pressure of the pressure reducer modules A1, A2, B1, B2 into the main control valve. As previously mentioned, the pressure reducer modules A1, A2, B1, B2 utilize one of a number of predetermined settings for a particular size and type of hydraulically operated accessory attached to a terminal. While so far discussed is the implementation of two pairs of pressure reducer modules A1, A2, B1, B2, it should be appreciated that, as illustrated in FIG. 43, yet another pair of pressure reducer modules C1, C2 are introduced and it should be appreciated that the subject invention should not be limited to three pairs of such pressure reducer modules but as many as needed to provide as many incremental fluid flows as necessary may be introduced.

Figure 45:
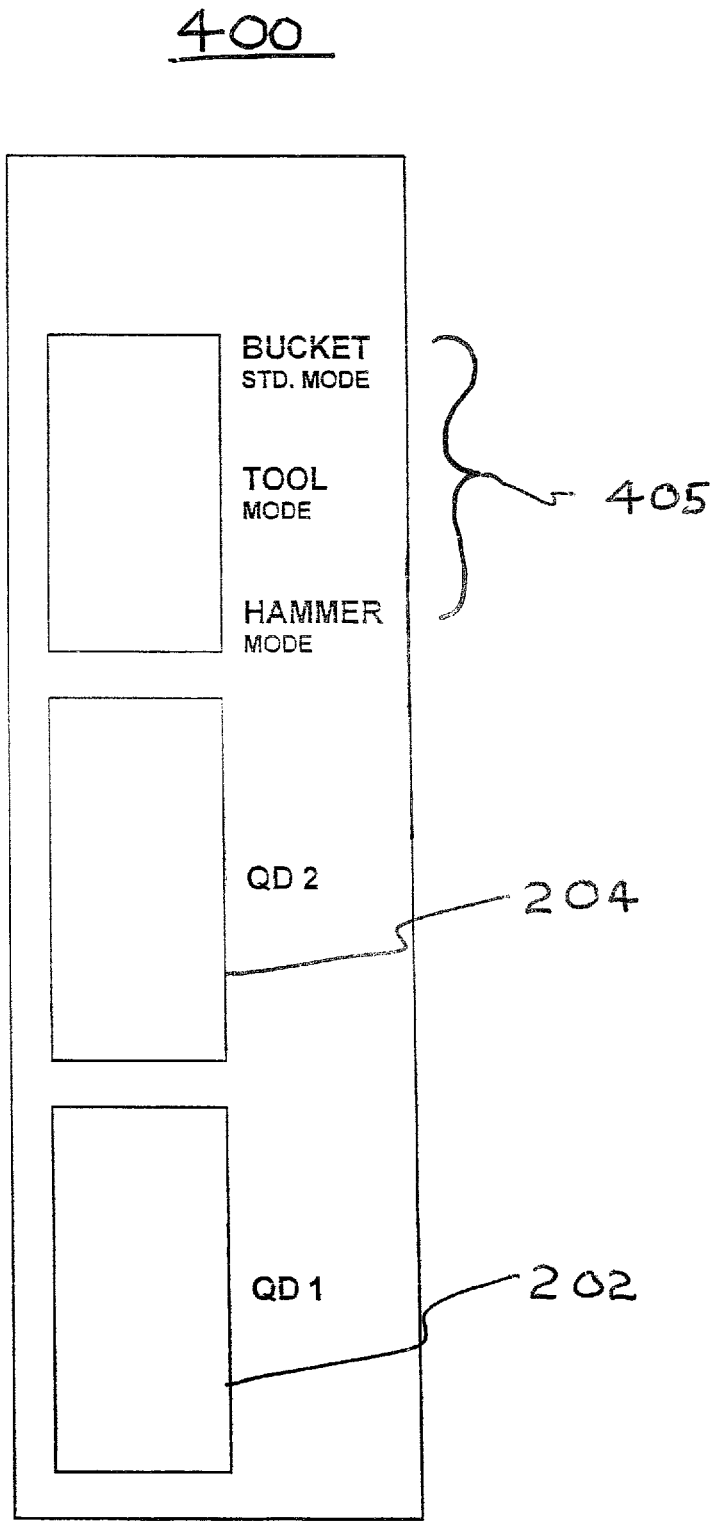
FIG. 45 is a sketch of the master controller utilized to reassign the function of the joysticks/pistol grip buttons for customization to a particular task.

Directing attention to FIG. 45, a master control panel 400 includes three separate toggle switches which are the boom quick disconnect toggle switch 202, the stick quick disconnect toggle switch 204, and the bucket/tool/hammer toggle switch 405. The toggle switch energizes the different functions described with the hydraulic circuitry in FIG. 33 for the three modes described with FIG. 33.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A system for activating hydraulic circuits necessary for different functions on a construction machine having a boom as a first member pivotally moved by a first hydraulic cylinder, a stick as a second member pivotally moved by a second hydraulic cylinder, a hydraulic tank with fluid therein, a hydraulic pump for providing fluid to hydraulic supply lines, wherein each hydraulic supply line has a related hydraulic return line for returning the fluid to the hydraulic tank thereby defining hydraulic line pairs and, wherein each pair of hydraulic lines ends at a terminal adapted to control a hydraulically operated accessory, wherein the hydraulic accessory is one of a bucket, a shear, a grapple, a hammer, a crusher or a magnet, comprising:

a) at least two fixed-function hydraulic line pairs dedicated to providing fluid to control predetermined machine functions;

b) a first open-function hydraulic line pair for providing fluid to one of a bucket branch line pair or to a tool branch line pair, wherein the fluid in the bucket branch line pair is connected with and controls a third hydraulic cylinder for curling/dumping a bucket extending from the end of the second member and wherein the tool branch line pair is not connected with and does not control a hydraulic cylinder for curling/extending a member but controls reciprocating fluid to a dual function hydraulic line pair for operating a hydraulic tool;

c) a diverter valve connected with the first open function line pair for diverting fluid to one of the bucket or tool branch line pairs;

d) a first open-function flow control valve for the first open function hydraulic line pair wherein the valve is between the diverter valve and the pump and wherein the flow control valve reciprocates the flow in the open function line pair thereby reciprocating the flow in the bucket branch line or in the tool branch line pair;

e) a hammer fixed line pair connected with a hydraulic hammer for providing hydraulic fluid in a single direction for operating the hydraulic hammer, wherein the hammer fixed line pair merges with at least one line of a dual function hydraulic line pair at a shuttle check valve, such that only one at a time of the hammer fixed line pair or the tool branch line pair communicates with the dual purpose hydraulic line pair such that the same dual function hydraulic line pair is used for operating a hydraulic tool with reciprocating fluid from the main pump or is used for operating a hydraulic hammer with pressurized fluid flow in a single direction from the main pump; and f) a flow control valve for the hammer fixed line pair which permits pressurized hydraulic fluid to travel in a single direction to the hammer.

2. The system according to claim 1, further including;

g) a third hydraulic cylinder fixed line pair for providing hydraulic fluid to the third hydraulic cylinder for extending/retracting a third member; and h) a flow control valve for the third hydraulic cylinder fixed line pair which permits pressurized hydraulic fluid to travel through the fixed line pair in a reciprocating fashion.

3. The system according to claim 2, wherein the flow control valve for the third hydraulic cylinder is a proportional slider switch.

4. The system according to claim 2, wherein the construction machine further includes a third member pivotally attached to the second member wherein the third hydraulic cylinder extends/retracts the third member.

5. The system according to claim 4, further including a hydraulic tool attached to the third member, wherein the hydraulic tool is one from the group consisting of a shear, a grapple, a hammer, a bucket, a crusher and a magnet.

6. The system according to claim 4, wherein a divider valve from the main pump directs fluid to the third hydraulic cylinder.

7. The system according to claim 4, further including a fourth hydraulic cylinder attached to the fourth member for extending/retracting a tool/member attached thereto; and i) a flow control valve for the third hydraulic cylinder which permits pressurized hydraulic fluid to travel through the fixed line pair in a reciprocating fashion.

8. The system according to claim 4, wherein the construction machine further includes a fourth member pivotally attached to the third member and a fourth hydraulic cylinder pivotally attached to the third member wherein a fourth hydraulic cylinder extends/retracts the fourth member and is controlled by a flow control valve.

9. The system according to claim 7, wherein the flow control valve for the fourth hydraulic cylinder is a proportional slider switch.

10. The system according to claim 7, wherein the construction machine further includes a fourth member pivotally attached to the third member wherein the fourth hydraulic cylinder extends/retracts the fourth member.

11. The system according to claim 7, further including the hydraulic tool attached to the fourth member, wherein the hydraulic tool is one from the group consisting of a shear, a grapple, a hammer, a bucket, a crusher and a magnet.

12. The system according to claim 7, wherein a second divider valve from the main pump directs fluid to the fourth hydraulic cylinder.

13. The system according to claim 10, further including a fifth hydraulic cylinder attached to the fourth member for extending/retracting a tool/member attached thereto; and j) a flow control valve for the fifth hydraulic cylinder which permits pressurized hydraulic fluid to travel through the fixed line pair in a reciprocating fashion.

14. The system according to claim 7, wherein the flow control valve for the fourth hydraulic cylinder is a proportional slider switch.

15. The system according to claim 12, wherein one or more of the flow control valves are proportional valves having fluid output proportional to the displacement of controller on the valve.

16. The system according to claim 1, wherein the hammer fixed line pair has connected thereto a pressure relief valve set at a pressure less than that provided by the main pump.

17. A system for activating hydraulic circuits necessary for different functions on a construction machine having a boom as a first member pivotally moved by a first hydraulic cylinder, a stick as a second member pivotally moved by a second hydraulic cylinder, a hydraulic tank with fluid therein, a hydraulic pump for providing fluid to hydraulic supply lines, wherein each hydraulic supply line has a related hydraulic return line for returning the fluid to the hydraulic tank thereby defining hydraulic line pairs and, wherein each pair of hydraulic lines ends at a terminal adapted to control a hydraulically operated accessory, wherein the hydraulic accessory is one of a bucket, a shear, a grapple, a hammer, a crusher, or a magnet, comprising:

a) at least a first and a second main control valve, wherein each main control valve is connected to and reciprocated by one of a separate first and second pair of pilot lines;

b) a hydraulic supply line pair extending from a pilot pump and branching to connect with and supply fluid to the at least first and second main control valves;

c) a separate pressure reducer module connected between each of the first pair of pilot lines and the hydraulic supply line pair;

d) a separate pressure reducer module connected between each of the second pair of pilot lines and the hydraulic supply line pair;

e) wherein the fluid flow from each of the main control valves may be varied by varying the pressure from the pressure reducer module into the main control valve; and f) wherein the pressure modules utilize one of a number of predetermined settings for a particular size and type of hydraulically operated accessory attached to the terminal.

18. A system for activating hydraulic circuits necessary for different functions on a construction machine having a boom as a first member pivotally moved by a first hydraulic cylinder, a stick as a second member pivotally moved by a second hydraulic cylinder, a hydraulic tank with fluid therein, a hydraulic pump for providing fluid to hydraulic supply lines, wherein each hydraulic supply line has a related hydraulic return line for returning the fluid to the hydraulic tank thereby defining hydraulic line pairs and, wherein each pair of hydraulic lines ends at a terminal adapted to control a hydraulically operated accessory, comprising:

a) at least two fixed-function hydraulic line pairs dedicated to providing fluid to control predetermined machine functions;

b) a first open-function hydraulic line pair for providing fluid to one of a bucket branch line pair or to a tool branch line pair, wherein the fluid in the bucket branch line pair controls a third hydraulic cylinder for curling/extending a bucket extending from the end of a second member and wherein the tool branch line pair controls reciprocating fluid to a dual purpose hydraulic line pair for operating a hydraulic tool;

c) a diverter valve associated with the first open function line pair for diverting fluid to one of the bucket or tool branch line pairs;

d) a first open-function flow control valve for the first open function hydraulic line pair wherein the valve is between the diverter valve and the pump and wherein the flow control valve reciprocates the flow in the open function line pair thereby reciprocating the flow in the bucket branch line or in the tool branch line pair;

e) a hammer fixed line pair for providing hydraulic fluid in a single direction for operating a hydraulic hammer, wherein the hammer fixed line pair merges with the dual function hydraulic line pair at a shuttle check valve, such that only one at a time of the hammer fixed line pair or the tool branch line pair may communicate with the dual purpose hydraulic line pair;

f) a flow control valve for the hammer fixed line pair which permits pressurized hydraulic fluid to travel in a single direction to the hammer;

g) a third hydraulic cylinder fixed line pair for providing hydraulic fluid to the third hydraulic cylinder for extending/retracting a third member; and h) a flow control valve for the third hydraulic cylinder fixed line pair which permits pressurized hydraulic fluid to travel through the fixed line pair in a reciprocating fashion.

* * * * *